US005365239A

United States Patent [19]

Stilwell, Jr.

[11] Patent Number: 5,365,239

[45] Date of Patent: Nov. 15, 1994

[54] FIBER OPTIC FEED AND PHASED ARRAY ANTENNA

[75] Inventor: P. Denzil Stilwell, Jr., Cheverly, Md.

[73] Assignee: The United States of America as represented by the Secretary of the Navy, Washington, D.C.

[21] Appl. No.: 788,704

[22] Filed: Nov. 6, 1991

[51] Int. Cl.[5] ..... H01Q 3/22; H01Q 3/24

[52] U.S. Cl. ..... 342/368; 342/424

[58] Field of Search ..... 342/368, 371, 372, 54, 342/156, 157, 424

[56] References Cited

U.S. PATENT DOCUMENTS

| | | | |
|---|---|---|---|
| 3,878,520 | 4/1975 | Wright et al. . | |
| 4,864,312 | 9/1989 | Huignard et al. | 342/375 |
| 4,885,589 | 12/1989 | Edward et al. | 342/175 |
| 4,929,956 | 5/1990 | Lee et al. | 342/376 |
| 4,965,603 | 10/1990 | Hong et al. | 342/372 |

OTHER PUBLICATIONS

Stilwell et al., "Fiber Optic Feed", NRL Memorandum Report 6741, Nov. 6, 1990, 44 pages.

*Primary Examiner*—Theodore M. Blum
*Attorney, Agent, or Firm*—Thomas E. McDonnell; Edward F. Miles

[57] ABSTRACT

A fiber optic feed includes an optical circuit for providing at least one optical output signal modulated according to an RF source and an antenna interface for demodulating the at least one optical output signal and communicating with an antenna, wherein the optical circuit includes a coherent light source, an interferometer driven by the coherent light source for synthesizing a plurality of independently controlled planar beams, an optic modulator for frequency modulating at least one of the independently controlled planar beams according to the RF source and an optic pickup for producing the at least one optical output signal according to a superposition of the plurality of independently controlled planar beams, wherein the interferometer includes at least one beam deflector for angularly deflecting at least one of the plurality of independently controlled beams according to a beam control command.

A phased array antenna includes an optical circuit for providing at least one optical output signal modulated according to an RF source and an antenna module for demodulating the at least one optical output signal and communicating with at least one RF radiating element, wherein the optical circuit includes a coherent light source, an interferometer driven by the coherent light source for synthesizing a plurality of independently controlled planar beams, an optic modulator for frequency modulating at least one of the independently controlled planar beams according to the RF source, and an optic pickup for producing the at least one optical output signal according to a superposition of the plurality of independently controlled planar beams, wherein the interferometer includes at least one beam deflector for angularly deflecting at least one of the plurality of independently controlled planar beams according to a beam control command.

34 Claims, 35 Drawing Sheets

FIBER OPTIC FEED AND PHASED ARRAY ANTENNA

BACKGROUND OF THE INVENTION

1. Field of the Invention

This invention relates to the field of acousto-optics and array antennas. In particular, the invention relates to acousto-optic beam deflectors and acousto-optic modulators and to their use in the control of the array antenna pattern.

2. Description of the Related Art

The interaction between light and sound has been under active investigation. Robert Adler, describes an acousto-optic beam deflector using a Bragg cell deflector in a May, 1967 article in IEEE Spectrum entitled "Interaction Between Light and Sound". Following this, the development of acousto-optic beam deflectors has progressed rapidly. A conventional acousto-optic beam deflector comprises a piece of isotropic optic material, such as glass, or non-isotropic material, such as tellurium dioxide,in which a travelling longitudinal or shear acoustic wave has been excited. The travelling acoustic wave modulates the index of refraction of the glass through a stress optic effect. An incident light beam is then deflected by the travelling phase grating produced by the travelling acoustic wave.

FIG. 1 illustrates a conventional beam deflector. A point light source 4 and collimating lens 6 form laterally coherent collimated light beam 7 parallel to axis 2. Coherent light beam 7 passes through Bragg cell 8 as coherent light beam 9*a*. Light beam 9*a* is focused by Fourier lens 10 onto focal plane 12 at point 12*a*. When Bragg cell 8 is driven by acoustic source 8*a* the refractive index of the material from which Bragg cell 8 is made is modulated so that coherent beam 7 is partially defracted through an angle as light beam 9*b*. Light beam 9*b* is focused by Fourier lens 10 on focal plane 12 at point 12*b*. The amount of beam deflection varies according to the wavelength of the acoustic wave in Bragg cell 8, which in turn varies inversely with the frequency of acoustic source 8*a*. Therefore, a change in the frequency of acoustic source 8*a* will cause a change in the angle of deflection of the acousto-optic beam deflector.

A conventional application of the acousto-optic beam deflector of FIG. 1 is as a spectrum analyzer. An analyzer comprises an array of detector elements (not shown) disposed along Fourier plane 12 such that a separate detector is disposed at point 12*a*, point 12*b* and other points along Fourier plane 12. Light from light source 4 will be focused on one detector in the array disposed along Fourier plane 12 in accordance with the frequency of acoustic source 8*a*. In this way the frequency components that make up acoustic source 8*a* are determined.

It is also known that the acoustic wave modulates coherent beam 7 such that the frequency of beam 9*b* is decreased by the frequency of acoustic source 8*a*. However, if the travelling acoustic wave were initiated from the bottom of Bragg cell 8, as shown in the figure, then the frequency of beam 9*b* would be increased by the frequency of acoustic source 8*a*.

Thus, according to the prior art, acousto-optic beam deflection is always accompanied by frequency shift of the beam, and modulation of the beam is always accompanied by beam deflection.

Corporately fed phased array antennas and radars employing phased array antennas have been known in one form or another in the relevant arts. For example, U.S. Pat. No. 4,258,363 to Bodmar et al. describes a phased array radar system with an optical fiber feed. Beam steering of the radar beam is controlled by phase shifters in each TR module; however, there is no disclosure as to how the phase shifter controls are driven. The light generated in the laser diodes of the transmitting section and fed through optical fibers to the TR modules does not contain any encoded information as to beam forming or beam steering. Light generated in a laser diode within each TR module and modulated with the intermediate frequency signal generated in the mixer in each TR module has no coherence synchronization with corresponding lights from other TR modules. Accordingly, the additive combination of these lights in the fiber converging unit and in the combination of the outputs of the photodiodes may have unpredictable results due to constructive and destructive superpositioned phases.

U.S. Pat. No. 4,028,702 to Levine describes a fiber optic phased array antenna system for RF transmission comprising RF modulated optical carrier light carried on a plurality of optical fibers to a plurality of multichanneled fiber optic delay lines. Each multi-channel fiber optic delay line produces from its input optical signal a plurality of optical signals, each signal corresponding to a unique phase delay. All optical signals corresponding to a unique phase delay are fed into a switchable transducer to demodulate a selected optic signal. A desired phase gradient across radiator elements is produced by proper selection of the discretely switched phase delay signals. This arrangement makes it difficult to match phase shifts produced by the plurality of multi-channel fiber optic delay lines across all elements of the phased array.

U.S. Pat. No. 4,814,773 to Wechsberg et al. describes a fiber optic feed network for a radar comprising a conventional RF phased beam forming network, an optical feed network and a plurality of TR modules forming an antenna. The antenna beam is steered according to the conventional beam forming network.

U.S. Pat. No. 4,965,603 to Hong et al. describes an optical beam forming network for controlling a RF phased array. The beam forming network comprises a spacial weight computation system, a temporal control system and an optical fiber bundle that distributes optical signals to photodetector elements corresponding to radiation elements.

U.S. Pat. No. 4,814,774 to Herczfeld describes an optically phased array system and method. The system comprises a plurality of optical fibers each of which carries a modulated optical signal into a TR element. Each optical fiber is wrapped once around a substantially disk-shaped piezoelectric crystal, wherein the circumference of the crystal is controlled by a voltage applied to the crystal according to a desired phase delay.

U.S. Pat. No. 4,620,193 to Heeks describes an optical phased array radar, and in particular, a means to adjust an optical path length of an optical link between a central processor and an antenna element. The means comprises a means to sense the relative phase of a reflected signal with respect to an incident signal and then adjust the optical path length according to the sensed phase difference.

U.S. Pat. No. 3,878,520 to Wright et al. describes an optically operated microwave phased-array antenna system comprising an optical phase processor and an optical to microwave converter for driving the phased array antenna. The optical phase processor comprises a reference optical link and a plurality of modulated optical links, each modulated optical link being modulated by an optical modulator. The optical modulator comprises a beam splitter, a quarter-wave plate circular polarizer, a polarization analyzer, two light gates, a quarter-wave retardation plate and an optical combiner to modulate the phase of the modulated optical links.

U.S. Pat. No. 4,864,312 to Huignard et al. describes a device for optical control of a beam-scanning antenna comprising an array of spatial modulators, each modulator adjusting the optical path length to control phase by controlling electro-reflectance or by controlling electrically controllable refractive index.

U.S. Pat. No. 4,885,589 to Edward et al. describes an optical distribution of signals and antenna returns in a phased array radar system. The system provides a modulated and an unmodulated light to a plurality of elemental TR modules, each module having an optical switch which is switched according to a transmit mode or a receive mode. When transmitting, the optical switch passed the modulated light to a detector where it is amplified and passed to antenna element. When receiving, the optical switch passes the unmodulated light to an optical modulator to be modulated according to a received signal from the antenna element. Each TR module has its own conventional microwave phase shifter.

U.S. Pat. No. 4,507,662 to Rothenberg et al. describes an optically coupled array antenna comprising a first antenna array having an energy exchanging relationship with free space, a space coupling region, a second antenna array having an energy coupling relationship with the space coupling region and correspondingly coupled to elements of the first array, a third antenna array having an energy coupling relationship with the space coupling region, and a means for providing elements of the third antenna array with a signal having a preselected phase and amplitude according to a distribution across the array.

U.S. Pat. No. 4,929,956 to Lee et al. describes an optical beam former for high frequency antenna arrays comprising a constrained lens comprising a first array of optical lenses mounted on a first concave surface for receiving and collecting light emanating from a point, a second array of lenses mounted on a second concave surface for emanating light and an array of optical fibers connecting lenses in the first array with the corresponding lenses in the second array such that light emitted from a point in omni direction and received by the first array of lenses will be re-emitted by the second array of lenses as a parallel beam of light. The direction of the beam corresponds to the position of the originating point of light.

SUMMARY OF THE INVENTION

It is an object of the present invention to overcome limitations in the prior art.

It is another object of the present invention to modulate a light beam without deflecting the light beam.

It is yet another object of the present invention to deflect a light beam without modulating the light beam.

These and other objects are achieved by a non-modulating optic beam deflector comprising a first acousto-optic beam deflector, driven by a first modulating frequency and disposed in a beam having a beam frequency, the first beam deflector deflecting the beam through a first angle and frequency modulating the beam to one of increase and decrease the beam frequency according to the first modulating frequency; and a second acousto-optic beam deflector, driven by the first modulating frequency and disposed in the beam, the second beam deflector deflecting the beam through a second angle and frequency modulating the beam to the other of increase and decrease the beam frequency by the first modulating frequency so as to unmodulate the frequency modulation produced by the first acousto-optic beam deflector, whereby an output of the non-modulated optic beam deflector is deflected according to the first modulating frequency.

Yet another object of the present invention is achieved by a non-deflecting acousto-optic modulator comprising a first acousto-optic beam deflector, driven by a first modulating frequency and disposed in a beam having a beam frequency, the first beam deflector deflecting the beam through a first angle and frequency modulating the beam to one of increase and decrease the beam frequency according to the first modulating frequency; and a second acousto-optic beam deflector, driven by a second modulating frequency and complimentarily disposed in the beam, the second beam deflector deflecting the beam through an angle equal and opposite to the first angle and further frequency modulating the beam to one of increase and decrease the beam frequency according to the second modulating frequency, whereby an output of the non-deflecting acousto-optic modulator is modulated according to a combination of the first and second modulating frequencies.

Yet another object of the present invention is to provide a phased array antenna with integral fiber optic feed.

Yet another object of the present invention is to provide a conformally mounted phased array antenna.

Yet another object of the present invention is to provide a phased array antenna with monopulse beam forming.

Yet another object of the present invention is provide a phased array antenna for producing a mainbeam and at least one auxiliary beam.

Yet another object of the present invention is to provide a phased array antenna for producing a plurality of independently controlled antenna beams.

Yet another object of the present invention is to provide a phased antenna compatible with pulse compression waveforms.

Yet another object of the present invention is to provide a wide band phased array antenna.

Yet another object of the present invention is to provide a phased array antenna for producing displaced phase center subapertures.

These an other objects are achieved in a phased array antenna comprising an optical circuit for providing optical output signals modulated according to an RF source and antenna modules for demodulating the optical output signals and communicating with corresponding RF radiating elements, wherein the optical circuit includes a coherent light source, an interferometer driven by the coherent light source for synthesizing a plurality of independently controlled planar beams, an optic modulator for frequency modulating at least one of the independently controlled planar beams according to the RF source, an optic pickup for producing optical output signals according to a superposition of the plurality of independently controlled planar beams, and wherein the interferometer includes beam deflectors for angularly deflecting at least one of the plurality of independently controlled planar beams according to a beam control command.

These and other objects are achieved in a phased array antenna which comprises at least one fiber optic feed, each fiber optic feed for producing a respective plurality of RF signals according to at least one beam control command and modulated according to at least one RF source, and an antenna driven by the plurality of RF signals for transmitting and receiving according to the plurality of RF signals, wherein the antenna includes a plurality of TR modules, each module corresponding to a respective one of the plurality of RF signals and operating as a transmitter when a TR input of the module receives a transmit signal and operating as a receiver when the TR input of the module does not receive the transmit signal.

BRIEF DESCRIPTION OF THE DRAWINGS

The invention will be described in detail in the following description of the preferred embodiments with reference to the following figures. Lenses are omitted in many of the figures for simplicity. Briefly, the figures are.

DETAILED DESCRIPTION OF THE PREFERRED EMBODIMENTS

FIRST EMBODIMENT

Figure 1:
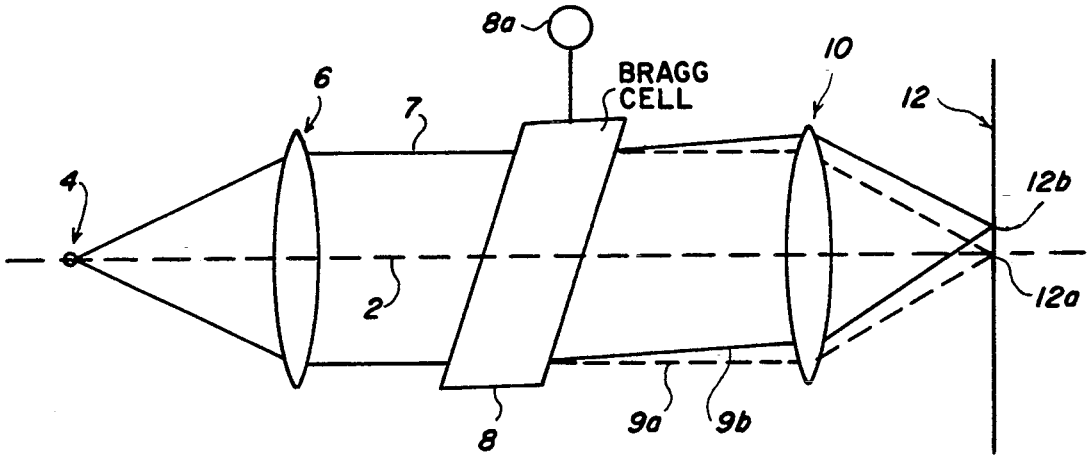
PRIOR ART FIG. 1
FIG. 1 is a schematic of a conventional acousto-optic beam deflector.
Figure 2:
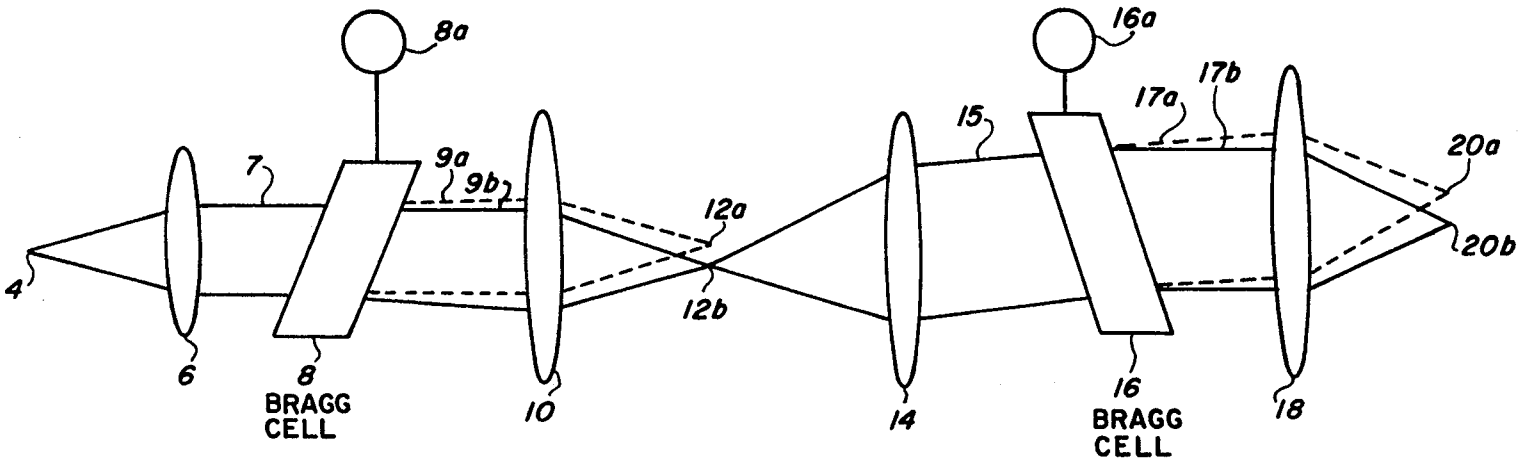
FIG. 2 is a schematic of a non-deflecting optic modulator.

FIG. 2 is a schematic of a non-deflecting acousto-optic modulator. In FIG. 2, light source 4 and collimating lens 6 produces coherent collimated light beam 7, a planar beam. When acoustic source 8*a* does not produce acoustic waves in Bragg cell 8, coherent light beam 7 passes through Bragg cell 8 as light beam 9*a* and is focused by Fourier lens 10 at point 12*a*. However, when acoustic source 8*a* produces acoustic waves in Bragg cell 8, coherent light beam 7 passes through Bragg cell 8 producing deflected beam 9*b* which is focused by Fourier lens 10 at point 12*b*. The light focused at point 12*b* has a frequency which has been modulated by the acousto-optic interaction within Bragg cell 8 to be higher than a frequency of light source 4 by an amount equal to the frequency of acoustic source 8*a*.

Collimating lens 14, Bragg cell 16 and Fourier lens 18 comprise the second half of the non-deflecting acousto-optic modulator. It will be appreciated that focused light at point 12*b* forms a light source for collimating lens 14 in a manner analogous to the way light source 4 provides light for collimating lens 6. It will also be appreciated that light from focal point 12*b* is below a neutral axis so that collimated light beam 15 is deflected above a neutral axis of the system composed of collimating lens 14, Bragg cell 16 and Fourier lens 18. Thus, as the deflection of point 12*b* caused by Bragg cell 8 is increased to greater deflection angles below neutral point 12*a*, the greater is the deflection of collimated light beam 15 above a neutral axis of the system comprising collimating lens 14, Bragg cell 16 and Fourier lens 18. If Bragg cell 16 were not driven by acoustic source 16*a*, light from point 12*b* which is collimated into light beam 15, would pass through Bragg cell 16 undeflected as light beam 17*a* which in turn would be focused by Fourier lens 18 at point 20*a*. When acoustic source 16*a* produces acoustic waves in Bragg cell 16, collimated light beam 15 is deflected as light beam 17*b* which in turn is focused by Fourier lens 18 at point 20*b*. A frequency of light focused at point 20*b* is equal to a frequency of collimated light beam 15 increased by a frequency of acoustic source 16*a*.

Thus, a frequency of light focused at 20*b* is increased by a frequency of acoustic source 16*a* over a frequency of light at point 12*b*, and a frequency of light focused at point 12*b* is increased by a frequency of acoustic source 8*a* over a frequency of light source 4. Accordingly, a frequency of light focused at 20*b* is increased (modulated) over a frequency of light source 4 by an amount equal to the sum of the frequency of acoustic source 8*a* and the frequency of acoustic source 16*a*. Therefore, the non-deflecting acousto-optic beam modulator of FIG. 2 modulates the frequency of light source 4 by the sum of the frequencies of acoustic sources 8*a* and 16*a*.

Further, Bragg cell 8 deflects collimated beam 7 downward below an axis of the system comprising collimating lens 6, Bragg cell 8 and Fourier lens 10. Collimating lens 14 inverts the downward deflection of point 12*b* so that collimated beam 15 is deflected upward above an axis of the system comprising collimating lens 14, Bragg cell 16 and Fourier lens 18 by the same angle that light beam 9*b* was deflected below an axis of the system comprised of collimating lens 6, Bragg cell 8 and Fourier lens 10. Collimated light beam 15 passes through Bragg cell 16 as deflected beam 17*b*, which is deflected downward according to acoustic source 16*a*. Without deflection in Bragg cell 16, collimated light beam 15 would pass through Bragg cell 16 as undeflected beam 17*a*. With deflection in Bragg cell 16, collimated light beam 15 passes through Bragg cell 16 as deflected beam 17*b* which is deflected downward below beam 17*a*. Deflected beam 17*b* is focused by Fourier lens 18 at point 20*b*.

It will be appreciated that collimated light beam 7 is deflected downward by Bragg cell 8 to produce deflected beam 9*b* which is focused by Fourier lens 10 at point 12*b* and that owing to the downward displacement of point 12*b* with respect to 12*a*, collimated beam 15 is deflected upward by an amount according to the amount which deflected beam 9*b* is deflected downward. Further, collimated light beam 15, which is deflected upward, is again deflected downward by Bragg cell 16 to produce deflected beam 17*b* which is focused by Fourier lens at point 20*b*. It will further be appreciated the components of the non-deflecting acousto-optic modulator of FIG. 2 can be selected so that the amount of downward deflection in deflected beam 9*b*, and thus upward deflection in collimated light beam 15, is exactly compensated by the amount of downward deflection in deflected beam 17*b*. It is thus possible to produce a non-deflecting acousto-optic modulator.

It will be appreciated that a non-deflecting acousto-optic modulator may be produced without elements 4, 6, 18 and 20*b*. Coherent collimated light beam 7 passes through the non-deflecting acousto-optic modulator as coherent collimated light beam 17*b*. Coherent collimated light beam 17*b* is undeflected with respect to coherent collimated light beam 7; however, it is modulated to have a frequency greater than a frequency of coherent collimated light beam 7 by the sum of the frequencies of acoustic source 8*a* and 16*a*.

In typical operations, Bragg cells 8 and 16 may be designed to produce frequency modulations in the microwave frequencies, such that the non-deflecting acousto-optic modulator typically modulates an incident light with a frequency ranging from 100 MHz through 10 GHz by concatenating groups of cells, for example 3 GHz.

SECOND EMBODIMENT

Figure 3:
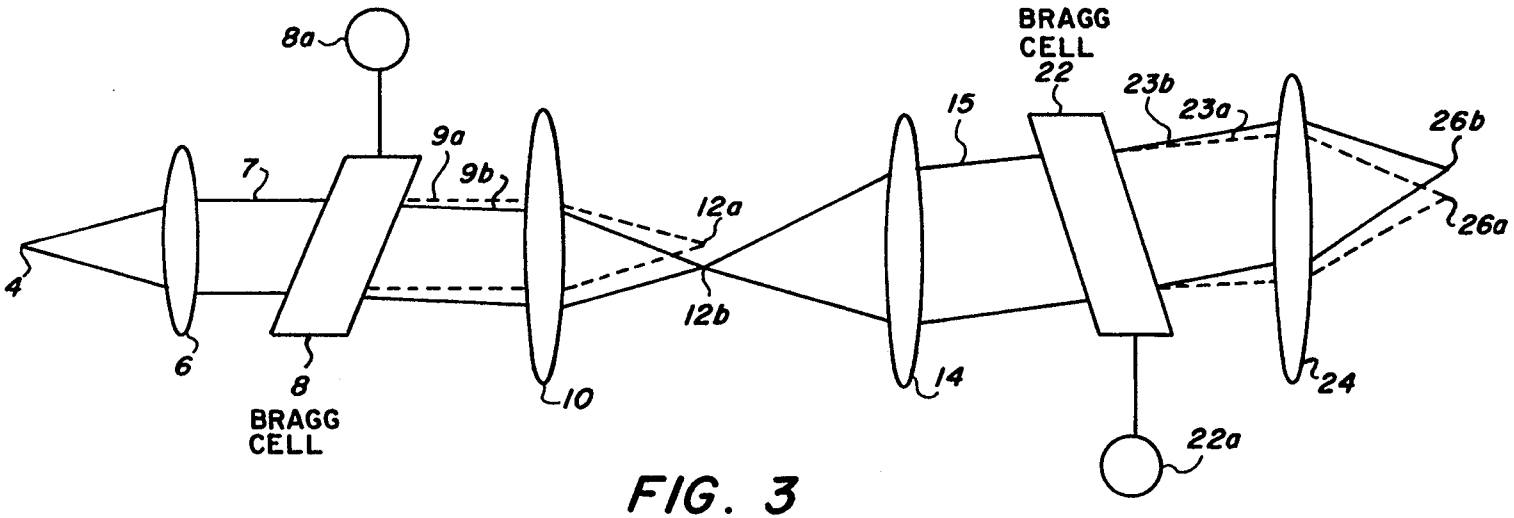
FIG. 3 is a schematic of a non-modulating optical beam deflector.

FIG. 3 is a schematic of a non-modulating acousto-optic beam deflector. The operation of the non-modulating acousto-optic beam deflector is substantially similar to the operation of the non-deflecting acousto-optic modulator. The operation of elements 4–18 of FIG. 3 are identical and will be not be further discussed. The difference is discussed in connection with the operation of elements 22–26*a* and 26*b* of FIG. 3.

As discussed in the first embodiment, collimated light beam 15 is deflected upward above an axis of the system comprised of collimating lens 14, Bragg cell 22, and Fourier lens 24 according to a frequency of acoustic source 8*a*. When acoustic source 22*a* provides no acoustic waves within Bragg cell 22, collimated light beam 15 passes through Bragg cell 22 as undeflected beam 23*a* which in turn is focused by Fourier lens 24 at focal point 26*a*. When acoustic source 22*a* produces acoustic waves within Bragg cell 22, collimated light beam 15 passes through Bragg cell 22 as deflected beam 23*b* which is deflected upward above undeflected beam 23*a*. Thus, the upward deflection of collimated light beam 15 according to a frequency of acoustic source 8*a* is added to the upward deflection produced in Bragg cell 22 according to a frequency of acoustic source 22*a*.

A frequency of light focused at point 12*b* is increased above a frequency of light source 4 by an amount of the frequency of acoustic source 8*a*. A frequency of light focused at point 26*b* is decreased by an amount of a frequency of acoustic source 22*a* below a frequency of light focused at point 12*b*. Thus, it will be appreciated that the components of the non-modulating acousto-optic beam deflector of FIG. 3 may be selected so that a frequency of light focused at point 26*b* is the same as a frequency of light source 4.

It will be appreciated that a non-modulating acousto-optic beam deflector may be produced without elements 4, 6, 24 and 26*b*. Accordingly, coherent collimated light beam 7 is deflected into coherent collimated deflected beam 23*b* according to frequencies of acoustic sources 8*a* and 22*a*, and when acoustic sources 8*a* and 22*a* are equal, a frequency of coherent collimated deflected beam 23*b* is equal to a frequency of coherent collimated light beam 7.

In operation, a non-modulating acousto-optic beam deflector is designed to be driven by acoustic sources having typical frequencies ranging from 50 MHz through 1 GHz, for example 500 MHz.

THIRD EMBODIMENT

Figure 4:
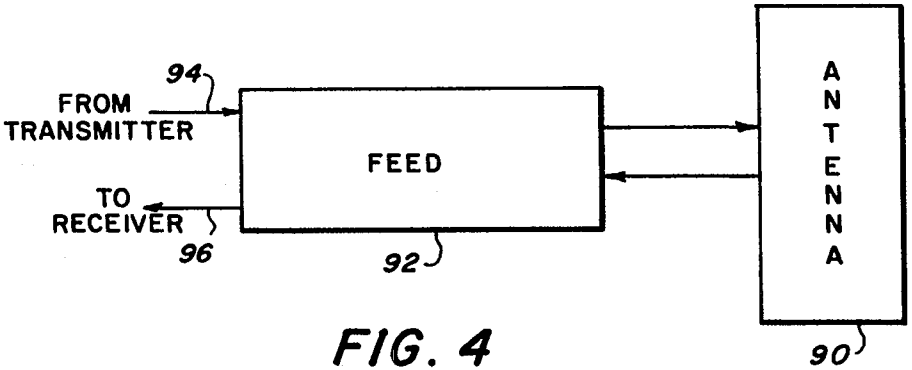
FIG. 4 is a block diagram of a general antenna/feed system.

Generally referring to FIG. 4, an antenna 90 is connected to a receiver 96 or transmitter 94 through a feed 92. The feed may be a simple transmission line or a complex power distribution system to distribute transmitter power to a multitude of radiating elements in an antenna array. The feed may collect received signals from a multitude of receiving elements in an antenna array and pass the collected signals to a receiver. A feed for an antenna array of necessity carefully controls the phases of signals fed to or from radiating elements in the array. Advanced feeds may perform beam forming by adjusting phases of signals fed to or from the elements of the array.

Figure 4A:
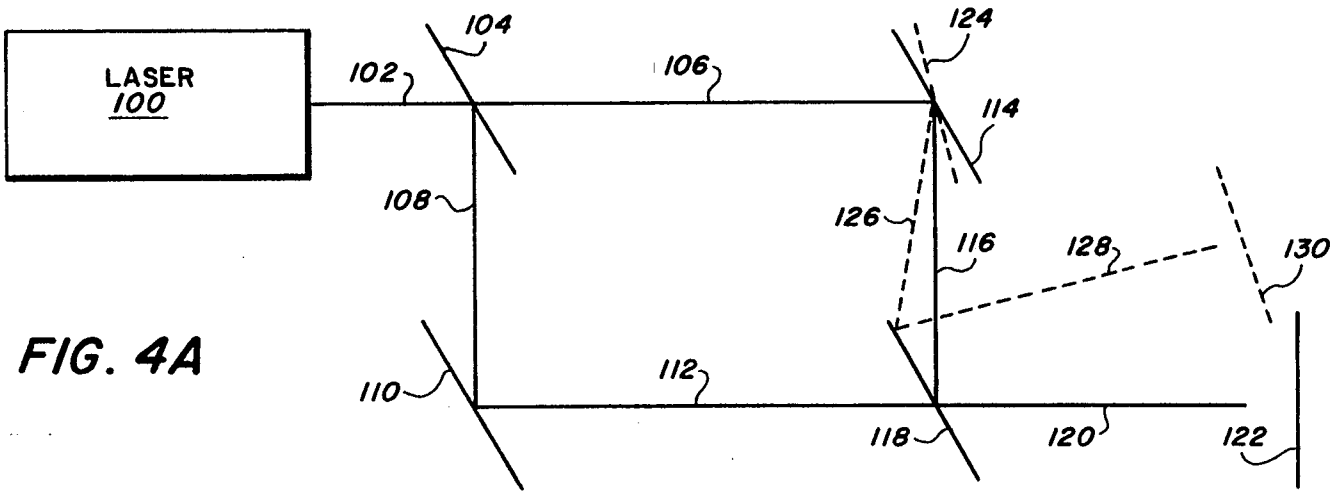
FIG. 4A is a Mach-Zehnder interferometer of the present invention.

FIG. 4A is a schematic of a Mach-Zehnder interferometer. In the interferometer, light source 100, typically a laser, produces coherent light beam 102. Coherent light beam 102 is split by beam splitter 104 into first beam 106 and split beam 108. Split beam 108 is reflected from mirror 110 as second beam 112. First beam 106 is reflected from mirror 114 as reflected first beam 116. Reflected first beam 116 and second beam 112 are combined in combiner 118 to produce combined beam 120. Wavefront 122 is perpendicular to an axis of combined beam 120 and represents a locus of points, all of which have the same phase angle in the electromagnetic waves that comprise combined beam 120. It will be appreciated that elements 102, 106, 108, 112, 116 and 120 depicted in FIG. 4 represent the center axis of respective light beams, and that respective light beams have finite beam widths. Light beam 102 is a coherent collimated beam having finite beam width. Accordingly, combined beam 120 has finite beam width. Because combined beam 120 has finite beam width and is a coherent collimated light beam, a locus of points 122 exists perpendicular to the travel direction of combined light beam 120, each point on the locus of points having identical phases. Thus, a planar wave is defined.

FIG. 4A also depicts misaligned first beam mirror 124 producing misaligned reflected first beam 126. Misaligned reflected first beam 126 is partially reflected off of combiner 118 to produce misaligned first beam component 128 of the combined beam.

Wavefront 130 of misaligned first beam component 128 is illustrated. It will be appreciated that the alignment of beam splitter 104, mirrors 110 and 114 and combiner 118 effect the angular orientation of wavefront 122.

Figure 5:
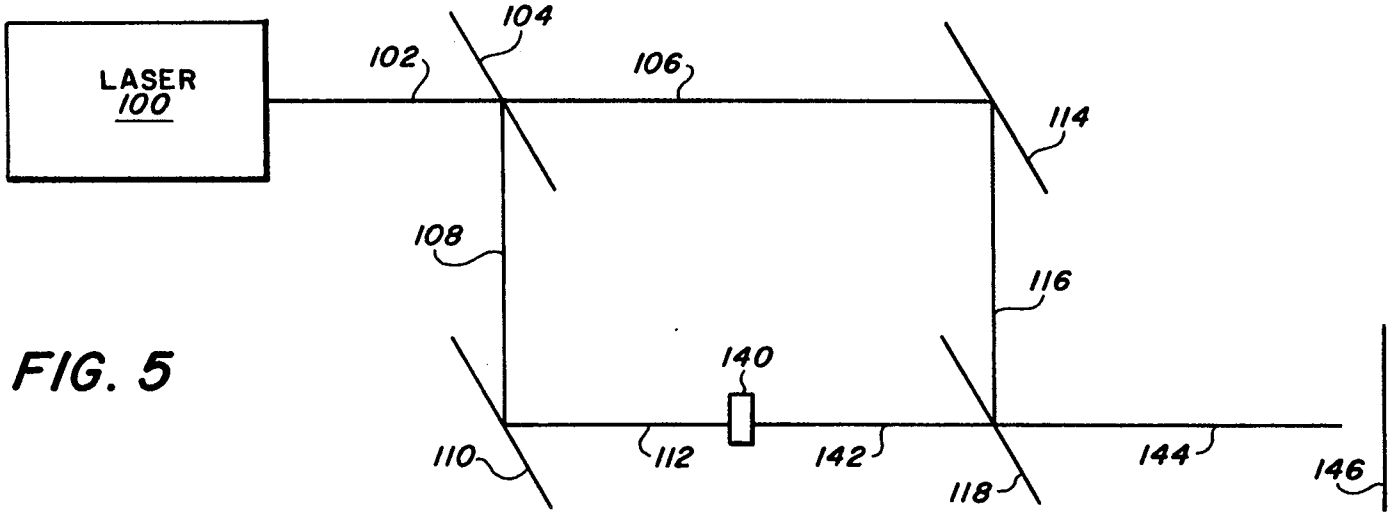
FIG. 5 is a Mach-Zehnder interferometer with acousto-optic modulator.

FIG. 5 is a Mach-Zehnder interferometer with non-deflecting acousto-optic modulator 140 disposed in second beam 112. An output of modulator 140 is modulated beam 142 having a frequency higher than a frequency of first beam 106 according to the frequency of the acoustic source of modulator 140. Modulator 140 is more fully described with reference to the embodiment described with respect to FIG. 2. Modulator 140 does not comprise elements 4, 6 and 18 as illustrated in FIG. 2. It will be appreciated that modulator 140 may be a non-deflecting electro-optic modulator.

In operation, modulator 140 produces modulated beam 142 having a frequency higher or lower than a frequency of first beam 106 by an amount that may range from 100 Mhz through 100 Ghz, and is typically 1 GHz to 10 GHz.

Modulated beam 142 and reflected first beam 116 are combined in combiner 118 to produce combined beam 144 having wavefront 146. Thus, combined beam 144 is a linear superposition of two superimposed beams of different frequencies. For example, $$E(t)=\cos(\Omega_1 t)+\cos(\Omega_2 t+\Phi_{12})$$

where $\Omega_1$ is the radian frequency of the first beam and $\Omega_2$ is the radian frequency of the modulated beam and $\Phi_{12}$ is the phase relationship between the phase of the first beam with respect to the phase of the modulated beam at the superimposed point within combined beam 144. For example, the phase may be determined at a point of the intersection of the axis of combined beam 144 and the line illustrated by wavefront 146. It will be appreciated that field strength E(t) may be mathematically described as, $$E(t)=2\times\cos[((\Omega_1=\Omega_2)t-\Phi_{12})/2]\times\cos[((\Omega_1+\Omega_2)t+\Phi_{12})/2]$$

The second mathematical representation of E(t) is easily recognized as an amplitude modulated wave having a carrier frequency $\Omega_c$ equal to the average of $\Omega_1$ and $\Omega_2$, and a modulation frequency $\Omega_m$ equal to half of the difference between $\Omega_1$ and $\Omega_2$. The term $\Phi_{12}$ is merely an arbitrary phase constant.

In operation, light source 100 produces coherent collimated light beam 102 (planar beam) having a frequency. For example when light source 100 produces light having a 600 nanometer wavelength, the frequency of the light is 500,000 GHz. Thus, first light beam 106 and second light beam 112 each have a frequency of 500,000 GHz. Modulator 140 increases the frequency of second light beam 112 by an amount of the modulation frequency, for example 20 GHz. Therefore, modulated light beam 142 has a frequency of 500,020 GHz. According to the second mathematical expression of E(t), the carrier frequency of the combined beam is 500,010 GHz and the modulation frequency of the combined beam is 10 GHz.

Figure 6:
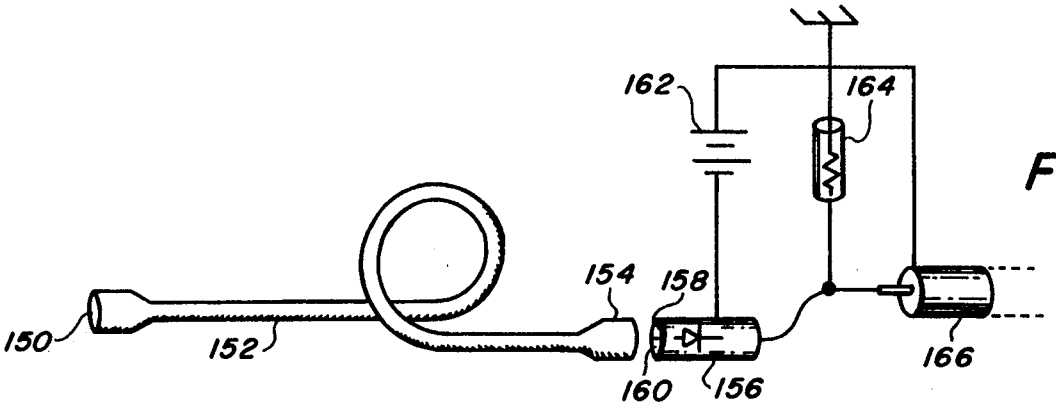
FIG. 6 is a schematic of a light detector of the present invention.

FIG. 6 is a schematic of a light detector of the present embodiment. Optic pickup 150 is disposed at a predetermined point in combined beam 144, for example at the intersection of the line illustrated by wavefront 146 and the axis of combined beam 144. Light from the combined beam is received by optic pickup 150 and travels through optical fiber 152 where it reaches optic cable end 154 which is disposed in confronting relationship with photodiode 156. Photodiode 156 is comprised of a semiconductor junction between N-type semiconductor 158 and P-type semiconductor 160. The photodiode 156 is configured in a circuit comprising power source 162, bias resistor 164 and output 166 and oriented so as to back bias the diode. When no light impinges the diode junction, little or no current flows in the circuit. However, light impinging on the diode junction creates electron-hole pairs which migrate under influence of the applied potential causing increasing current flow (photocurrent). The photocurrent is directly proportional to the intensity of the light impinging on the diode junction. Typical photodiodes are available that are responsive to wavelengths produced by most lasers. It will be appreciated that phototransistors, avalanche photodiodes and the like may be substituted for photodiodes.

The photocurrent varies in response to the intensity of light impinging on the diode junction. When the light intensity varies, for example sinusoidally at a frequency, so too will the photocurrent vary sinusoidally at the frequency of the light intensity variation. Thus, the detector demodulates the amplitude modulated light beam. Currently available photodiodes are able to demodulate amplitude modulated light beams where the amplitude modulated light beam is modulated at a frequency up to microwave and millimeter wave frequencies. Thus, when optic pickup 150 is disposed at a position of a line illustrated by wavefront 146 and along an axis of combined beam 144, the optical signal will be demodulated to produce a sinusoidal frequency according to the sinusoidal amplitude modulation in combined beam 144. For example, when the carrier frequency is 500,010 GHz and the amplitude modulation frequency is 10 GHz, the detector will provide a 10 GHz signal to output 166. It will be appreciated that output 166 may be a coaxial cable, strip line, micro strip, waveguide or the like. Thus, a microwave signal used to produce an acoustic source for modulator 140 is modulated on combined light beam 144 which travels a distance through optical fiber 152 and is eventually detected to produce a microwave output at output 166.

Figure 7:
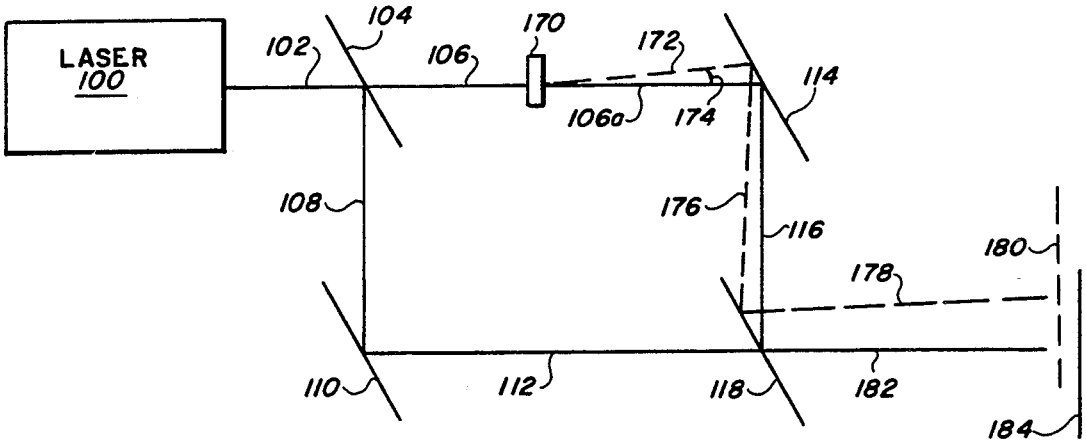
FIG. 7 is a schematic of a Mach-Zehnder interferometer with acousto-optic beam deflector.

FIG. 7 is a schematic of a Mach-Zehnder interferometer having non-modulating acousto-optic beam deflector 170 disposed in first beam 106. Non-modulating acousto-optic beam deflector 170 is further described with reference to the embodiment described with respect to FIG. 3. It will be appreciated that beam deflector 170 does not comprise elements 4, 6 and 24 of the beam deflector described with reference to FIG. 3. When no deflecting acoustic source is provided in beam deflector 170 first light beam 106 passes through beam deflector 170 as undeflected beam **106*a* which in turn is reflected by mirror 114 to produce reflected first beam 116. Reflected first beam 116 is then combined with second beam 112 on combiner 118 to produce an undeflected combined beam in the same manner as combined beam 120 is produced in reference to FIG. 4. However, when beam deflector 170 deflects first beam 106, it produces deflected beam 172 which is reflected by mirror 114 to produce reflected deflected first beam 176. Reflected deflected first beam 176 partially reflects off of combiner 118 to produce deflected first beam component 178 having wavefront 180. Second beam 112 passes through combiner 118 as second beam component 182 having wavefront 184. It will be appreciated that deflected beam 172 varies from undeflected beam 106*a* by deflection angle 174 and that wavefront 180 is askew from wavefront 184 by deflection angle 174**.

Figure 8:
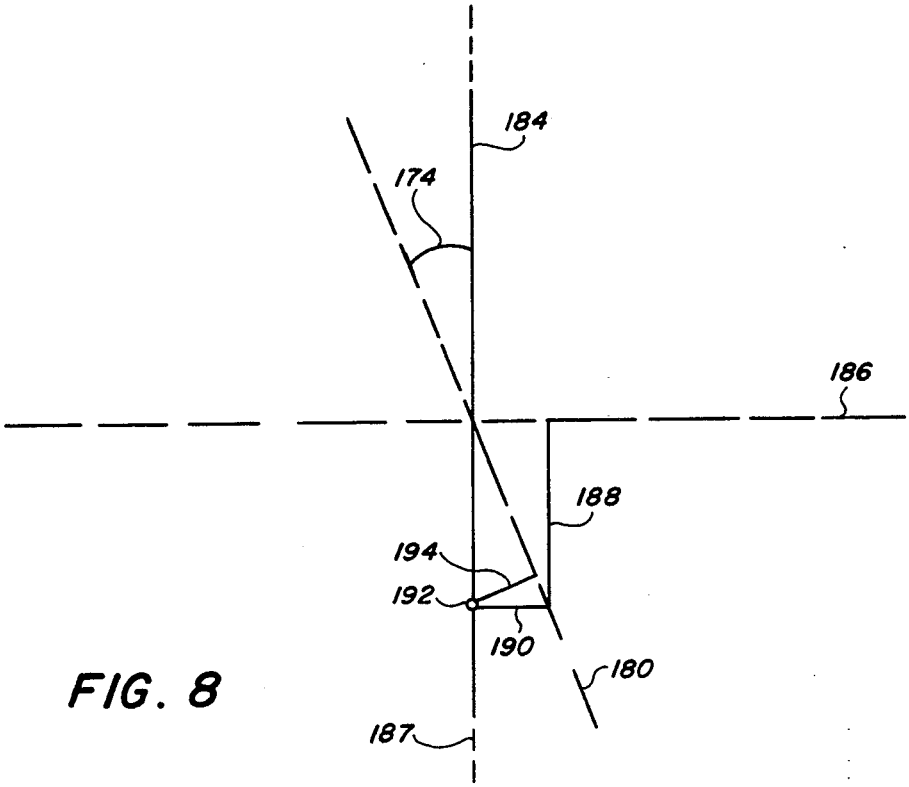
FIG. 8 is an enlarged view of superimposed wave fronts of the present invention.

FIG. 8 is an enlarged schematic of wavefront 180, wavefront 184, deflection angle 174, horizontal axis 186 of beam 182 and vertical axis 187. Deflection angle 174 is exaggerated in order to more clearly illustrate features of this embodiment illustrated in FIG. 8. Wavefront 184 traveling to the right is illustrated at a time when it is coincident with axis 187. At the intersection of axis 186 and axis 187, wavefront 180 has a defined phase relationship with respect to wavefront 184. At a point 192 offset from and below (in FIG. 8) axis 186 by distance 188, wavefront 180 has a different phase relationship to wavefront 184 for each different offset distance 188. Both wavefronts are traveling to the right in FIG. 8. Thus, wavefront 180 passes over point 192 before wavefront 184 when time is measured with respect to the defined phase relationship that exists between wavefronts 180 and 184 at the point of intersection between axes 186 and 187. With offset distance, y, defined by offset 188, wavefront 180 will be advanced in distance ahead of wavefront 184 by oblique distance 190 in the direction of axis 186 defined by $D=y$ tangent $\alpha$, where e is deflection angle 174. However, wavefront 180 does not travel in a direction parallel to axis 186. Instead, wavefront 180 has traveled a true distance 194 from point 192. Thus, by the time wavefront 180 reaches the intersection of axes 186 and 187, wavefront 180 has already traveled distance 194 from point 192 equal to $D=y \sin \alpha$. In radians, the phase of wavefront 180 is advanced ahead of the phase of wavefront 184 everywhere below axis 186 by an amount equal to $2\pi\sin(\alpha)y/\lambda$. At all points above axis 186 wavefront 180 is delayed behind wavefront 184 by a slight amount.

At any point along wavefront 184, there is a superposition of two waves. The first wave represented by wavefront 180 is $\cos(\Omega t-Ky)$ and the second wave represented by wavefront 184 is $\cos \Omega t$, where K is the radian phase shift per unit offset $2\pi\sin(\alpha)/\lambda$. The combination of the first and second waves is given by, $$E(t)=2^* \cos[-(Ky)/2]^* \cos[\Omega t-(Ky)/2],$$

where $\Omega$ is the radian frequency of the light. It is therefore appreciated that the first cosine term is a constant with time and varies only with offset along the y axis for any constant deflection angle 174, and the second cosine term varies with time with the same frequency as light source 100 but also varies in phase with offset y for any constant deflection angle 174.

Figure 9:
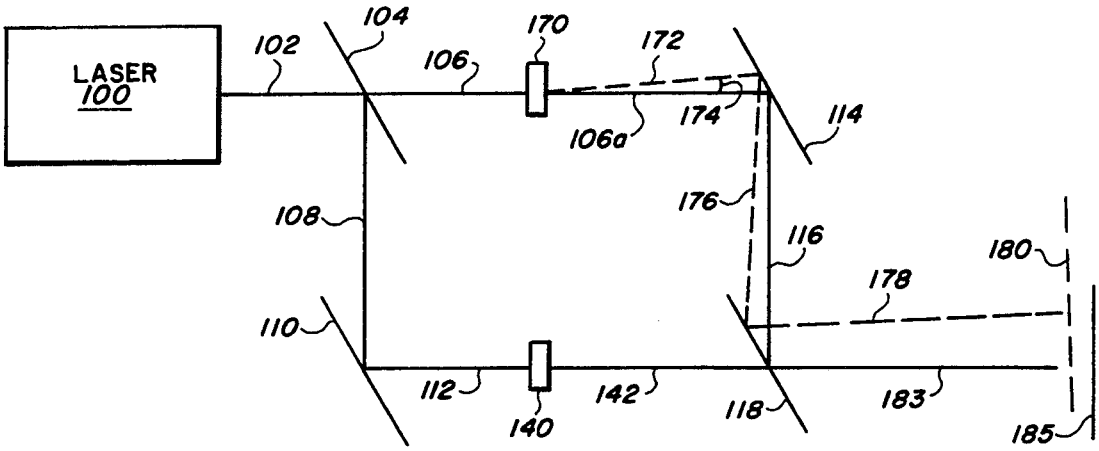
FIG. 9 is a schematic of a Mach-Zehnder interferometer with an acousto-optic beam deflector and acousto-optic modulator.

FIG. 9 is a schematic of a Mach-Zehnder interferometer with a non-modulating acousto-optic beam deflector 170 disposed in first beam 106 and a non-deflecting acousto-optic modulator 140 disposed in second beam 112. It will be apparent to persons skilled in the art that modulator 140 may be an electro-optic modulator. Deflected beam 178 having wavefront 180 is produced in the interferometer of FIG. 9 in the exact same way as deflected beam 178 having wavefront 180 was produced in the interferometer of FIG. 7. Modulated beam 142 in the interferometer of FIG. 9 is produced in the exact same way as modulated beam 142 was produced in the interferometer of FIG. 5. In FIG. 9, modulated beam 142 passes through combiner 118 as modulated beam 183 having a wavefront 185. Thus wavefront 180 is angularly disposed askew from wavefront 185 by deflection angle 174 and beam 178 has a frequency which is the same as the frequency of light beam 102; however, modulated beam 183 has a frequency which is higher or lower than the frequency of light beam 102 by an amount of the modulation frequency of modulator 140.

Figure 10:
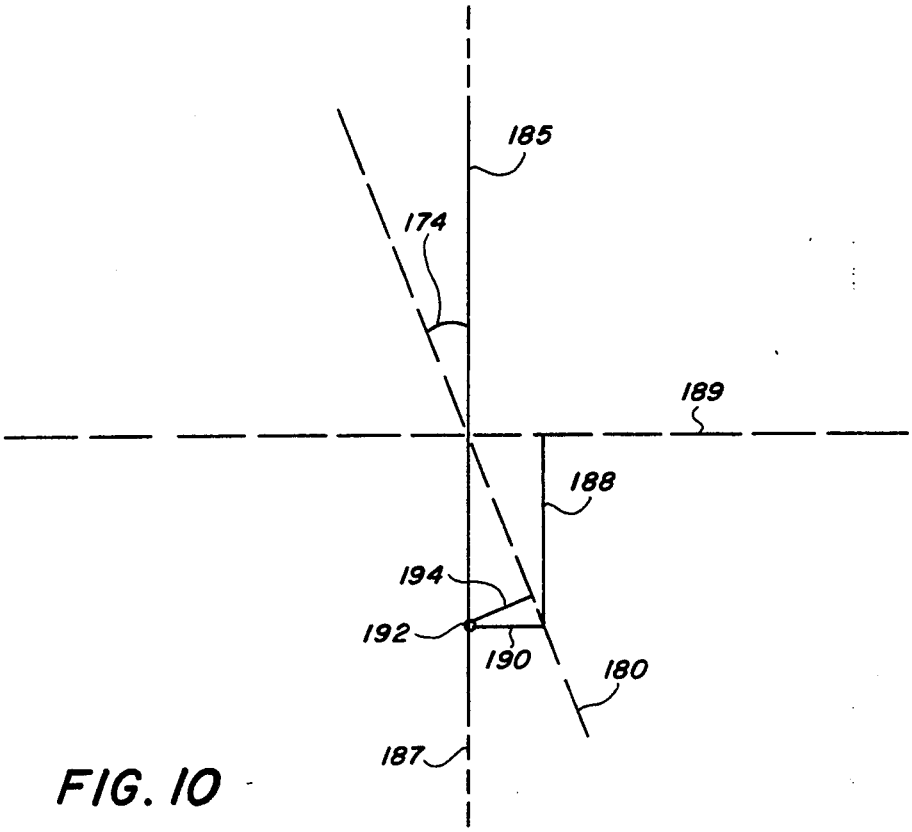
FIG. 10 is an enlarged view of the angular relationship between the wave fronts produced by the interferometer of FIG. 9.

FIG. 10 illustrates the angular relationship between wavefront 180 and wavefront 185. FIG. 10 is substantially similar to FIG. 8 with wavefront 185 in FIG. 10 replacing wavefront 184 in FIG. 8 and axis 189 in FIG. 10 of beam 183 replacing axis 186 in FIG. 8 of beam 182. In FIG. 10 wavefront 180 arrives at a point on vertical axis 187 at a time which is delayed behind or advanced in front of the time at which wavefront 185 passes the point on vertical axis 187 in accordance with a y offset from axis 189. A phase of wavefront 185 of beam 183 has a defined phase relationship with respect to a phase of wavefront 180 of beam 178 at an intersection of axes 187 and 189. With respect to this defined phase relationship, the phase of wavefront 180 is advanced at points along vertical axis 187 for offsets 188 below axis 189. Similarly, a phase of wavefront 180 is delayed at points along vertical axis 187 for offsets above axis 189.

At points along vertical axis 187, the field strength of deflected beam 178 is given by, $$E_1(t)=\cos(\Omega_1 t-K_1 y)$$

where $\Omega_1$ is the radian frequency of light beam 102 and $K_1$ is the lateral or "y" component of the wave propagation number for light beam 178 and is equal to $2\pi\sin(\alpha)/\lambda_1$ wherein $\lambda_1$ is the wavelength of light beam 102. The field strength of beam 183 at a point along vertical axis 187 is given by, $$E_2(t)=\cos(\Omega_2 t-K_2 y),$$

where $\Omega_2$ is the radian frequency of modulated beam 183 and $K_2$ is the wave propagation number of modulated beam 183 and is equal to zero. A superposition of $E_1(t)$ and $E_2(t)$ at any point along vertical axis 187 is expressed as, $$E_1(t)+E_2(t)=2\cos[((\Omega_1-\Omega_2)t-(K_1-K_2)y)/2]^*\cos[((\Omega_1+\Omega_2)t-(K_1+K_2)y)/2].$$

The detector, earlier described with reference to FIG. 6, will detect only the beat frequency component of the superimposed field strength $E_1(t)+E_2(t)$. The detected signal is given by, $$E_D(t)=1+\cos(\Delta\Omega t-\Delta Ky),$$

where $\Delta\Omega$ is $(\Omega_1-\Omega_2)=\omega t$ and $\Delta Ky$ is $(K_1y-K_2y)=ky$, where $\omega$ is the microwave radian frequency and k is the projected microwave propagation number and is equal to $2\pi\sin(\alpha)/\Lambda$ where $\Lambda$ is the microwave wavelength.

Thus, with optic pickup 150 disposed at any point along vertical axis 187, the detected signal $E_D$ is a function of time having a frequency of e and a phase proportional to offset distance 188, thus producing a desired phase gradient along vertical axis 187.

Figure 11:
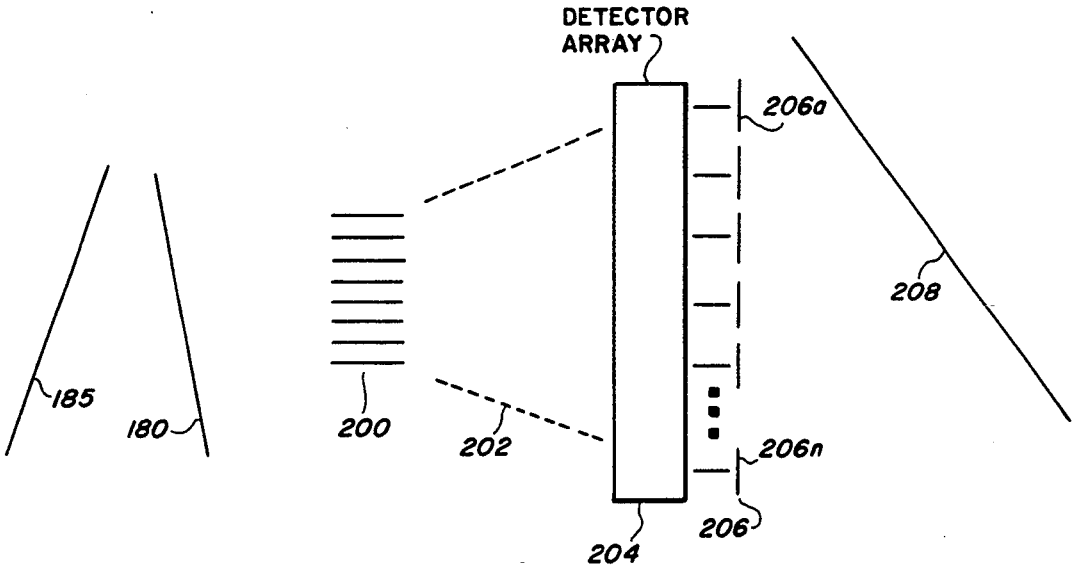
FIG. 11 is a schematic of a phased array microwave antenna using an optical feed.

FIG. 11 is a schematic of a phased array microwave antenna using an optical feed. Deflected beam 180 and modulated beam 185 of FIG. 11 are the same as corresponding beams of FIG. 10. Linear array 200 of optic pickup elements 150 are separated by distance s, usually about 100 times typical optical wavelengths. The plurality of optic pickup elements 150 in linear array 200 are connected by optic bundle 202 comprising a plurality of optical fibers 152 for carrying a plurality of optical signals to illuminate respective photodiodes 156 in the plurality of photodiodes which comprise detector array 204. Detector array 204 comprises a plurality of detector circuits each having power source 162, bias resistor 164, output 166 in addition corresponding photodiode 156. Each output 166 of detector array 204 is connected to a corresponding radiating element from **206*a* to 206*n* within radiating element array 206. Preferably radiating elements in array 206** are canonically spaced at $\Lambda/2$ intervals. Equivalent spacing of optical fibers ($\lambda/2$) is not possible. Typically spacing between fibers is $100\times\lambda$ apart. This gives rise to a significant angular deflection amplification.

When the antenna radiating elements are canonically spaced at $S=\Lambda/2$ and the optic pickups are spaced at $s=100\lambda$, the angular amplification is given by, $$(s/\lambda)\sin\theta=(S/\Lambda)\sin\Theta$$

where $\theta$ is the optic deflection angle 174 and $\Theta$ is the microwave launch angle represented by microwave front 208 of FIG. 11. Thus, for the example when $s=100\lambda$ and $S=\Lambda/2$, $$200\sin\theta=\sin\Theta.$$

It will be appreciated that at small angles the angular deflection amplification is approximately 200 to 1, and there is trigonometrically distorted amplifications at larger angles. For example, to achieve a microwave launch angle of 45° requires an optic deflection angle 174 of just 0.203° (3.535 mrad).

It is thus appreciated that the interferometer described with reference to FIG. 9 produces deflected wavefront 180 and modulated wavefront 185 which is fed to the antenna described with reference to FIG. 11 where the angle and frequency difference between wavefronts 180 and 185 produce microwave front 208 at microwave frequencies.

FOURTH EMBODIMENT

Figure 12:
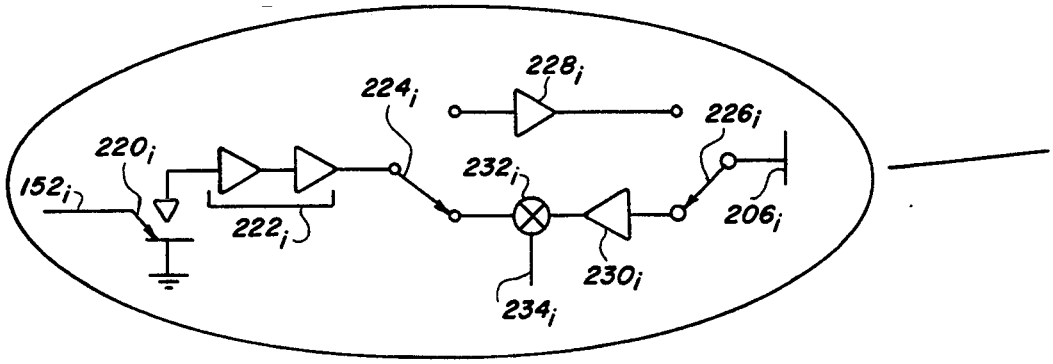
FIG. 12 is a circuit schematic of a TR module of the present invention.

FIG. 12 is a schematic representation of a TR module (transmit/receive module) representative of a TR module of this embodiment. In the TR module an optic signal is received over optical fiber $152_i$ which is disposed in confronting relation with avalanche photodiode $220_i$. Signals from avalanche photodiode $220_i$ are amplified, as required, by microwave amplifiers $222_i$. Avalanche photodiode $220_i$ and amplifiers $222_i$ are illustrated in FIG. 12, but it will be appreciated that avalanche photodiode $220_i$ and amplifier $222_i$ in FIG. 12 are equivalent to photodiode 156 and its associated circuit of FIG. 6. Microwave signals amplified by amplifiers $222_i$ are fed to microwave switch $224_i$. Microwave switch $224_i$ and microwave switch $226_i$ operate in tandem as a double pole double throw switch responsive to a transmit control command. Switches $224_i$ and $226_i$ are illustrated in FIG. 12 in a receiving switch position which is commanded when the transmit signal is off (i.e., when receiving). When the transmit signal is on, microwave signals from amplifiers $222_i$ are passed through switch $224_i$ to power amplifier $228_i$, and power amplified microwave signals from power amplifier $228_i$ are passed through switch $226_i$ to antenna radiating element $206_i$. An array of N TR modules, such as the TR modules shown in FIG. 12, connected in transmit configuration, comprise an active aperture array of a phased array antenna such as illustrated by fiber optic cable 202, antenna interface 204 and linear array 206 of FIG. 11.

When the transmit signal is off (i.e., when receiving) switches $224_i$ and $226_i$ are connected as illustrated in FIG. 12. A microwave signal received at antenna radiating element $206_i$ is passed through switch $226_i$ to amplifier $230_i$. It will be appreciated that typically amplifier $230_i$ will be a low noise wide dynamic range amplifier. Amplified received signals from amplifier $230_i$ are connected to a first input of microwave mixer $232_i$.

Meanwhile, an optic signal carried on optical fiber $152_i$ and detected by avalanche photodiode $220_i$ and amplified by amplifiers $222_i$ is passed through switch $224_i$ to a second input of microwave mixer $232_i$. The microwave mixer heterodynes the signals on the first and second inputs to mixer $232_i$ and provides the mixed signal at output $234_i$.

Figure 13:
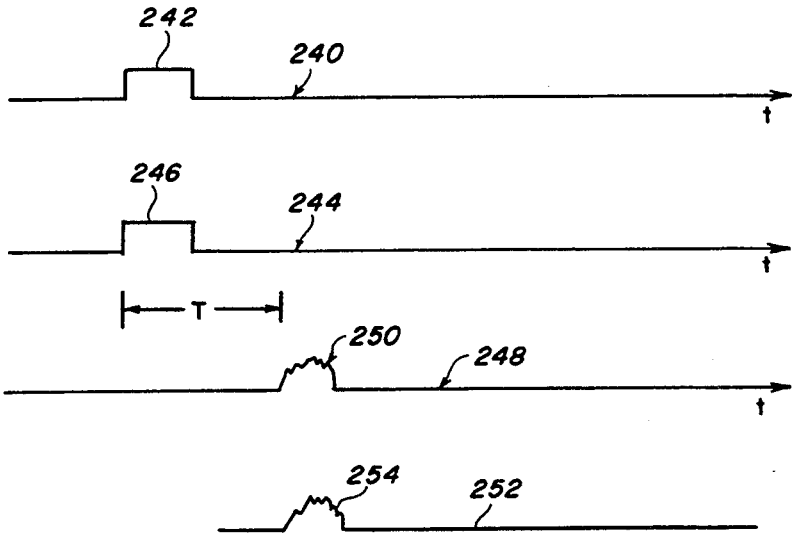
FIG. 13 is a timing diagram relating to the operation of the TR module of FIG. 12 in a radar having transmit and receive modes.

In operation, a frequency of a microwave signal provided by amplifiers $222_i$ is a first frequency when the TR module is transmitting and is a second frequency when the TR module is receiving. The first and second frequencies are defined according to the acoustic source frequency which drives non-deflecting acousto-optic modulator 140 of FIG. 9. In FIG. 13, transmit signal 240 is illustrated as a function of time where at 242 the transmit signal is on, indicating transmit mode for the TR module and the TR signal is off at all other times. The frequency of the microwave signal provided by amplifiers $222_i$ is a first frequency 246 when the transmit signal is on and is a second frequency 244 when the transmit signal is off. For example, the first frequency might be 10.4 GHz and the second frequency might be 10 GHz.

A microwave transmit beam, which radiates over the time duration when the transmit signal is on, is reflected by a distant target, and the reflected transmit beam returns to be received at antenna radiating element $206_i$ after a brief time delay T following initiation of the transmit signal. Reflected signal 248 having a frequency equal to the first frequency (transmit frequency) has a greater amplitude 250 when the microwave transmit beam is reflected from a target than at other times. The reflected microwave transmit beam has substantially the same frequency 246, plus doppler shift, as the transmit beam. The reflected signal is amplified in amplifier $230_i$ and provided to a first input of mixer $232_i$ at a time when amplifier $222_i$ is providing a microwave reference signal having a second (receive) frequency 244 which is passed through switch $224_i$ to the second input of mixer $232_i$. It will be appreciated that when the first frequency is 10.4 Ghz and the second frequency is 10.0 GHz, mixer output $234_i$ will have a frequency of 400 Mhz and an amplitude based on the amplitude of the reflected signal amplified by amplifier $230_i$ which is based on the reflection from the target.

When an array of the TR modules, such as the TR modules illustrated in FIG. 12, are employed as the N elements of 202, 204 and 206 of FIG. 11, a microwave transmit beam is launched from the array in the direction indicated by wavefront 208 when the transmit signal is on (placing TR modules in transmit mode). It will be appreciated that when the transmit signal is off (placing TR modules in receive mode) coherent signals received from a direction indicated by wavefront 208 will produce a phase gradient at the outputs of the amplifiers $230_i$ within the TR modules that complimentarily correspond to the phase gradient produced at the outputs of amplifiers $222_i$ so that the mixer output $224_i$ of each TR module will be in phase with each other. Thus, the phase gradient of the electrical phases provided by the outputs of amplifiers $222_i$ of the TR modules when in a receive mode directly control the launch/receive direction of the microwave receive beam. The mixer outputs $234_i$ from each TR module in the array are coherently superimposed to form a receive signal at an intermediate frequency.

Thus, it will be appreciated with respect to this embodiment that the TR modules described herein, when arrayed in an array as illustrated in FIG. 11, and in combination with a Mach-Zehnder interferometer as illustrated in FIG. 9 describe an active aperture phased array antenna that may be duplexed, providing a phased array transmit function and a phased array receive function. The receive function produces an intermediate frequency by additively superimposing outputs $234_i$ of the TR modules and modulating non-deflecting acousto-optic modulator 140 with a first frequency (for example 10.4 GHz) when a transmit signal is on and a second frequency (for example 10 GHz) when a transmit signal is not on.

FIFTH EMBODIMENT

Figure 14:
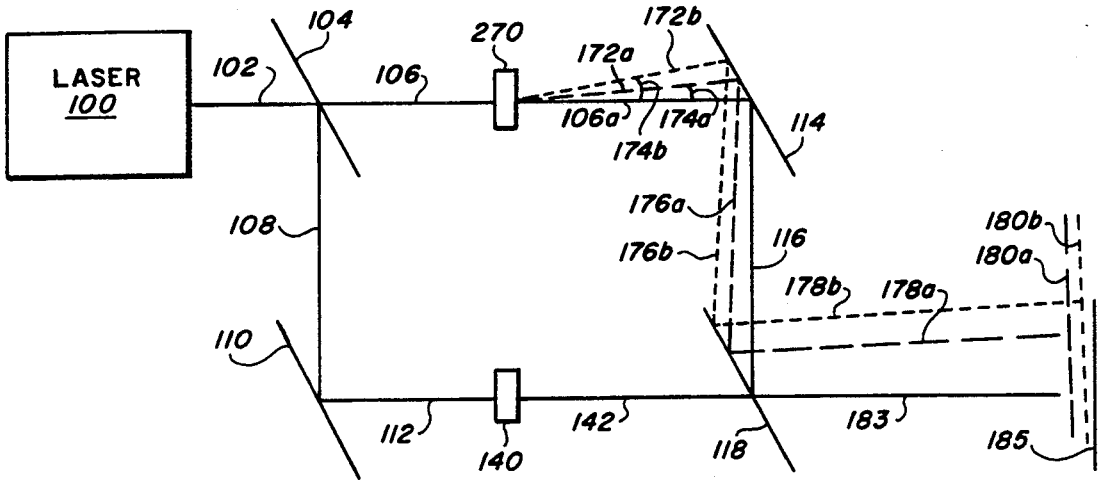
FIG. 14 is a schematic Mach-Zehnder interferometer employing conventional acousto-optic beam deflector.

FIG. 14 is a schematic of a Mach-Zehnder interferometer substantially similar to the interferometer described in connection with FIG. 9; however, the non-modulating acousto-optic beam deflector 170 of FIG. 9 is replaced by a conventional acousto-optic beam deflector 270. Conventional acousto-optic beam deflector 270 both deflects and modulates first planar beam 106 according to a frequency of the acoustic source applied to conventional acousto-optic beam deflector 270. When a first frequency acoustic source is applied to beam deflector 270, first planar beam 106 is deflected through first deflection angle 174*a* to produce first deflected first planar beam 172*a* which is modulated by conventional acousto-optic beam deflector 270 to have a first modulated frequency. First deflected first planar beam 172*a* is reflected from reflector 114 as first reflected deflected first planar beam 176*a*. First reflected deflected first planar beam 176*a* is partially reflected from combiner 118 as first deflected first planar beam component 178*a* having first wavefront 180*a*. When a second acoustic source frequency is applied to beam deflector 270, first planar beam 106 is deflected through second deflection angle 174*b* to produce second deflected first planar beam 172*b* having a second modulated frequency. Second deflected first planar beam 172*b* is reflected from reflector 114 as second reflected deflected first planar beam 176*b*. Second reflected deflected first planar beam 176*b* is partially reflected from combiner 118 as second deflected first planar beam component 178*b* having second wavefront 180*b*.

When an acoustic source is formed having a superposition of the first acoustic source frequency and the second acoustic source frequency, first planar beam 106 splits in conventional acousto-optic beam deflector 270 to form two beams simultaneously: first deflected first planar beam 172*a* and second deflected first planar beam 172*b*. Therefore, three planar beams travel substantially along the axis of modulated beam 183 with respective beams having first wavefront 180*a*, second wavefront 180*b* and modulated wavefront 185. It will be appreciated that first deflected first planar beam component 178*a* and second deflected first planar beam component 178*b* are each modulated according to an acoustic source frequency that produces first deflection angle 174*a* and second deflection angle 174*b*, respectively, because beam deflector 270 is a conventional acousto-optic beam deflector.

It is well known that the beam width of a phased array microwave antenna, such as the antenna described in connection with FIG. 11, is defined by parameters comprising wavelength, array dimension, microwave beam launch angle (affecting the projected dimension of the array) and amplitude weighing of individual radiating elements across the array. In this embodiment, first beam component 178*a* and second beam component 178*b* each individually combine with modulated beam 183 to produce a phase gradient necessary to launch a microwave beam in first and second directions, respectively.

First beam component 178*a* combines with modulated beam 183 to form a first phase gradient in a manner substantially the same as the phase gradient produced by the embodiment described in connection with FIG. 9. Similarly, second beam component 178*b* combines with modulated beam 183 to produce a second phase gradient in a manner substantially the same as the phase gradient produced by the embodiment described in connection with FIG. 9. However, deflection angles 174*a* and 174*b* are generally different.

Combined beams 178*a* and 183 define a first microwave frequency different than a second microwave frequency defined by the combined beams 178*b* and 183, because beam components 178*a* and 178*b* have been modulated with a different frequency by conventional acousto-optic beam deflector 270 according to respective first and second acoustic source frequencies.

Therefore, when the interferometer described in connection with FIG. 14 is employed to feed the phased array antenna described in connection with FIG. 11, two microwave antenna beams having first and second microwave frequencies are directed at first and second launch angles according to first and second phase gradients, respectively.

Figure 15:
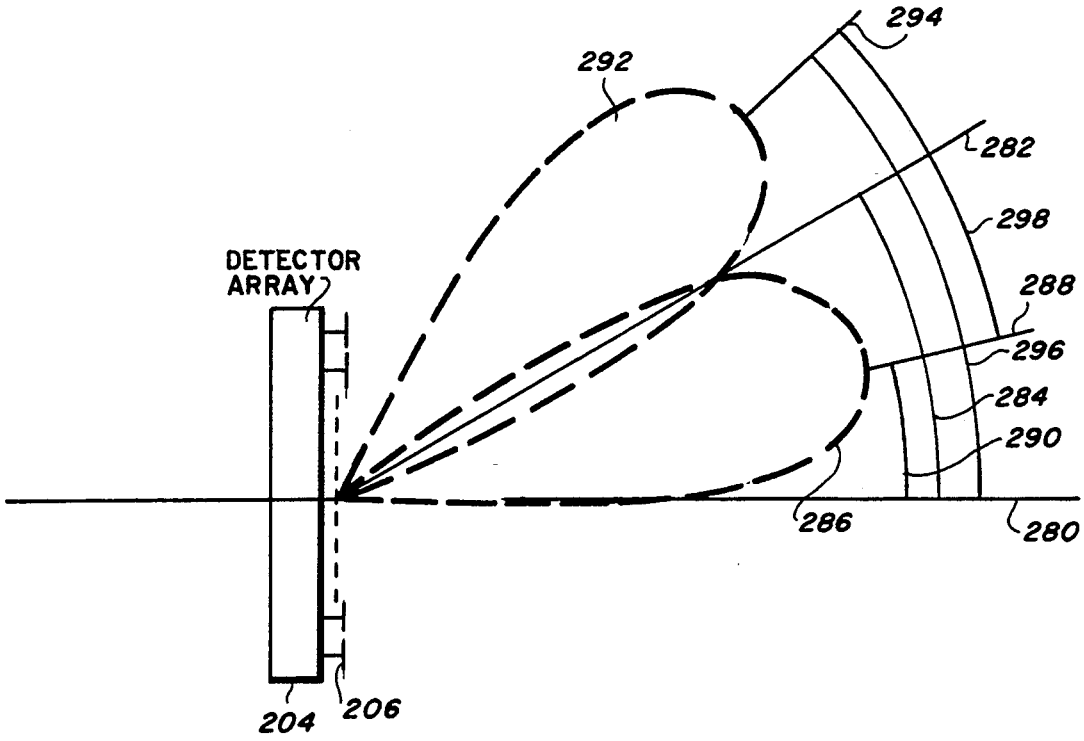
FIG. 15 is an antenna pattern diagram for a dual beam monopulse antenna.

In FIG. 15 elements 204 and 206 of the phased array antenna of FIG. 11 are illustrated. Axis 280 is perpendicular to array 206 of antenna radiating elements. The interferometer described in connection with FIG. 14 produces first microwave beam 286 in direction 288 having angle 290 with respect to axis 280 and second microwave beam 292 having direction 294 having angle 296 relative to axis 280. Desired direction 282 defined by angle 284 relative to axis 280 is illustrated.

First deflection angle 174*a* and second deflection angle 174*b* of the interferometer described in connection with FIG. 14 produce respective first and second phase gradients and first and second microwave beams directed in first direction 288 and second direction 294, respectively, so that an average of direction 288 and direction 294 is desired direction 282. Further, first and second acoustic source frequencies for driving conventional acousto-optic beam deflector 270 are chosen so that a difference between the first and second acoustic source frequencies produces the angular difference 298 between directions 288 and 294 to be approximately equal to one beam width of the antenna comprising array 206. It will be appreciated that first microwave beam 286 has first microwave frequency and second microwave beam 292 has second microwave frequency such that there is a difference between the first and second microwave frequencies. For example, when the first microwave frequency is 10 GHz, the second microwave frequency might be 10.08 GHz.

The dual transmit beam illustrated in FIG. 15 may be transmitted from the antenna when transmit signal 240 is on as indicated at 242 of FIG. 13. It will be appreciated that when transmit signal 240 is off, the interferometer described in connection with FIG. 14 may be operated with a single frequency acoustic source driving conventional acousto-optic beam deflector 270 to produce a receive beam directed in desired direction to 282 and with non-deflecting acousto-optic modulator 140 disposed in second beam 112 and being driven with an acoustic source having a frequency such that the modulated beam from conventional beam deflector 270 superimposed on modulated beam component 183 produces a microwave local oscillator frequency which heterodynes with an average of the first and second microwave transmit frequencies to produce an average of two desired intermediate frequencies in microwave mixers $232_i$. For example, when the interferometer described in connection with FIG. 14 is used to produce a receive beam in desired direction 282, modulator 140 is driven by an acoustic source frequency that may be selected to produce a reference frequency at the second input to mixers $232_i$ of, for example, 10.4 GHz. When the receive mode microwave reference frequency of 10.4 GHz at the second input to mixers $232_i$ when in receive mode is mixed with reflected signals from first transmit beam 286 having microwave frequency of, for example, 10 GHz, mixer output $234_i$ will produce an intermediate frequency of 400 MHz. When the receive mode microwave reference frequency of 10.4 GHz at the second input to mixers $232_i$ is mixed with reflected second microwave beam 292 having second frequency of, for example, 10.08 GHz, mixer output $234_i$ will produce an intermediate frequency of, for example, 320 MHz. It will therefore be appreciated that a first intermediate frequency, for example, 400 MHz, corresponds to reflected signals from first microwave beam 286, and that a second intermediate frequency, for example, 320 MHz, corresponds to reflected signals from second microwave beam 292.

The gain characteristic of first microwave beam 286 is a maximum in direction 288 and decreases at angles that are greater or lesser than angle 290 with respect to axis 280. Further, a gain characteristic of second microwave beam 292 has a maximum in direction 294 which decreases at angles that are greater or lesser than angle 296 with respect to axis 280. It will be appreciated that signals reflected from a reflector oriented in direction 288 will produce a maximum amplitude in the first intermediate frequency signal which corresponds to first microwave beam 286 and a small amplitude in the second intermediate frequency signal which corresponds to second microwave beam 292. Alternatively, a reflector oriented in direction 294 will produce a maximum amplitude in the second intermediate frequency signal, corresponding to second microwave beam 292 and a small amplitude in the first intermediate frequency signal corresponding to first microwave beam 286. It will be appreciated that a target oriented in the desired direction 282 will produce an intermediate amplitude signal in both first and second intermediate frequency signals corresponding to both first and second microwave beams 286 and 292.

It is well known that the ratio of the difference in the amplitudes of the thus described first and second intermediate frequency signals divided by the sum of the amplitudes of first and second intermediate frequency signals defines a monopulse angle discrimination function. This discrimination function identifies an angle between directions 288 and 294 where the reflector is oriented, the reflector being that reflector which produces the reflected signals corresponding to the first and second intermediate frequency signals.

Thus, it will be appreciated that the interferometer described in connection with FIG. 14 feeds a phased array antenna to produce dual transmit beams when a transmit signal is on and feeds the phased array antenna to produce a single receive beam when the transmit signal is off so as to produce first and second intermediate frequency signals from which the monopulse angle discrimination function is formed.

It will also be appreciated that the interferometer described in connection with FIG. 14 may produce a single transmit beam oriented in a desired direction 282 when a transmit signal is on and produce dual receive beams 286 and 292 when a transmit signal is off so as to produce first and second intermediate frequency signals with amplitudes corresponding to amplitudes received by first and second receive beams 286 and 292, respectively. It will be appreciated that first and second intermediate frequency signals are combinable as described herein to form the monopulse angle discrimination function described herein.

SIXTH EMBODIMENT

Figure 16:
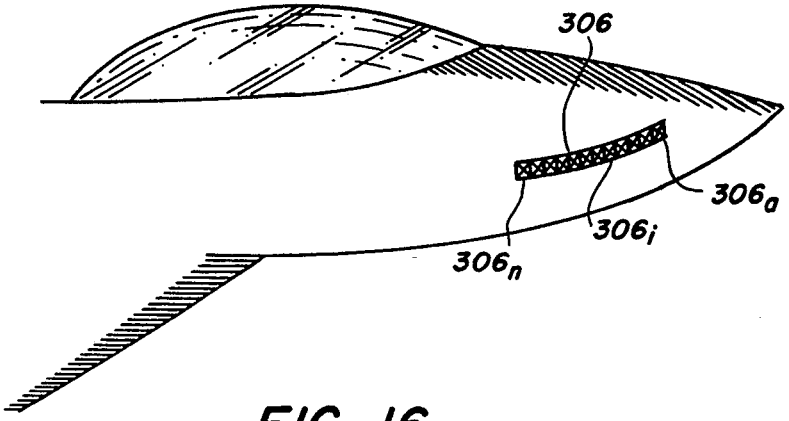
FIG. 16 illustrates a conformal mount of a phased array antenna.
Figure 17:
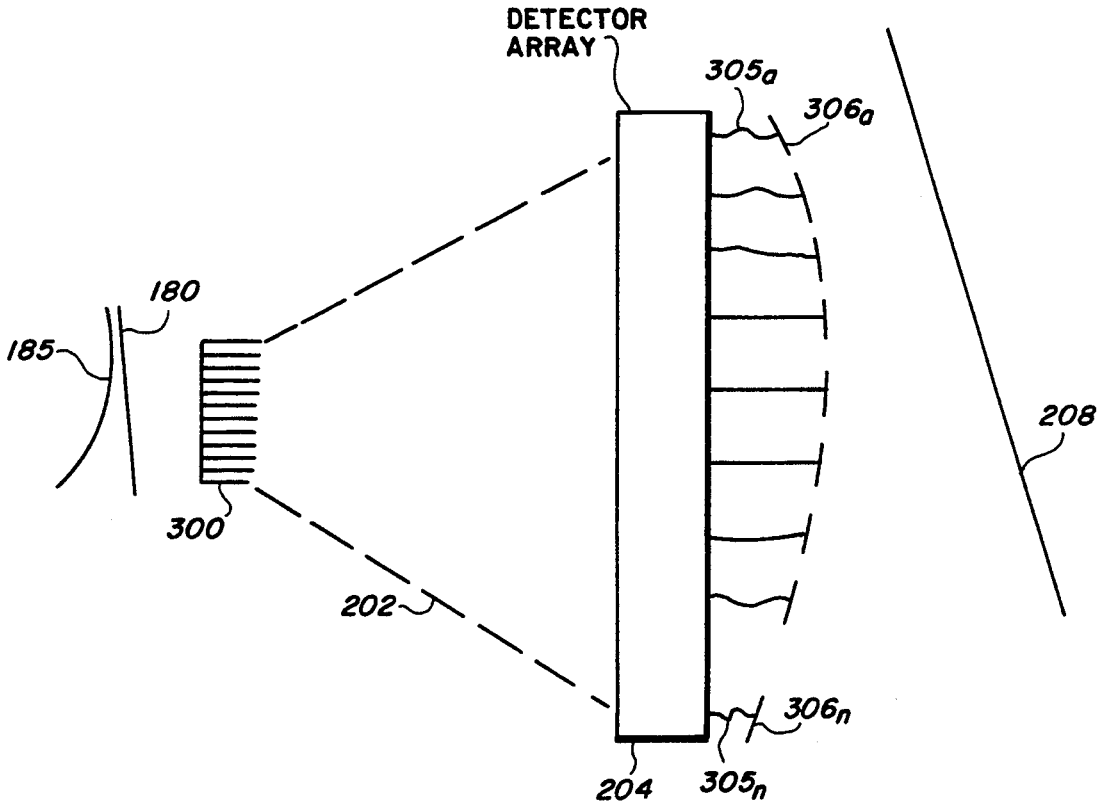
FIG. 17 illustrates a phased array antenna for conformal mounting.

FIG. 16 exemplifies a typical challenge to practical implementation of a phased array antenna. In FIG. 16 an aircraft having a surface of arbitrary but predetermined curvature is illustrated. One dimensional array 306 of antenna radiating elements **306*a* through 306*n* is mounted conformally to the curvature of the aircraft. The phase of microwaves radiated from or received by array 306 must be shifted by an amount according to the curvature of array 306 and the position of a given radiating element 306*i* within array 306 in order to produce a microwave beam in a desired direction. FIG. 17 is a schematic of a phased array microwave antenna conformally mounted to a surface having a curvature, the antenna employing a fiber optic feed. Deflected beam 180 and modulated beam 185 of FIG. 17 are the same as corresponding beams of FIG. 10, except that modulated beam 185 is curvelinear to compensate for the conformal curvature. This curvelinear reference beam can be made by properly positioning lenses (spherical, aspherical, or cylindrical) within the reference leg. Conformal array 300 of FIG. 17 comprised of pick-up elements 150 is identical with linear array 200 of FIG. 11 comprised of pick-up elements 150. The plurality of optic pick-up elements 150 in conformal array 300 are connected by optic bundle 202 comprising a plurality of optical fibers 152 for carrying a plurality of optical signals to illuminate respective photodiodes 156 in the plurality of photodiodes which comprise detector array 204. Optic bundle 202 and detector array 204 of FIG. 17 are the same as optic bundle 202 and detector array 204 of FIG. 11. Detector array 204 comprises a plurality of detector circuits each having a power source 162, bias resistor 164, output 166 in addition to corresponding photodiode 156. Each output 166 of detector array 204 is connected to a corresponding radiating element from 306*a* to 306*n* within radiating element array 306**.

As illustrated in FIG. 17 the one dimensional array of radiating elements 306 is disposed conformal to a arbitrary but predetermined curvature. Each optical fiber 152 in optic bundle 202 is of identical length. Accordingly, the phases of the demodulated microwave signals at a plurality of outputs 166 within detector array 204 bear these same phased gradient relationship as do the phases of the amplitude modulation of the optical signals picked-up by the plurality of optic pickup elements 150 within conformal array 300. Similarly, the phases of the microwave signals across radiating elements of array 306 bear the same phase gradient relationship as does the phases of the plurality of outputs 166 of detector array 204, because radiating element feeds **305*a* through 305*n* provide equal electrical lengths between each radiating element 306*a* through 306*n* to corresponding detector outputs 166**.

In operation, wavefronts 180 and 185 are superimposed at the plurality of optic pick-up elements 150 within conformal array 300 to produce a plurality of modulated optical signals. The phase of the modulation of the modulated optical signals depends on all of the factors that determine the phase gradients that were described in connection with the embodiment described with reference to FIG. 11, plus in FIG. 17, the phase is also determined by the curvature of modulated wavefront 185. Accordingly, the phase of microwaves radiated from array 306 will bear the same phase gradient as picked-up by optic pick-up elements 150 within conformal array 300. Thus, wavefront 180 defines a launch direction 208 in the embodiment described with respect to FIG. 17 in the exact same way as wavefronts 180 and 185 defined a launched direction 208 in the embodiment described with reference to FIG. 11.

SEVENTH EMBODIMENT

Figure 18:
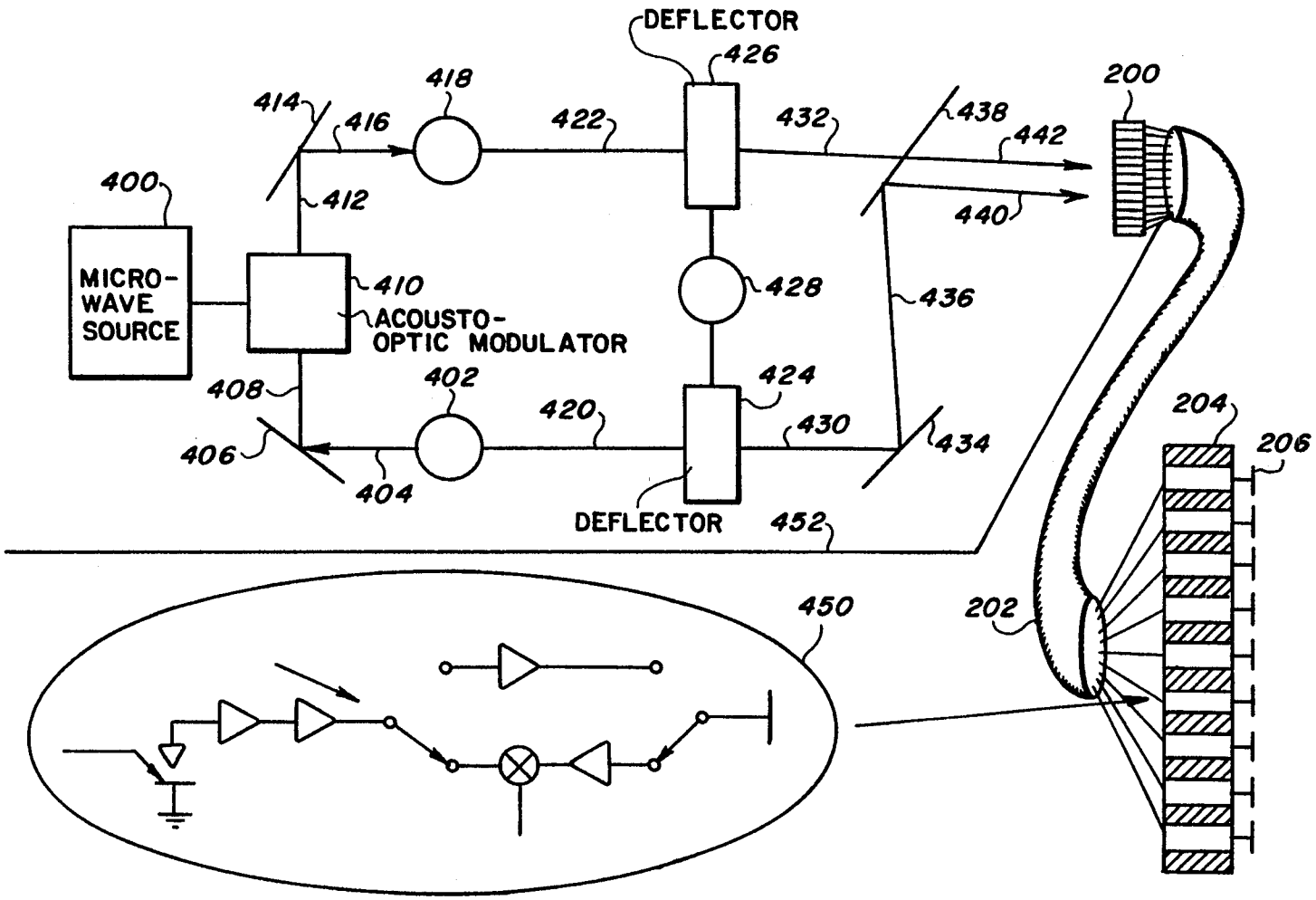
FIG. 18 is a schematic of an optically fed phased array antenna employing conventional acousto-optic beam deflectors in a single plane.

FIG. 18 illustrates a seventh embodiment of the present invention. In FIG. 18 elements 200–206 correspond to elements 200–206 in the embodiment described with reference to FIG. 11. In FIG. 18, element 450 is the TR module described with respect to the embodiment described with reference to FIG. 12.

In FIG. 18, master laser 402 lases to produce master laser back beam 404 and master laser forward beam 420. Master laser back beam 404 is reflected by mirror 406 as reflected beam 408. Reflected beam 408 passes through non-deflecting acousto-optic modulator 410 as modulated beam 412. Non-deflecting acousto-optic modulator 410 modulates reflected beam 408 according to a microwave frequency from microwave source 400. Modulated beam 412 is reflected by mirror 414 as slave laser input beam 416. Slave laser input beam 416 is amplified in slave laser 418 to produce slave laser forward beam 422. It will be appreciated that any insertion loss that may be suffered as reflected beam 408 passes through non-deflecting acousto-optic modulator 410 is compensated for by gain in slave laser 418. Thus, master laser forward beam 420 and slave laser forward beam 422 are substantially matched in the amount of power in the beams. However, slave laser forward beam 422 has been modulated according to the frequency of microwave source 400.

In this embodiment, master and slave conventional acousto-optic beam deflectors 424 and 426 are disposed in corresponding master and slave beams 420 and 422 and oriented to deflect beams 420 and 422 in a single plane. The two beam deflection angles are both determined according to a frequency of single acoustic source 428. Both beam deflectors 424 and 426 are oriented so that modulation resulting from acoustic source 428 either increases or decreases the frequency of both beams 420 and 422 as they pass through beam deflectors 424 and 426. Thus, the frequency shift induced in deflected master beam 430 and deflected slave beam 432 resulting from conventional acousto-optic beam deflectors 424 and 426 according to a frequency of single acoustic source 428 will be identical, so as to neutralize any effect that the beam deflectors might have on the amplitude modulation on carrier optic signals within optic bundle 202.

It will also be appreciated that the orientation of conventional acousto-optic beam deflectors 424 and 426 are configured so that deflected master beam 430 will be deflected downward (referring to FIG. 18) by an equal amount to the amount that deflected slave beam 432 is deflected upward. Deflected master beam 430 reflects off of mirror 434 as reflected master beam 436. Reflected master beam 436 and deflected slave beam 432 are combined on combiner 438 to produce master beam component 430 and slave beam component 432. It will also be appreciated that deflected master beam 430 may be deflected upward while deflected slave beam 432 is deflected downward.

Master beam component 440 and slave beam component 442 have wavefronts that are askew with respect to each other by an amount determined according to the amount of deflection induced in deflected master beam 430 and deflected slave beam 432. Thus, the wavefronts of master beam components 440 and slave beam component 442 are equivalent to wavefronts 180 and 185 described with respect to the embodiment described with reference to FIG. 11.

Finally, optical transmit signal 452 feeds an optical fiber within optic bundle 202 so that the microwave antenna elements comprising detector array 204 which includes a plurality of TR modules 450 and microwave radiating element array 206 is connected to the interferometer of FIG. 18 solely by optic bundle 202. On receive, the same process is performed at the local oscillator frequency. The outputs of the mixers are summed in a corporate combiner and routed to the receiver.

The embodiment described in connection with FIG. 18 has the advantage of minimizing optical insertion losses in the forward legs of the circuit because the beam deflectors used are conventional Bragg cells. For example, available acousto-optic beam deflectors 424 and 426 may be obtained in excess of 80% efficiency, and adequate beam deflection can be achieved with frequencies from acoustic source 428 in a range around 80 MHz.

EIGHTH EMBODIMENT

An eighth embodiment of the present invention is described with reference to FIG. 19. Elements 200–206 of FIG. 19 correspond to elements 200–206 of the embodiment described with reference to FIG. 11. Elements 400–422, 434, 438, 450 and 452 of FIG. 19 correspond to like numbered elements of the embodiment described with reference to FIG. 18.

Figure 19:
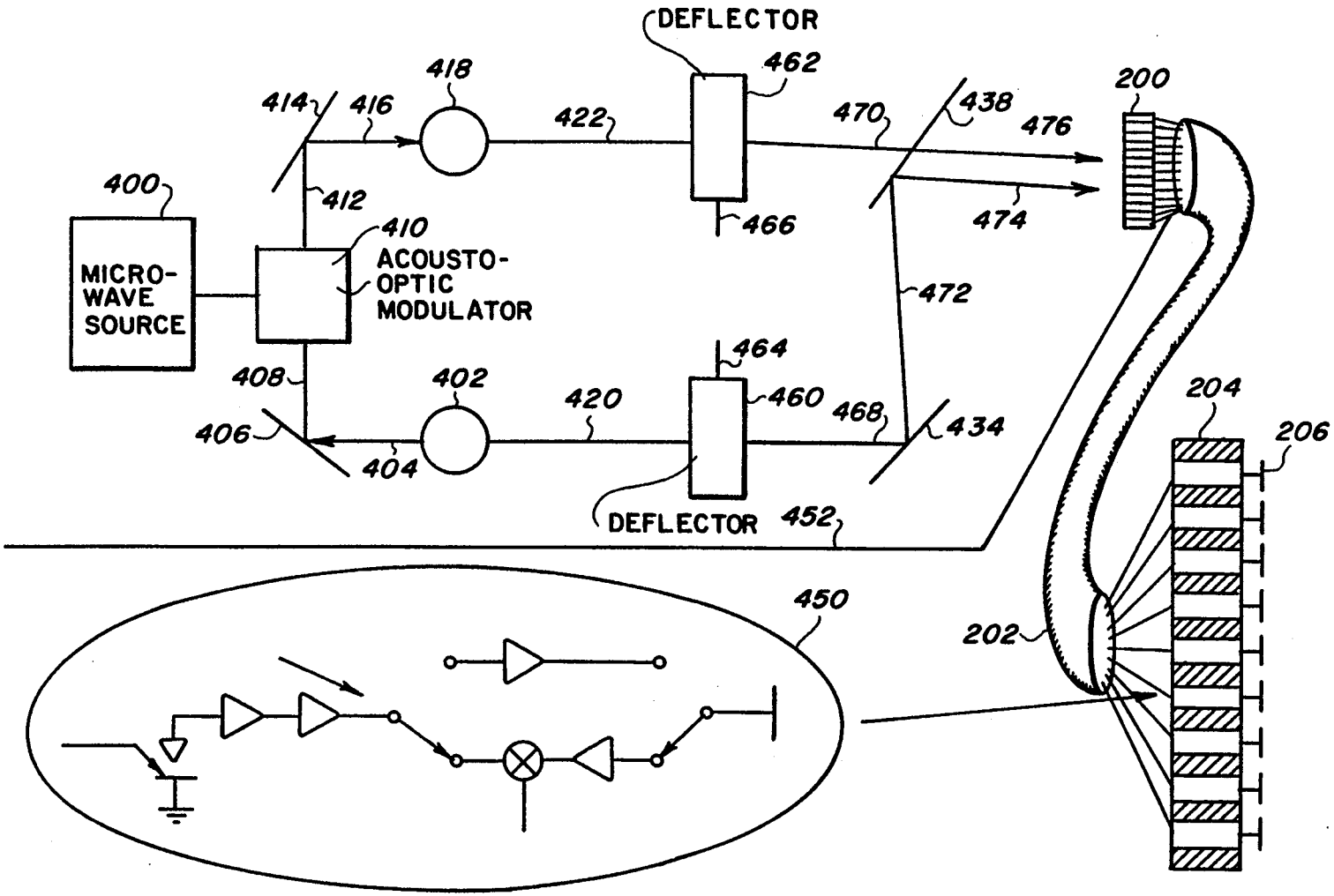
FIG. 19 is a schematic of an optically fed phased array antenna with conventional acousto-optic beam deflectors employed in two orthogonal planes.

In FIG. 19 master and slave beams 420 and 422 are deflected by master and slave conventional acousto-optic beam deflectors 460 and 462 to produce deflected master beam 468 and deflected slave beam 470 according to frequencies of master and slave beam deflector acoustic sources 464 and 466, respectively. Deflected master beam 468 is reflected by mirror 434 as reflected master beam 472. Reflected master beam 472 is combined on combiner 438 with deflected slave beam 470 as master beam component 474 and slave beam component 476, respectively.

Figure 20:
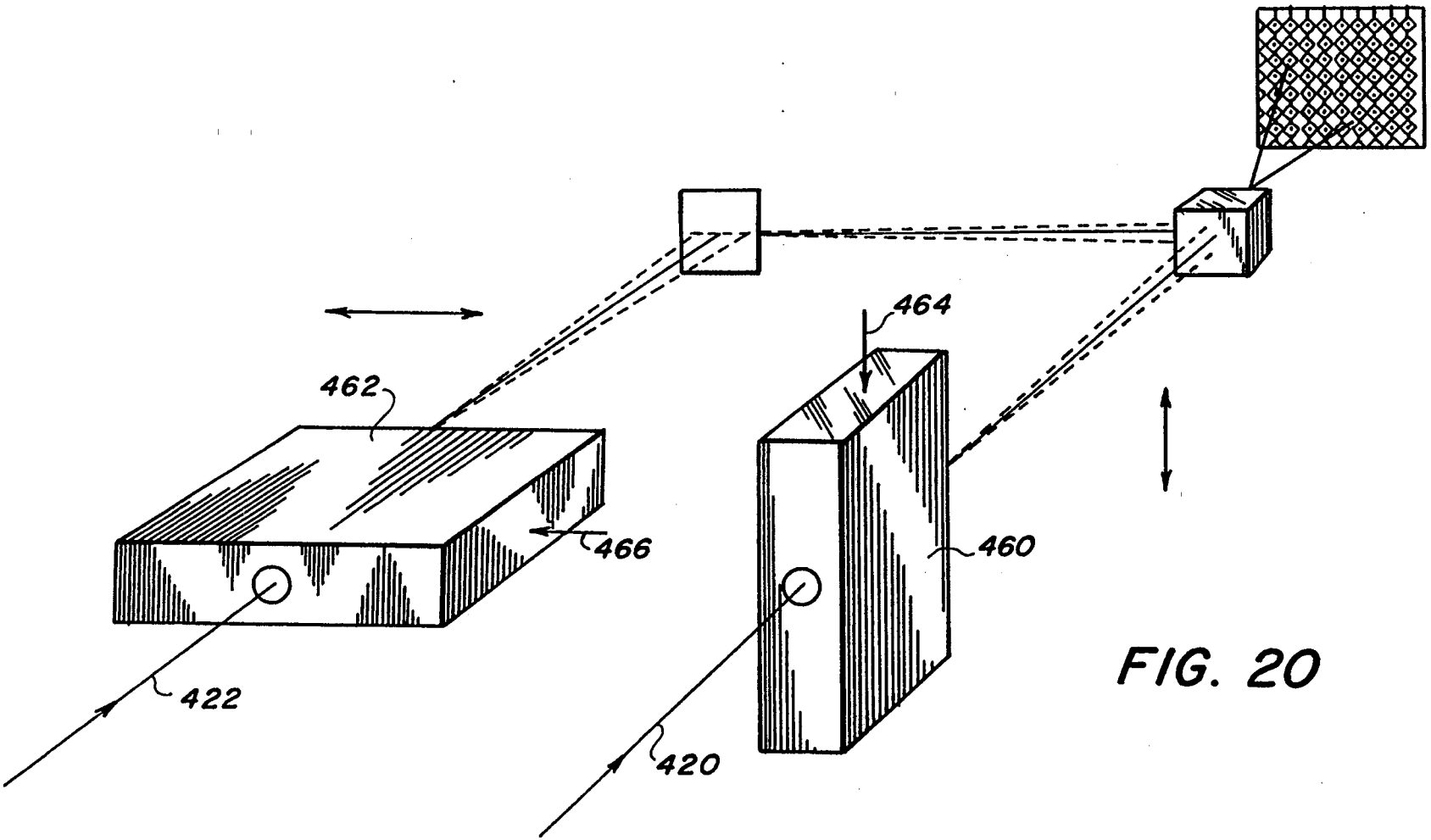
FIG. 20 is a perspective view of the disposition of acousto-optic beam deflectors of the schematic of FIG. 19.

The invention of this embodiment will be appreciated with reference to FIG. 20. FIG. 20 is a perspective view illustrating the orientation of master conventional acousto-optic beam deflector 460 and slave conventional acousto-optic beam deflector 462. The orientation of beam deflectors 460 and 462 are substantially orthogonal to each other, producing a two dimensional fiber optic feed mechanism.

When master acoustic source 464 is quiescent (producing no beam deflection in beam deflector 460), slave acoustic source 466 drives beam deflector 462 to deflect slave beam 422 in a first (horizontal) plane. Under this condition, the microwave beam produced in the phased array antenna will be deflected in the first (horizontal) plane.

When slave acoustic source 466 is quiescent (producing no beam deflection in slave beam deflector 462), master acoustic source 464 drives master beam deflector 460 to deflect master beam 420 in a second (vertical) plane, substantially orthogonal to the first (horizontal) plane. Under this condition, a microwave beam produced by a phased array antenna will be deflected in the second (vertical) plane.

When both master acoustic source 464 and slave acoustic source 466 drive corresponding beam deflectors 460 and 462, a microwave beam produced by the phased array antenna will be deflected in both a first (horizontal) and a second (vertical) plane in accordance with frequencies of the master and slave acoustic sources 464 and 466.

Conventional beam deflectors 460 and 466 induce a laser light frequency shift corresponding to the amount of deflection of master and slave beam components 474 and 476. In the general case, the vertical and horizontal deflection of master and slave beam components 474 and 476 will not be equal. Accordingly, unless corrected there will be some vernier frequency shift induced in the microwave beam corresponding to the desired microwave beam position. Thus, in order to achieve a desired microwave frequency in the microwave beam, the vernier frequency shift that would result from the deflection of master and slave beam components 474 and 476 is determined in advance to advise a correcting frequency to compensate the frequency of the acoustic source that drives acousto-optic modulator 410 so as to produce the desired microwave frequency when the microwave beam is pointed to the desired microwave beam position.

It will be appreciated that master and slave beam deflectors 460 and 462 may be of a non-modulating acousto-optic beam deflector technology instead of the conventional acousto-optic beam deflector technology, obviating a need to frequency compensate modulator 410 based on deflection angles.

In typical operation, the non-deflecting acousto-optic modulator 410 may have an octave bandwidth with reasonable efficiency, for example, modulation is produced at frequencies from 1 through 2 GHz with 35 to 40% efficiency and certainly providing sufficient energy to drive the slave laser over an octave bandwidth.

Faraday cells are frequently used with laser diodes to isolate the laser oscillator (master laser) from external mismatches which can modify the mode of oscillation. The Faraday cells use the same phenomenology as ferrite isolators in microwave circuits. Laser injection locking can occur at about 1% of the laser output power. Consequently, if the return loss of the output of a laser is less than 20 dB, reflections can dramatically influence the lasing. The reflection set up an external cavity so that the lasing spectrum must simultaneously be a mode or eigenvalue of the two cavities, the 100 micron laser cavity and the cavity defined by the external reflection point which may be of the order of millimeters. Consequently, the lasing is likely to be quite erratic if there are any longitudinal vibrations of a magnitude similar to an optical wavelength. Insertion of a Faraday cell isolates the lasing output from "properly aligned optics" which tend to retro-reflect energy. Accordingly, a Faraday isolator is preferably disposed in the optic path somewhere between the master laser and the non-deflecting acousto-optic modulator 410. The Faraday isolator is not shown in FIGS. 18 and 19 for simplicity so that the concepts of the embodiments described with reference to FIGS. 18 and 19 might be more clearly understood.

The embodiment described with reference to FIG. 19 can perform frequency agile beam forming over at least an octave bandwidth. With conventional acousto-optic beam deflectors 460 and 462 efficiencies in excess of 80% are available from low frequency cells, for example, $TeO_2$ cells.

A typical laser of this embodiment may be a laser diode with output signal power of approximately 10 mW. The back leg of the optical circuit can tolerate attenuation through non-deflecting acousto-optic modulator 410 of as much as 20 dB. This is easily achieved with a matched pair of Bragg cells each with even 12 to 14% efficiencies at microwave frequencies. Since each forward leg produces 10 mW of signal power and the conventional acousto-optic beam deflectors impose an insertion loss of 1 dB and the beam splitter/combiner imposes an additional loss of 3 dB, it will be appreciated that a fiber array is driven with 6 dB mW of laser signal power from each leg. If the fiber array were to comprise, for example, a 10 by 10 array of optic pick-up elements 150, each element could acquire no more than 1% of the optical signal power. However, only about 10% of the total light intercepts the fiber cores anyway; therefore, with an assumed additional 3 dB of system losses, the light power in each optical fiber 152 is about −27 dB mW from each leg at corresponding detector 156. If detector 156 were to be of an avalanche photodiode technology, the detector would produce a gain G of approximately 30. With resistor 164 (r) at 50 ohms and a responsivity R of the avalanche photodiode of 0.5 amperes per watt, a microwave signal of −46 dB mW is produced or the deflector conversion loss ($p/P_1$) is 19 dB.

The equation governing the power produced is:

$$p=P_1P_2R^2G^2r/2,$$

where $P_1$ is the laser power in master beam component 474 and $P_2$ is the laser power in slave beam component 476, and $G=30$ is the avalanche gain.

Larger arrays, for example, 100×100 elements, may be driven by available higher power laser technologies. For example, neodymium YAG lasers presently exist for producing 100 mW of power yielding a −46 dB mW microwave signal power. This power is approximately 65 dB above noise power in a 1 MHz band with a 3 dB noise figure.

Figure 21:
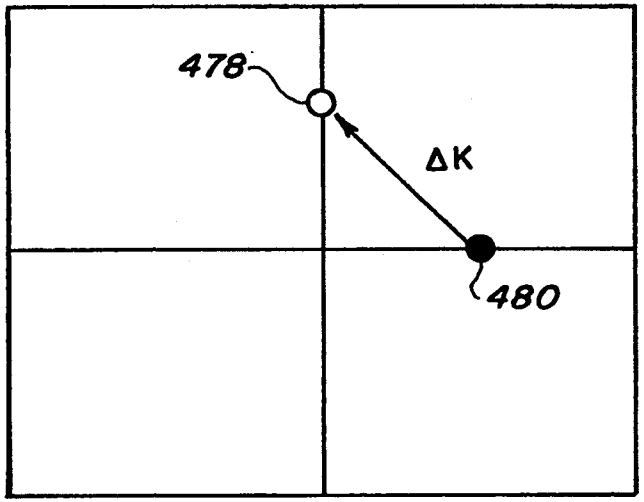
FIG. 21 is a K-space diagram of the wave propagation numbers of beams resulting from the circuit of FIG. 19.

FIG. 21 is a K-space graph of the Fourier plane representation of beams produced by the circuit of FIG. 20. FIG. 21 can be visualized by interposing a Fourier transformed lens between combiner 438 and the Fourier plane shown in FIG. 21. The Fourier lens is disposed exactly one focal length in front of the Fourier plane. From basic optics, plane waves (coherent collimated beams) are then brought to a focus in the focal plane. Two spots of light will be generated, one corresponding to each of the incident plane waves, master beam component 474 and slave beam component 476. Master beam component 474 and slave beam component 476 are brought to a focus at master focal point 478 and slave focal point 480. It will be appreciated from FIG. 20 that master beam component 474 is deflected in a vertical plane resulting in a vertical deflection of master focal point 478, and slave beam component 476 is deflected in a horizontal plane resulting in a horizontal displacement of slave focal point 480. The displacement of master and slave focal points 478 and 480 correspond to respective wave propagation numbers $K_1$and $K_2$, and the vector difference between master and slave focal points 478 and 480 correspond to the difference in wave propagation numbers $\Delta K$. The difference in wave propagation numbers $\Delta K$ defines the phase gradient at the microwave aperture which controls the microwave beam direction as shown in the beam space diagram of FIG. 22.

Figure 22:
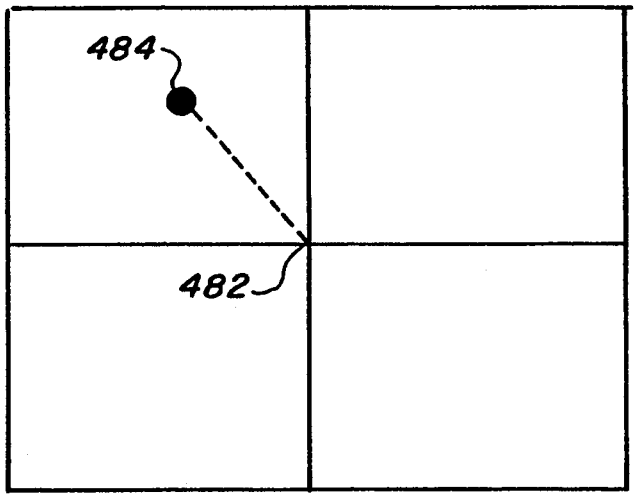
FIG. 22 is a microwave beam space diagram of the microwave beam launch angle.

The natural coordinates for FIG. 21 are the drive frequencies into the crossed acousto-optic cells. The difference vector $\Delta K$ corresponds to the wave number k projected into the plane of the antenna array. Therefore the natural coordinates of FIG. 22 are polar coordinates. The radius from the center is proportional to the elevation angle and the angle from some reference direction, e.g. positive x axis, is proportional to the azimuth angle. It will be appreciated that the radius is mathematically proportional to $\omega\sin\Theta$, $\omega$ being the radian frequency of the RF, and $\Theta$ being the elevation angle from the normal to the array. In the receive mode the virtual antenna pattern which must be excited corresponds to the point 484 of FIG. 22 but rotated 180° in azimuth, i.e. on the opposite side of point 482.

NINTH EMBODIMENT

The ninth embodiment is described with reference to FIG. 23.

Figure 23:
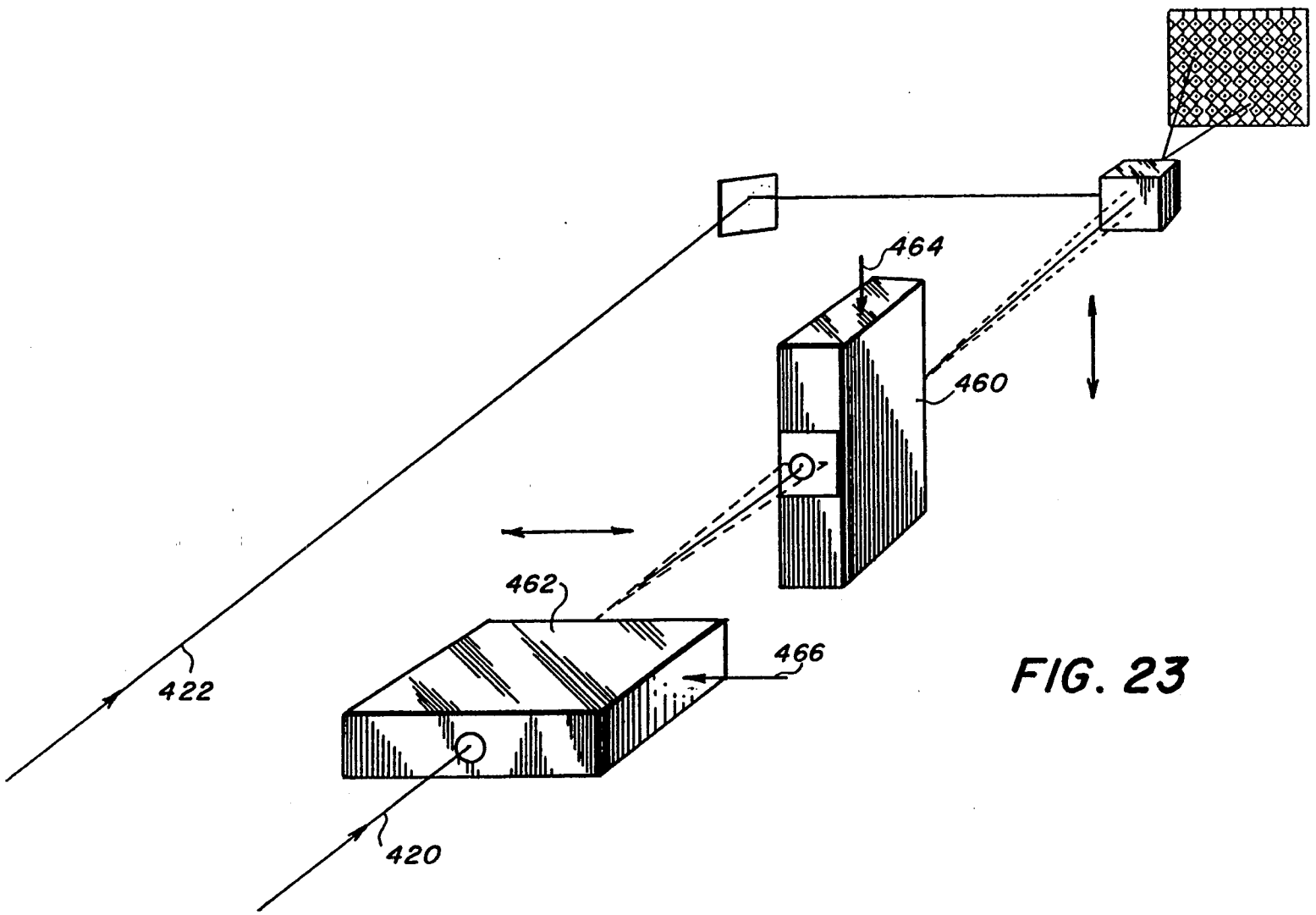
FIG. 23 is a perspective view of an alternative embodiment to the embodiment illustrated in the perspective view of FIG. 20.

It will be appreciated that the configuration illustrated in FIG. 23 is a functional equivalent of the configuration illustrated in FIG. 20 for the function of producing a desired phase gradient. Master beam 420 is first deflected in a horizontal direction by beam deflector 462 and then deflected in a vertical direction by beam deflector 460. Slave beam 422 remains undeflected. When viewed from the point of view of a K-space diagram similar to that of FIG. 21, it will be appreciated that slave beam 422 will focus at the center of the coordinates set while master beam 420, having been deflected in both horizontal and vertical directions will focus at a point displaced from the center of coordinates set by an amount $\Delta K$ corresponding to desired microwave beam deflection 484.

Figure 23A:
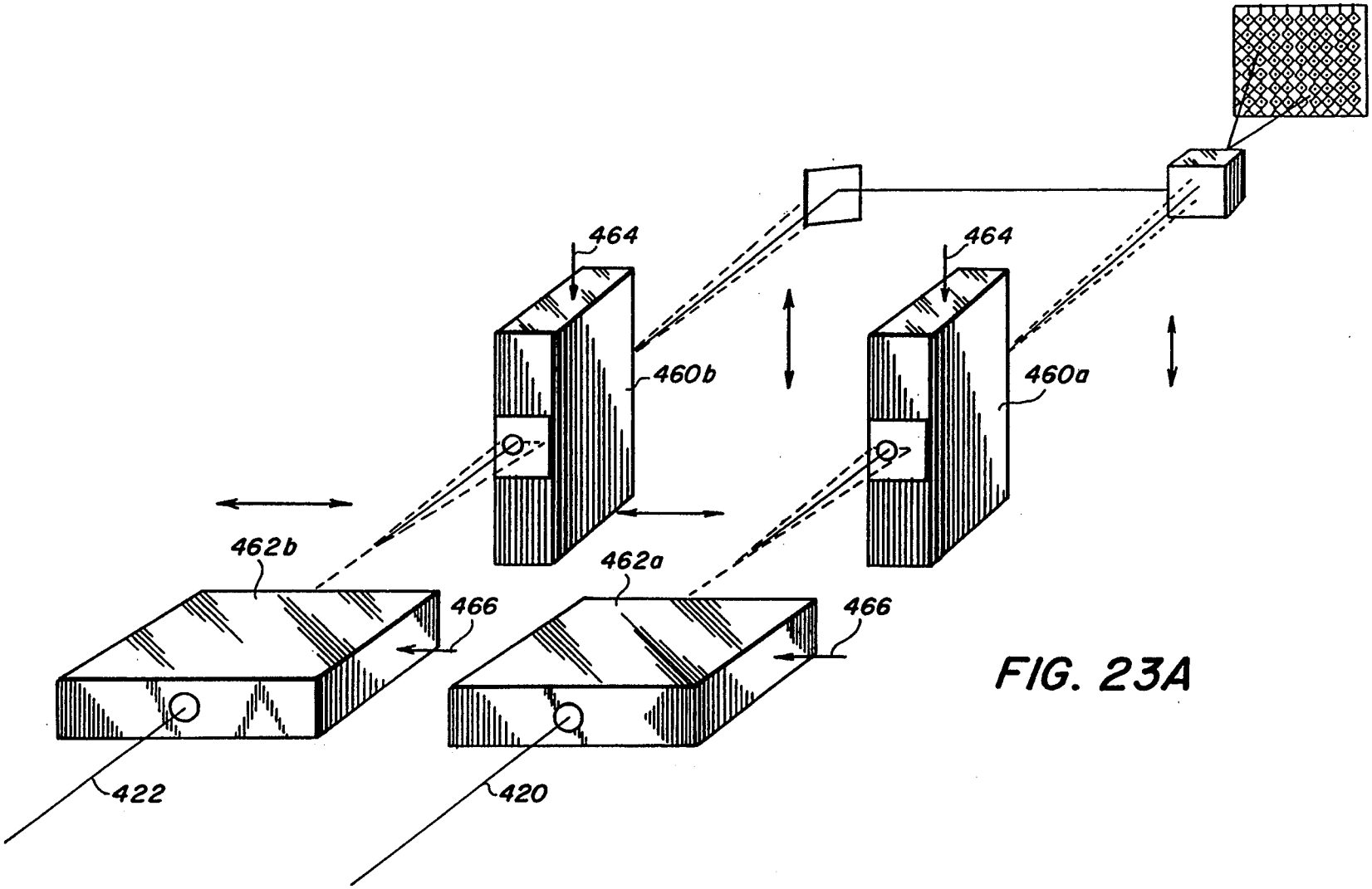
FIG. 23A is a perspective view of an alternative to the embodiment illustrated in FIG. 20.

FIG. 23A is similar to FIG. 23 except that there are two orthogonal beam deflectors in both the master and slave beams. Beam deflectors **162*a* and 162*b* cooperate in the same way that beam deflectors 424 and 426 in FIG. 18 cooperate to define a phase gradient while both deflectors increase and decrease a frequency of both master slave beams by a same amount. Note that both 462a and 462b are driven by acoustic source signal 466. Further, beam deflectors 460a and 460b cooperate in the same way that 462a and 462b cooperate; however, beam deflectors 462a and 462b define a phase gradient to produce a beam deflection in a first plane while beam deflector 460a and 460b** produce a beam deflection in a second plane orthogonal to the first plane.

TENTH EMBODIMENT

It will be appreciated that vertical and horizontal beam deflectors 460 and 462 of either FIG. 20 or 23 may be driven by acoustic sources having a plurality of frequency components. For example, if vertical beam deflector 460 is driven by acoustic source 464 having two frequency components, vertical deflected beam component (master beam component 474) will be split into two beam components, each corresponding to a respective frequency of the acoustic source 464. The monopulse antenna and the monopulse angle discrimination function described with respect to the embodiment described with reference to FIGS. 14 and 15 may be employed in this embodiment. The monopulse angle discrimination function may be achieved in both the horizontal and vertical directions either separately or combined. When the monopulse angle discrimination function is achieved in both the horizontal and vertical directions combined, four beams are formed.

Figure 24:
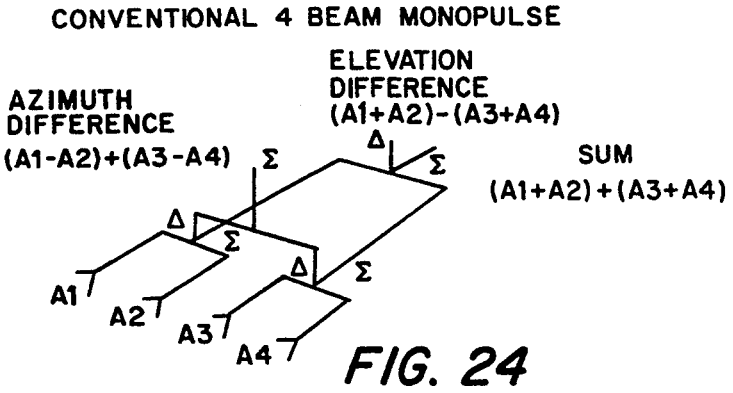
FIG. 24 is a functional schematic of conventional four beam monopulse.

FIG. 24 illustrates conventional four beam monopulse function. Apertures A1–A4 represent four beams of the four beam monopulse. Apertures A1 and A2 are combined, typically in a waveguide hybrid tee, producing a sum Z and a difference Δ. In the same way, signals from apertures A3 and A4 are combined to produce a sum and difference. The difference of A1 and A2 is combined by summing with the difference of A3 and A4 to produce an azimuth difference. The sum of A1 and A2 is combined with the sum of A3 and A4 to produce both a sum and a difference, the difference being the elevation difference and the sum being the monopulse sum.

Figure 25:
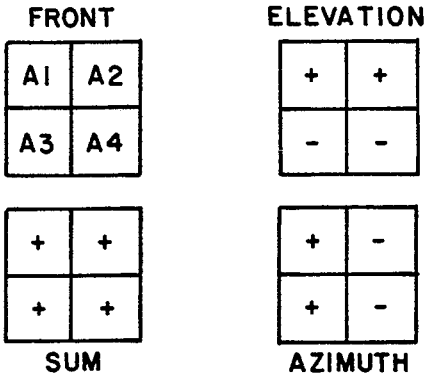
FIG. 25 is an illustration map of the combinations provided by the schematic of FIG. 24.

FIG. 25 illustrates the respective beam positions of A1–A4 in a beam space corresponding to the beam space illustrated in FIG. 22. As can be seen, the elevation difference is produced as the sum of A1 and A2 less the sum of A3 and A4. The azimuth difference is produced as the sum of A1 and A3 less the sum of A2 and A4. The monopulse sum is the sum of A1–A4.

The ratio of the elevation difference to the monopulse sum is employed to achieve the monopulse angle discrimination function to measure the elevation angle. The ratio of the azimuth difference to the monopulse sum is employed to achieve the monopulse angle discrimination function to measure the azimuth angle.

Figure 26:
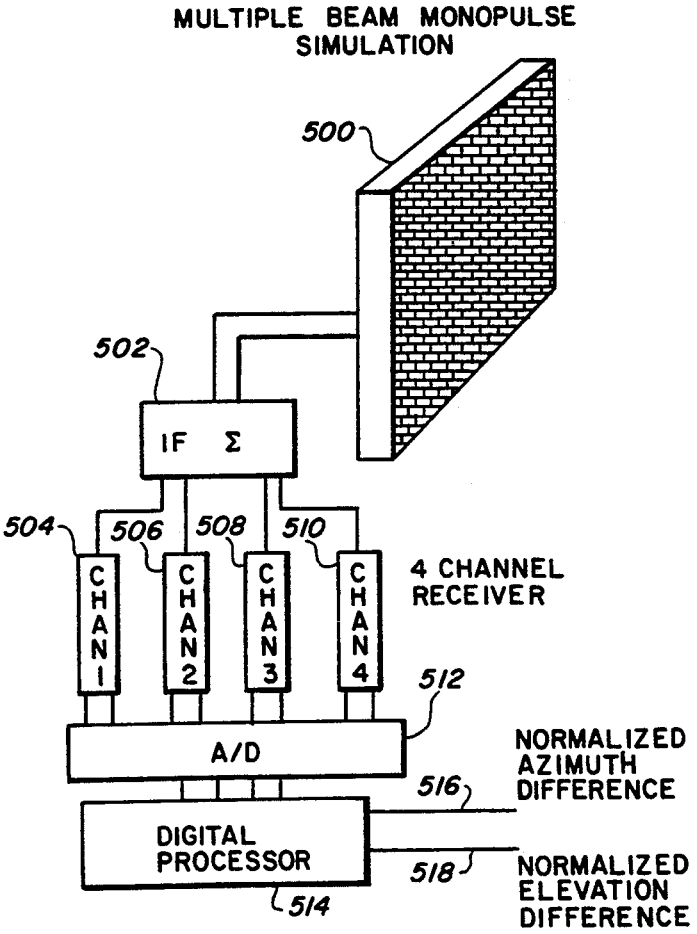
FIG. 26 is a functional schematic of the four beam monopulse of the present invention.

FIG. 26 illustrates the four beam monopulse antenna achieved by the application of plural acoustic source frequencies to beam deflectors 460 and 466 of the embodiment described with reference to FIGS. 20 and 23. Phased array antenna 500 produces a plurality of microwave mixer outputs $234_i$ which are combined and channelized in intermediate frequency summation unit 502. It will be appreciated that the teachings of the embodiment described with reference to FIGS. 14 and 15 teach how an optically fed phased array antenna can achieve monopulse on receive such that two distinct intermediate frequencies corresponding to each beam of the monopulse pair of beams are produced at microwave mixer output $234_i$. It will be apparent to persons of ordinary skill in the art how four distinct intermediate frequency channels may be produced to achieve a four beam monopulse on receive function. Thus, intermediate frequency summation unit 502 channelizes the four intermediate frequencies into channels 1–4 to be amplified by intermediate frequency amplifiers 504–510. It will be appreciated that channels 1–4 correspond to apertures A1-A4 described in reference to FIGS. 24 and 25. As an example of post processing, FIG. 26 illustrates the output of receivers 504–510 being converted from analog to digital form in A/D 512 which is provided to digital processor 514. Digital processor 514 produces normalized azimuth difference 516 by determining the ratio of azimuth difference to monopulse sum as described with reference to FIG. 25. Digital processor 514 determines normalized elevation difference 518 by determining the ratio of elevation difference to monopulse sum as described with reference to FIG. 25.

It will thus be appreciated that a four beam monopulse on receive function may be achieved. It may be further appreciated by persons skilled in the art that a four beam monopulse on transmit function may be achieved according to the teachings herein. Similarly, a two beam monopulse on transmit may be achieved and combined with a two beam monopulse on receive according to the teachings herein. The choice of monopulse on receive or monopulse on transmit functions is a designers choice to be guided by such factors as a desire to minimize the possibility that the transmit beam is detected by receivers in the far field, or a desire to minimize the effects of a jammer in the far field.

ELEVENTH EMBODIMENT

Figure 27:
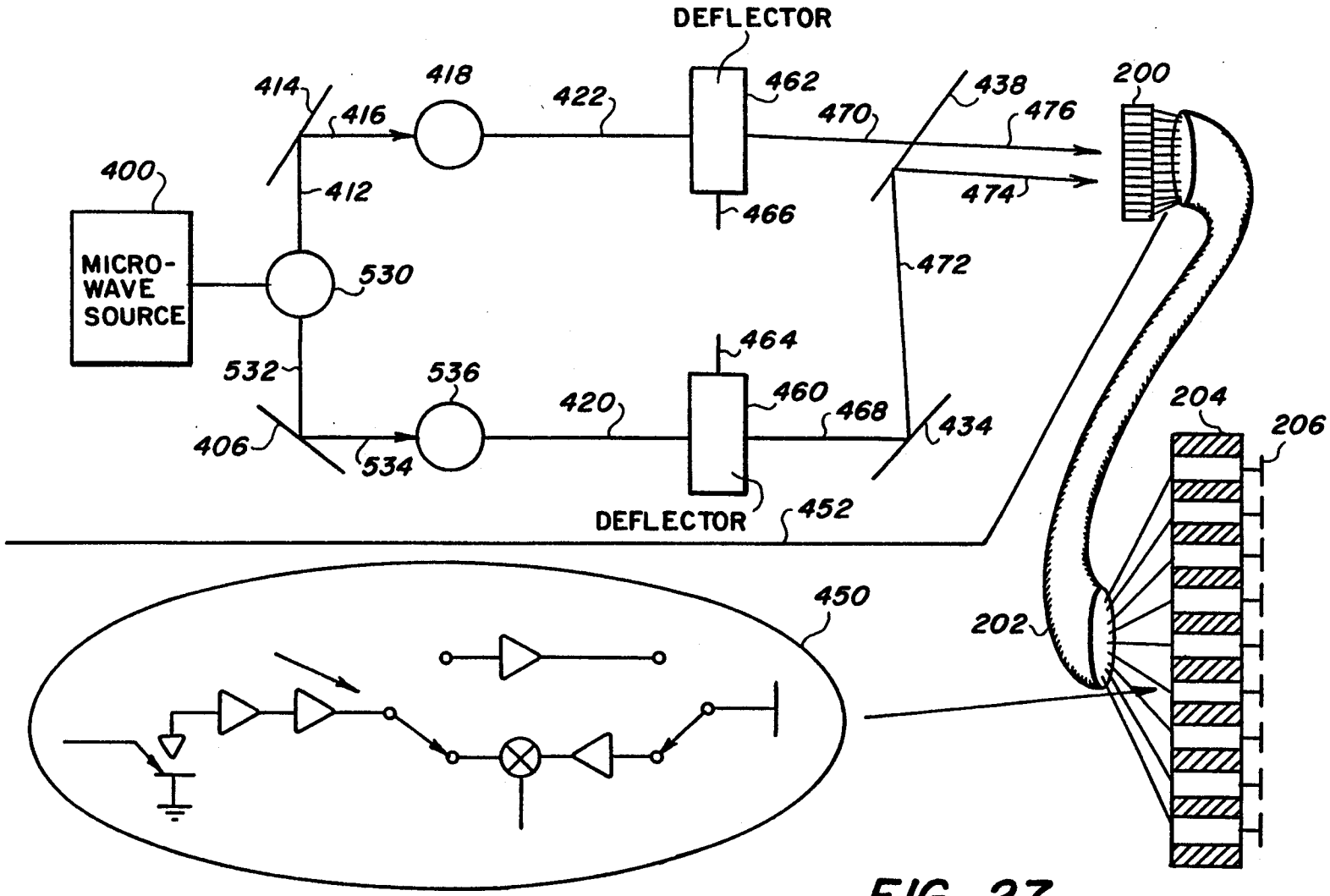
FIG. 27 is an optical schematic of a directly modulated interferometer of the present invention.

FIG. 27 is an optical schematic of an interferometer with directly modulated master laser 530 and side band injection-locked slave lasers 418 and 536. All elements of FIG. 27 are the same as corresponding elements of FIG. 19 except for the inclusion of elements 530–536 which replace some of the elements in FIG. 19.

In FIG. 27, master laser 530 is directly modulated by microwave source 400 producing a carrier (light) frequency $\Omega$ and two side band frequencies $\Omega+\omega$ and $\Omega-\omega$ in each of forward beam 532 and back beam 412. Slave lasers 410 and 536 operate as narrow band amplifiers. Slave laser 418 is tuned to the $\Omega+\omega$ side band. Therefore, elements 412, 414, 416 and 418 function in this present embodiment in substantially the same manner as they function with respect to the embodiment described with reference to FIGS. 19 and 20, except that a portion of carrier frequency $\Omega$ passes through slave laser 418 and is included in slave beam 422.

Forward beam 532, including carrier frequency $\Omega$ and side band frequencies $\Omega+\omega$ and $\Omega-\omega$, reflects off of mirror 406 as input beam 534 to second slave laser 536. Second slave laser 536 is tuned to carrier frequency $\Omega$ to amplify and pass carrier frequency $\Omega$ to master beam 420 which functions in substantially the same manner as master beam 420 functions in the embodiment described with reference to FIG. 19.

Figure 28:
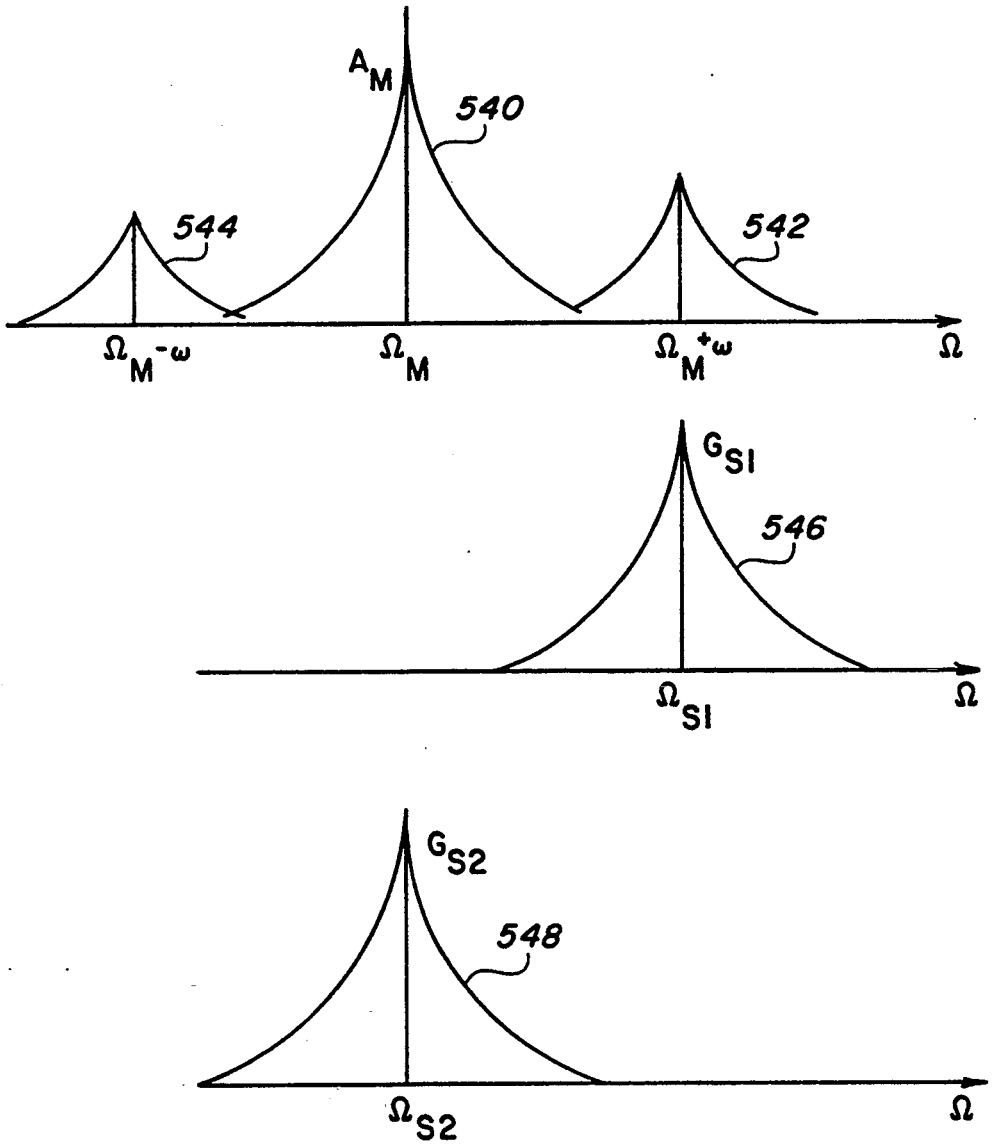
FIG. 28 is a spectral schematic of the direct modulation mechanism.

In FIG. 28, the amplitude of light signals produced by master laser 530 is illustrated as having three spectral components: carrier frequency $\Omega_M$ as element 540, upper side band 542 and lower side band 544. These three spectral components are present in both forward beam 532 and back beam 412. Typical side band amplitudes are reduced below carrier amplitudes by 30 dB.

Slave laser 418 is biased to function as a narrow band amplifier with pass band gain 546 centered about frequency $\Omega_{S1}$. Proper bias of slave laser diode 418 permits amplification of side band 542 while rejecting carrier 540 and side band 544. In a similar way, second slave laser 536 is biased to function as a narrow band amplifier with pass band gain 548 centered at frequency $\Omega_{S2}$. Second slave laser 536 is biased so as to amplify carrier 540 and reject side bands 542 and 544.

In typical operations, a portion of side bands 542 and 544 will pass through pass band 548 of second slave laser 536 and a portion of carrier 540 and side band 544 will pass through pass band 546 of slave laser 418. However, at microwave modulation frequencies $\omega$ that are greater than 6 GHz, adequate rejection of undesired side bands is obtained.

TWELFTH EMBODIMENT

Figure 29:
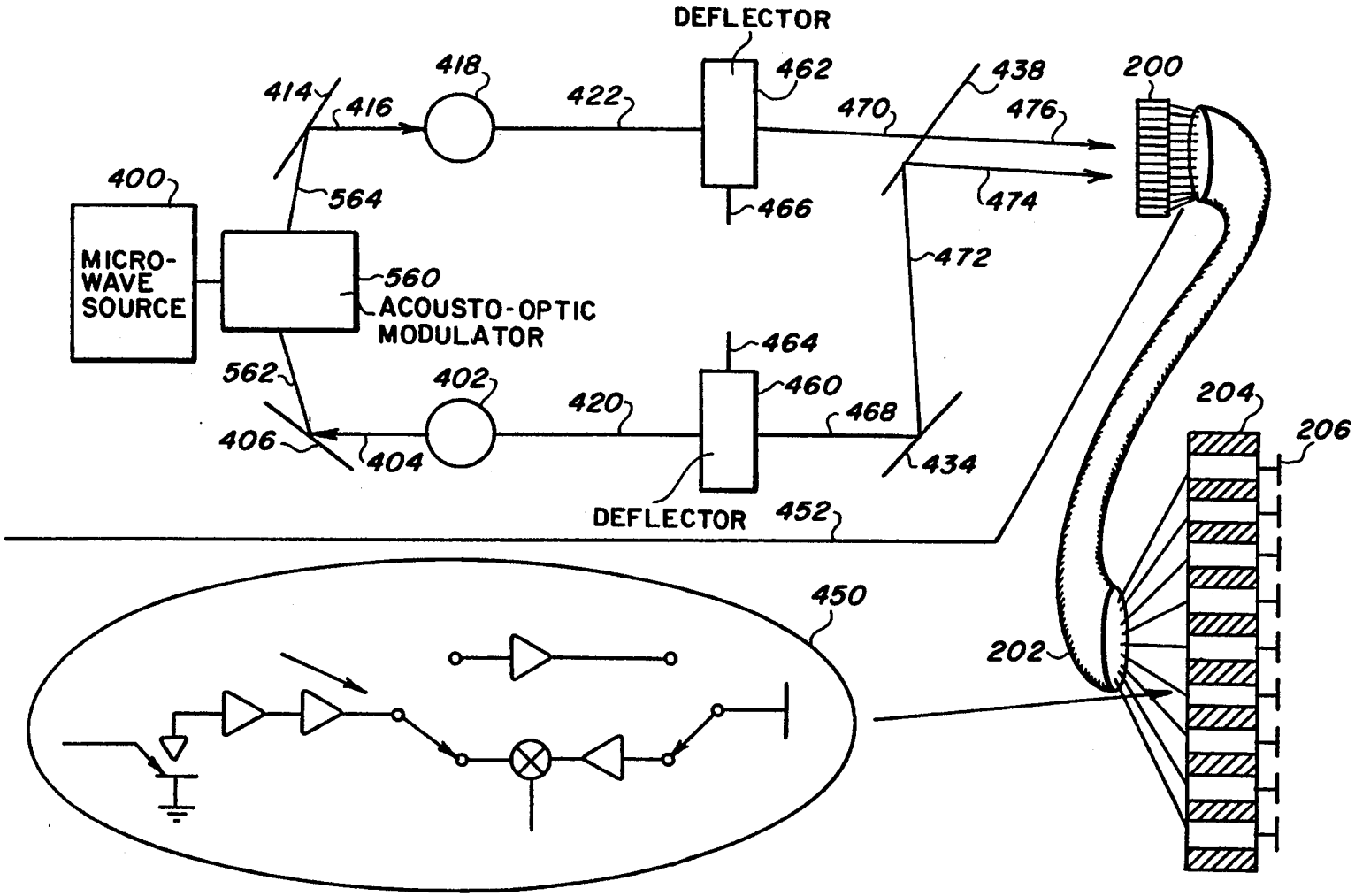
FIG. 29 is an optical schematic of an interferometer employing single side band suppressed carrier modulation.

FIG. 29 is an optical circuit schematic of an interferometer using an optical analog of single side band suppressed carrier modulation. All elements of FIG. 29 are the same as corresponding elements of FIG. 19 except elements 560–564. In FIG. 29, mirrors 406 and 414 are adjusted so that the angle between reflected beam 562 and modulated beam 564 is exactly a predetermined angle. Master laser back beam 404 is reflected from mirror 406 as reflected beam 562. Reflected beam 562 is modulated by conventional acousto-optic modulator 560 driven by microwave source 400 as modulated beam 564. Because, modulator 560 is of a conventional Bragg cell technology, the modulation frequency and the deflection angle between reflected beam 562 and modulated beam 564 are interdependent. Thus, both the modulation frequency is determined according to microwave source 400 and the deflection angle between reflected beam 562 and modulated beam 564 is determined according to microwave source 400. The optic circuit of FIG. 29 is adjusted so that slave laser 418 will be illuminated by modulated beam 564 only when the deflection angle between beams 562 and 564 is a predetermined angle corresponding to the modulation frequency of microwave source 400. In this way, slave laser beam 422 is produced from a single side band of modulator 560 with a suppress carrier. There is no feed through of the carrier frequency since the undeviated master laser light will not focus on the slave laser and will not influence the output light from the slave laser. It has been observed that a change in operating frequency of as little as 1 MHz may be sufficient to shift the side band out of the proper geometry and the system will then fail to injection lock.

It will be thus appreciated how the double defracted beam of the non-deflecting acousto-optic modulator described in connection with other embodiments described herein and undergoing no angular deviation would permit wide band frequency agility.

The layout indicated in the figure is simplified and is not optimum because the total light from the front of the master laser and that from the back of the laser to the beam recombination should be the same length. This is because of the finite coherence length of light from lasers. Even though the feedback beam passes through a slave laser, coherence is maintained.

The two beam deflectors 460 and 462 indicated in the figure should be located as close as possible to the fiber ends of the fiber array so as to avoid walkoff. Walkoff is due to the beam being deflected in a direction away from the optical axis. For example, if a beam of finite extent were deflected by either beam deflector 460 or beam deflector 462 through an angle and the distance between the beam deflector and optic pickup array 200 is sufficiently large that the beam of finite extent no longer illuminates the optic pickup array 200, then walkoff occurs. Thus, the optical design must accommodate the possibility of walkoff so as to permit formation of sufficiently large phase gradients and minimize the dilution of light power that may occur due to larger beam diameters.

Figure 30:
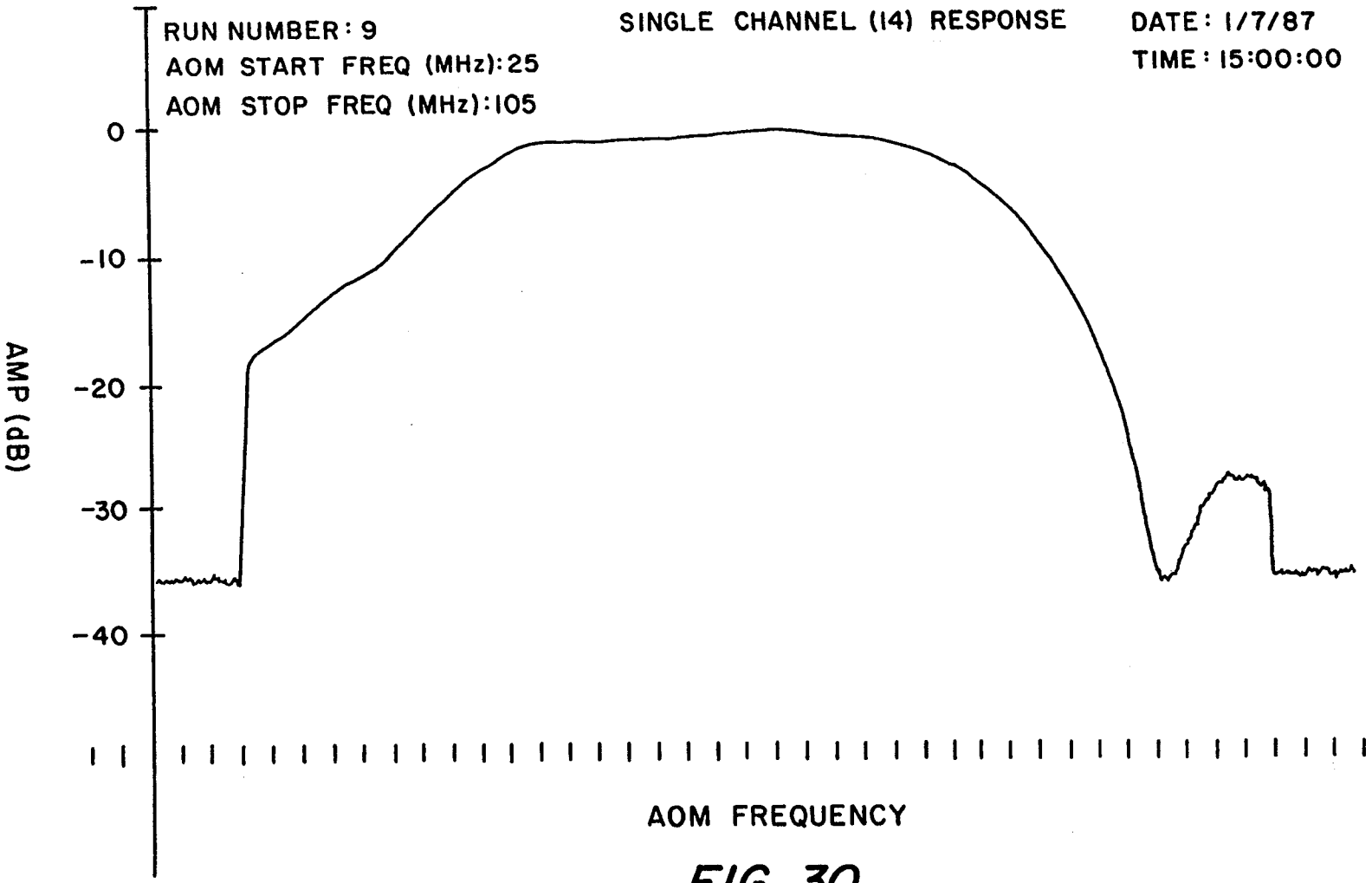
FIG. 30 is a graph of experimental results of a single fiber in a linear array.

FIG. 30 shows experimental results using a single fiber of the array. As the beam deflector (either beam deflector 460 or beam deflector 462) drive frequency ranges from 25 MHz to 105 MHz, the power level sensed at the output shows a fairly symmetric variation. This range is well in excess of the acousto-optic beam deflector transducer bandwidth and is therefore attenuated severely at band edges. The roll off is due to the combined effects of beam walkoff and transducer efficiency.

Figure 31:
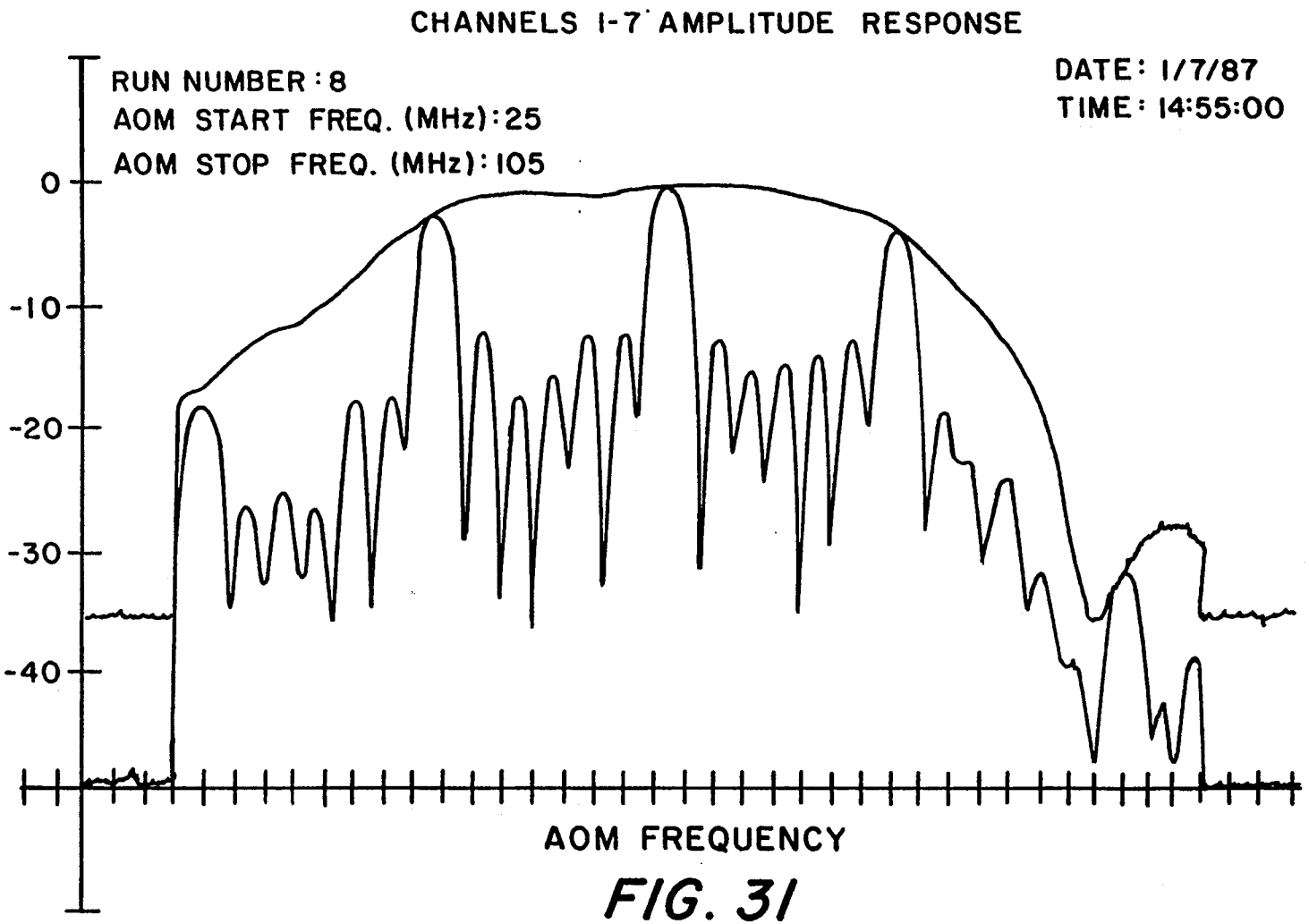
FIG. 31 is a graph of experimental results showing antenna array factor overlayed on results of a single fiber.

In the array, magnitudes of light signals were adjusted by varying the gap between the end of the fiber and the sensitive area of the photodetector, and the phase was adjusted by trimming the length of the fiber at a splice. FIG. 31 shows the total response of a seven element array overlayed on the response of a single element. The seven element array response was measured using a microwave lens corresponding to the receiver measurement that would be obtained in the far field if a receiver were disposed at a single angle. Thus, as different frequencies are applied to a beam deflector (either beam deflector 460 or beam deflector 462) the microwave beam will scan through different launch angles. The peaks in the array response shown in FIG. 30 correspond to launch angles directed at the receiver in the far field. The difference between the several peaks in the array response shown in FIG. 31 correspond to a phase difference of $2\pi$. The lower level peaks between the main peaks correspond to the antenna side lobes. The response as a whole is the antenna array factor weighted by the bandwidth limitations of a single Bragg cell.

Figure 32:
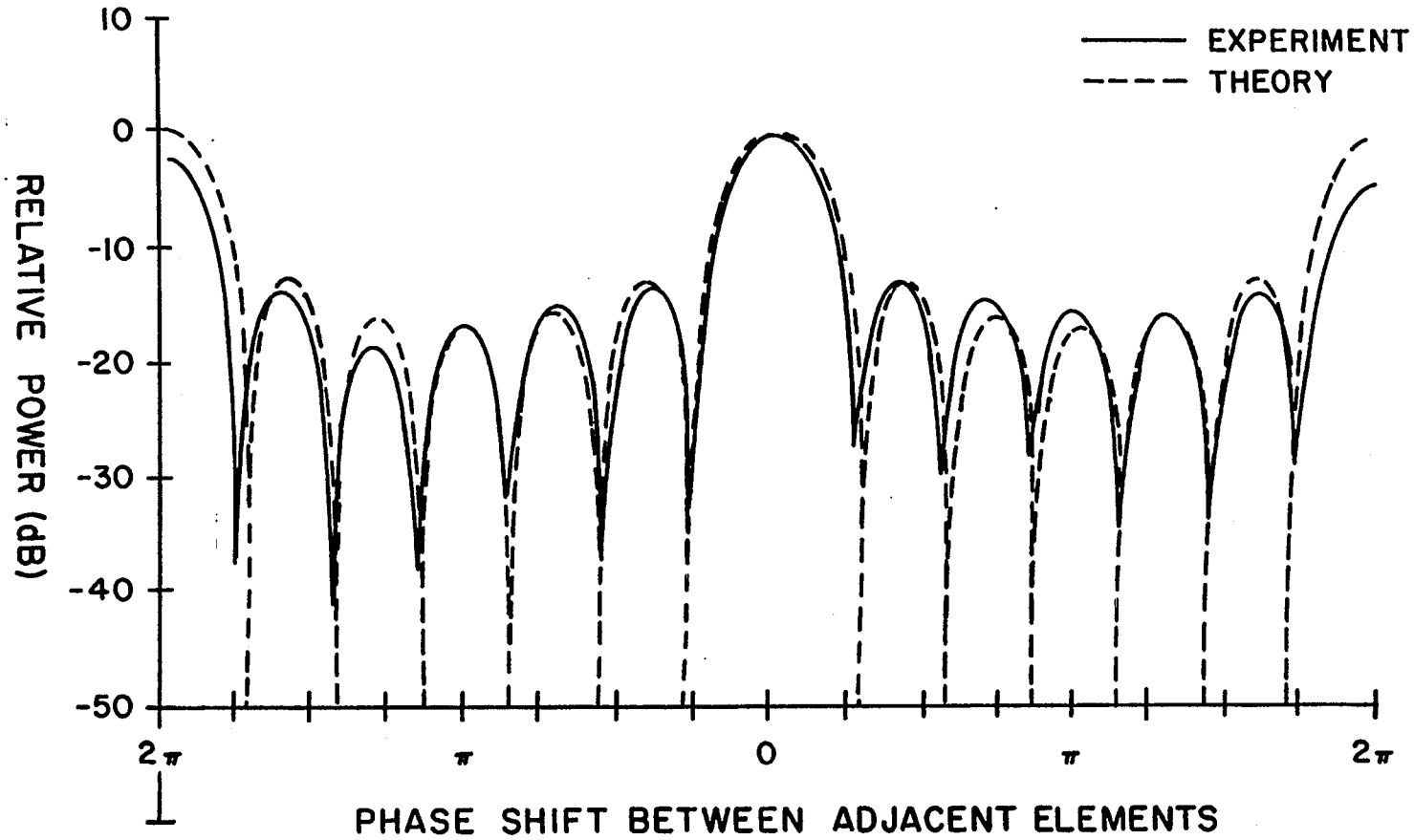
FIG. 32 is a graph showing an overlay of the experimentally derived antenna pattern with theoretically derived antenna pattern.

FIG. 32 shows the experimentally obtained array factor compared to a theoretical array factor, illustrating that the agreement is quite good. The major peaks are separated by phase difference of $2\pi$. The amplitude difference between the experiment in theory for the main peaks which are shifted in phase by $2\pi$ from the zero reference phase is due to the roll off in the acousto-optic beam deflector aperture frequency response. Of significance is the level to which errors in magnitude and phase have been reduced so as to produce null depths an excess of 27 dB below the peak response. The depth of null is indicative of a 0.5 dB rms power imbalance or a 3 degree rms phase variation in the seven element array, or some intermediate combination of smaller r ms errors.

THIRTEENTH EMBODIMENT

Figure 33:
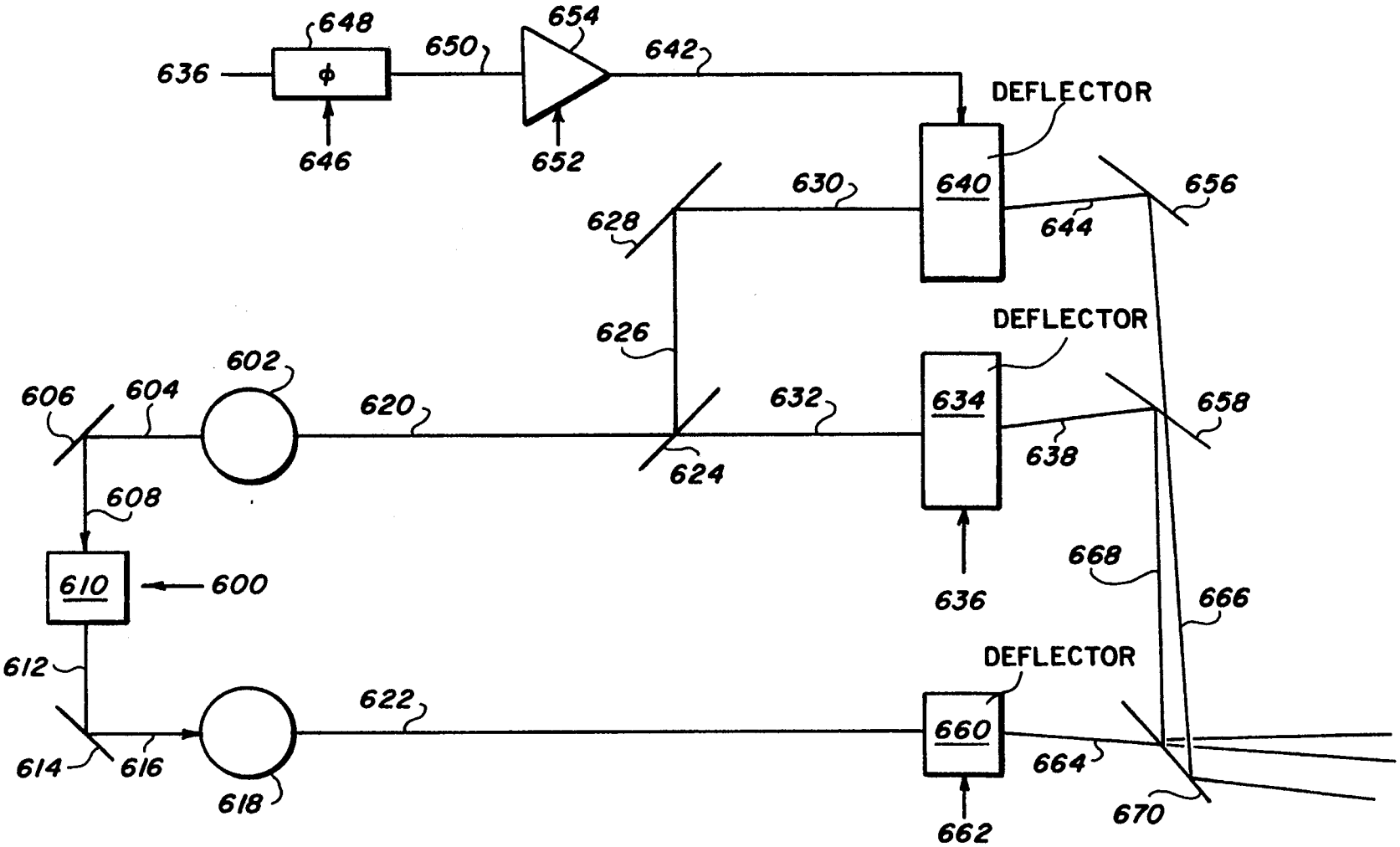
FIG. 33 is an optical schematic of an interferometer for producing a main beam and a dependent type auxiliary beam.

FIG. 33 illustrates an optical schematic of an interferometer for producing dependent type auxiliary beams. The elements in FIG. 33 are similar to corresponding elements of the embodiment described with reference to FIG. 19. Master laser 602 produces master forward beam 620 and master back beam 604. Master back beam 604 is reflected by mirror 606 as reflected beam 608. Reflected beam 608 is modulated by acousto-optic modulator 610 according to microwave source 600 to produce modulated beam 612. Modulated beam 612 is reflected by mirror 614 as slave laser input beam 616. Slave laser input beam 616 is injection-locked into and amplified by slave laser 618 to form slave beam 622. It will be appreciated that reflected beam 608 may be modulated to form modulation beam 612 by any of the modulation techniques described herein.

Master beam 620 is split by beam splitter 624 to form split beam 626 and main master beam 632. Split beam 626 is reflected by mirror 628 as auxiliary master beam 630. It will be appreciated that additional beam splitters may be employed so as to produce any reasonable number of additional auxiliary master beams. It will also be appreciated that beam splitter 624 may split beam 620 into beams 626 and 632 so that beam 626 and 632 have different power intensities.

Master beam 620 has a carrier frequency of $\Omega$. Second master beam 632 passes through conventional acousto-optic beam deflector (e.g., Bragg cell) 634 to produce deflected main master beam 638 according to acoustic source frequency 636. The acoustic source frequency 636 is $\omega_1$ so that the frequency of deflected main master beam 638 is $\neq+\omega_1$.

Auxiliary master beam 630 is deflected by conventional acousto-optic beam deflector 640 according to acoustic source frequency 642 to produce deflected auxiliary master beam 644. The acoustic source frequency 642 is the same as the acoustic source frequency 636; however, acoustic source 642 is delayed in phase with respect to acoustic source 636 by phase angle $\phi_1$. Accordingly, deflected auxiliary master beam 644 has a frequency $\Omega+\omega_1$ and a phase angle with respect to deflected main master beam 638 of $\phi_1$.

Acoustic source frequency 636 drives phase shifter 648 according to phase control signal 646 to produce phase shifted frequency 650 having phase shifted with respect to acoustic source 636 by $\phi_1$. Phase shifted frequency 650 is amplified by amplifier 654 according to gain control signal 652 to produce phase shifted acoustic source frequency 642 which in turn drives acousto-optic beam deflector 640.

Acousto-optic beam deflector 634 and 640 are oriented to produce deflected beams 638 and 644 both of which are deflected in the same plane, for example deflected along the X axis. Slave beam 622 is deflected in conventional acousto-optic beam deflector 660 according to acoustic source frequency 662 to produce slave deflected beam 664 which is deflected in a plane orthogonal to the plane of deflection of beams 638 and 644, that is to say, deflected beam 664 is deflected along the Y axis.

Master laser 602 produces light beam carrier frequency $\Omega$. Modulator 614 modulates the master laser light beam according to the frequency of microwave source 600. Microwave source 600 has a frequency of $\omega_{RF}$. Therefore, modulated beam 612 has a frequency of $\Omega+\omega_{RF}$, and slave beam 622 has $\Omega+\omega_{RF}$. Slave beam 622 is deflected by conventional acousto-optic beam deflector 660 according to acoustic source frequency 662 to produce deflected slave beam 664. Acoustic source frequency 662 is $\omega_2$ and deflects slave beam 622 along the Y axis. Deflected main master beam 638 reflects off of mirror 658 as reflected beam 668. Reflected beam 668 is combined with deflected slave beam 664 on combiner 670 to produce a two axis deflected control beam in a manner substantially identical to the manner in which beams 470 and 472 are combined on combiner 438 to produce a two axis steerable beam in the embodiment described with reference to FIG. 19. The beam in the present embodiment produced by the combination of beams 664 and 668 is referred to as the main beam.

Deflected auxiliary master beam 644 is reflected from gimballed mirror 656 as reflected auxiliary beam 666. Reflected auxiliary beam 666 is combined with deflected slave beam 664 on combiner 670 to produce an auxiliary beam in a manner substantially similar to the manner in which the main beam is produced in this present embodiment. Thus, the interferometer illustrated in FIG. 33 produces combined beams on combiner 670 so as to form phase gradients to encode a main microwave beam and an auxiliary microwave beam.

Gimballed mirror 656 is gimballed along two axes. When rotated about a first axis $\Theta$, the mirror deflects the auxiliary beam along an X axis. When mirror 656 is rotated about a second axis $\Phi$ the auxiliary beam is deflected along the Y axis. Thus, the two axes pointing of the auxiliary beam is controlled according to $\Theta$ and $\Phi$ rotation angles of gimballed mirror 656, and the phase and amplitude of the auxiliary beam with respect to the main beam is controlled according to phase control 646 and amplitude control 652.

With respect to the main beam produced by combination on combiner 670, the frequency of beam 638 is $\Omega+\omega_1$ and the frequency of beam 664 is $\Omega+\omega_2+\omega_{RF}$ where $\omega_1$ and $\omega_2$ vary depending on the desired X and Y main beam deflection, respectively. It will be appreciated that in order to produce a microwave beam of a predetermined microwave frequency $\omega_{RF}$, it is necessary to provide a vernier frequency compensation at microwave source 600 so that the microwave frequency radiated from a phased array antenna is a predetermined value, independent of the X and Y deflection. The technique to perform this vernier correction is described with respect to the embodiment described with reference to FIG. 19.

The phase relationship between the main and auxiliary beams thus produced on combiner 670 is determined according to phase control 646. The amplitude of the auxiliary beam with respect to the main beam is determined according to gain control 652. Thus, the embodiment described with reference to FIG. 33 controls the Y axis deflection of the main beam according to acoustic source frequency 662, the Y axis deflection of the auxiliary beam according to principally acoustic source-frequency 662 plus vernier gimbal rotation of mirror 656, the X axis deflection of the main beam according to acoustic source frequency 636, the X axis deflection of auxiliary beam according to principally acoustic source frequency 662 plus Vernier gimphal rotation of mirror 656, the amplitude of the auxiliary beam with respect to main beam according to gain control 652 and the phase of the auxiliary beam with respect to the main beam according to phase control 646.

It is sometimes desirable to control a phased array antenna in receive mode so as to place a null in the antenna pattern at the X axis and Y axis location of a jammer. Likewise, it is sometimes desirable to control a phased array antenna in a transmit mode to produce a null in the antenna pattern at a X axis and Y axis location of a receiver to be avoided. Accordingly, the main beam Y axis deflection according to acoustic source frequency 662 and X axis deflection according to acoustic source frequency 636 are produced to point the main beam in a desired direction. Further, the auxiliary beam is pointed in the desired null direction by gimballed mirror 656 with phase controlled according to phase control 646 and amplitude controlled according to amplitude control 652 so as to cancel by destructive superposition the antenna pattern of the main beam in the null direction, that is to say the direction of the jammer or receiver to be avoided. The superposition of the auxiliary beam, controllable according to phase by phase control 646 and controllable according to amplitude by gain control 652 and controllable according to X axis and Y axis deflection by gimballed mirror 656 superimposed on top of the main beam having X axis and Y axis deflections controlled according to acoustic source frequencies 636 and 662 are so controlled in relative phase and amplitude as to electrically cancel at the desired null X axis deflection angle of the jammer or receiver to be avoided. Once two receive channels are produced, well known jammer cancellation techniques describe how to combine main and auxiliary beams so as to produce a null in the direction of the jammer or receiver to be avoided.

FOURTEENTH EMBODIMENT

Figure 34:
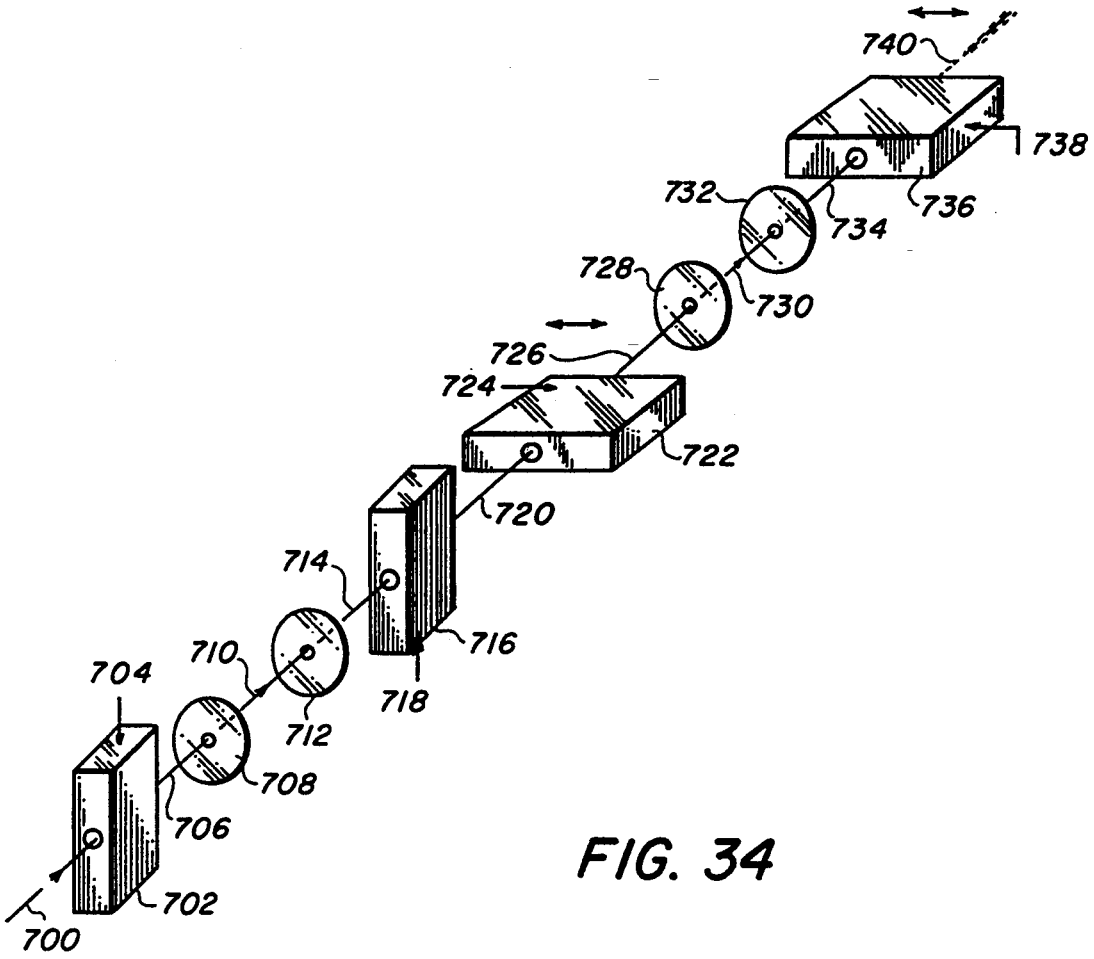
FIG. 34 is a perspective view of components of a two axes non-modulating acousto-optic beam deflector.

FIG. 34 illustrates a two axes non-modulating acousto-optic beam deflector. The beam deflector of FIG. 34 may be used in the embodiment described with reference to FIG. 33 as a replacement for gimballed mirror 656. Elements 702, 716, 722 and 736 are conventional (Bragg cell) acousto-optic beam deflectors driven by corresponding acoustic source frequencies 704, 718, 724 and 738. Elements 708 and 728 are Fourier lenses. Elements 712 and 732 are collimating lenses. It will be appreciated that anamorphic lenses may be required, spherical lenses are shown for simplicity.

In operation, planar light beam 700 is deflected in beam deflector 702 according to acoustic source frequency 704 as deflected planar beam 706. Fourier lens 708 focuses planar beam 706 at a point 710 which varies in the plane of deflection according to the angle of deflection. Light focused on point 710 proceeds on through collimating lens 712 to produce deflected planar beam 714. Deflected planar beam 714 is deflected by beam deflector 716 according to acoustic source frequency 718 to form deflected planar beam 720.

Beam deflector 702 and 716 and acoustic source frequencies 704 and 718 are so oriented that when beam 607 is modulated to have a frequency higher than beam 700, beam 720 will be modulated to have a frequency lower than beam 714. Further, acoustic source frequencies 704 and 718 are matched so that the frequency of beam 720 is the same as the frequency of beam 700.

It will be appreciated that elements 700–720 of the present embodiment described with reference to FIG. 34 are the same as elements 7–23 of the embodiment described with respect to FIG. 3. Thus, elements 700–720 comprise a non-modulating acousto-optic beam deflector for deflecting a beam in a first plane.

Elements 720–740 perform the same function as elements 700–720, except that the beam deflection is in a plane that is orthogonal to the plane of beam deflection produced by elements 700–720. Thus, by judicious control of acoustic source frequency 704, 718, 724 and 738, beam 740 is deflected in both an X axis and Y axis with respect to beam 700. Further, beam 740 is unmodulated with respect to beam 700, that is to say beam 740 has the same frequency as beam 700. It may therefore be appreciated that the gimballed mirror 656 described in the embodiment described with reference to FIG. 33 may be replaced by the two axes non-modulating acousto-optic beam deflector described with reference to FIG. 34.

FIFTEENTH EMBODIMENT

Figure 35:
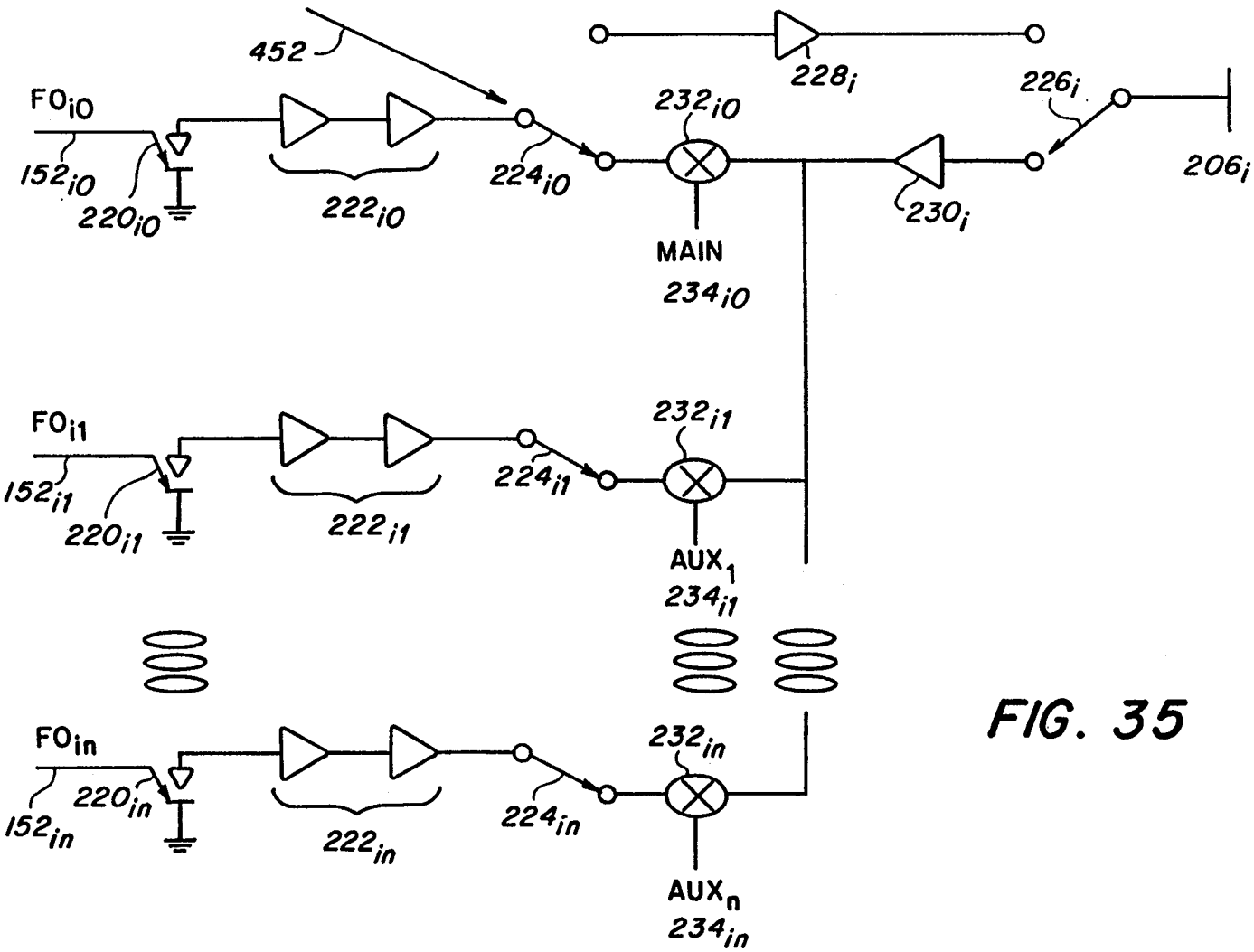
FIG. 35 is a circuit schematic for a TR module with provision for a main transmit beam and a main plus plural auxiliary beams.

FIG. 35 is a circuit schematic for a TR module similar to the module described with respect to FIG. 12. In FIG. 35, provision is made for a transmit and receive mode of a main antenna beam and a plurality of auxiliary antenna beams in receive mode only. Transmit/receive control signal 452 controls switches 224 and 226 to switch between transmit mode and receive mode. The switches are illustrated in a receive mode configuration.

Each radiating element $\mathbf{206}_i$ is associated with a single TR module indicated by the subscript i. Each TR module has a main transmit/receive channel indicated by a second subscript 0 and a plurality of auxiliary receive channels indicated by a second subscript 1 through n.

A main beam is formed by an optical interferometer such as described with reference to FIG. 19. Optical signals $FO_{i0}$ are picked up at fiber optic pickup ends 152 and provided to avalanche photodiode 220. In a similar way, a wholly different interferometer produces optical signals $FO_{i1}$ to form a first auxiliary antenna beam. Yet another wholly different optical interferometer forms optical signals $FO_{in}$ to form the nth auxiliary antenna beam. That is to say, when a main beam is to be formed and n auxiliary beams are to be formed, n+1 independent optical interferometers produce the necessary optical signals for beam control.

As to the main antenna beam, in receive mode amplifier $\mathbf{222}_{i0}$ produces the local oscillator frequency to mix in mixer $\mathbf{232}_{i0}$ with the output of amplifier $\mathbf{230}_i$ to form the intermediate frequency output $\mathbf{234}_{i0}$.

For each auxiliary antenna beam, in receive mode the output of amplifier $\mathbf{220}_{in}$ is mixed in mixer $\mathbf{232}_{in}$ with the output of amplifier $\mathbf{230}_i$ to form intermediate frequency $\mathbf{234}_{in}$.

Thus, in receive mode, the TR module illustrated in FIG. 35 produces an intermediate frequency corresponding to the signal received in the main antenna beam and n intermediate frequencies corresponding to the signals received in n auxiliary antenna beams. However, in transmit mode, only the main beam is transmitted. Therefore, n nulls may be formed in the receive mode antenna pattern at independently controllable locations. It will be apparent to persons of ordinary skill in the art that the circuit schematic of FIG. 35 may be modified to provide auxiliary beams on transmit so as to permit formation of n independently controllable nulls in the transmit mode antenna pattern or n spoofing or sidelobe covering beams.

SIXTEENTH EMBODIMENT

Figure 36:
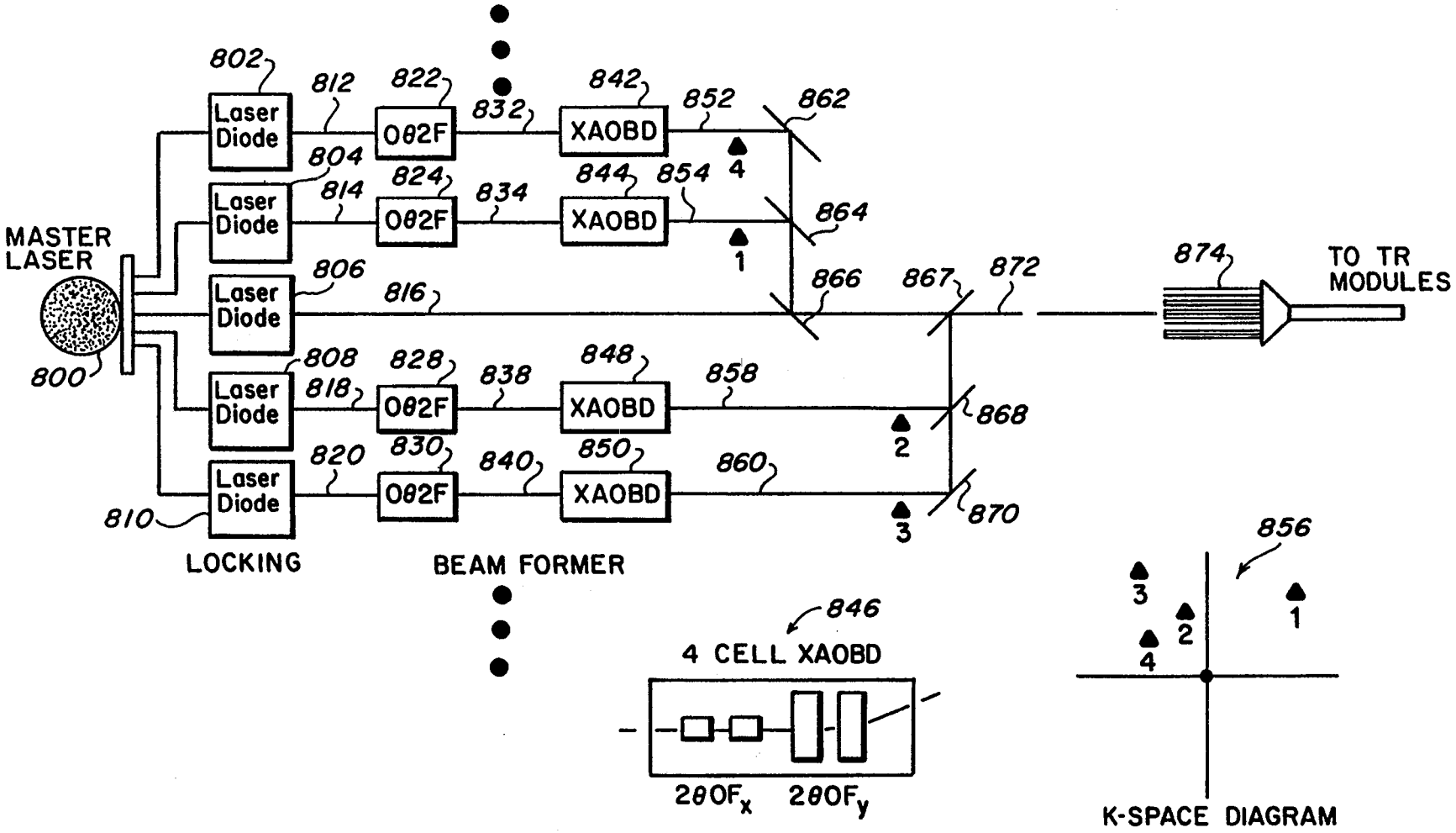
FIG. 36 is a functional schematic of an optical feed for producing independently controllable transmit and receive beams.

FIG. 36 is an alternative embodiment for producing multiple independently controllable transmit/receive beams. Master laser 800 drives slave lasers 802–810 which are injection-locked or phase-locked to master laser 800 to produce slave beams 812–820. Slave beam 816 is a frequency reference beam. Slave beams 812, 814, 818 and 820 are fed to non-deflecting acousto-optic modulators 822, 824, 828 and 830, respectively, to form modulated beams 832, 834, 838 and 840, respectively. Modulated beams 832, 834, 838 and 840 are fed to two axes non-modulating acousto-optic beam deflectors 842, 844, 848 and 850, respectively to form deflected beams 852, 854, 858 and 860, respectively. Two axes non-modulating acousto-optic beam deflectors 842, 844, 848 and 850 are four cell orthogonally deflected beam deflectors 846 and further described in the embodiment described with reference to FIG. 34. Mirrors 862 and 870 and combiners/splitters 864, 866, 867 and 868 combine slave beam 816 with deflected beams 852, 854, 858 and 860 to produce multiple beam encoded light beam 872. Light beam 872 illuminates fiber array 874 comprising fiber optic pickup elements which are in turn fed to TR modules.

In operation, master laser 800 produces light having frequency Ω. Modulators 822, 824, 828 and 830 produce modulated beams 832, 834, 838 and 840 which differ in frequency from reference beam 816 by the amount of the microwave acoustic source frequency (not shown). The frequencies of modulated beams 832, 834, 838 and 840 may be different from one another.

This embodiment obtains multiple beam performance by providing additional optical beams. K-space diagram 456 indicates beam positions produced by the circuit of FIG. 36 because the wave propagation numbers K and the light frequencies Ω are decoupled (beam deflection without frequency shift and frequency shift without beam deflection and involve no vernier frequency shifts). One of the beams, usually the reference beam, is taken as the origin and can without loss of generality be assumed to propagate along the optical axis of the system. The microwave frequency is given by the difference frequency between beams 832, 834, 838 and 840 and the reference beam 816 while the phase gradient is simply the projection of the steered beam onto the plane of the fiber array.

The circuit of FIG. 36 is capable of exciting a plurality of independently controlled beams simultaneously. K-space diagram 856 shows four independent beams, each with a different azimuth direction and a different elevation direction (X axis and Y axis deflection). Each beam can also operate on a different RF. The range of microwave frequencies must be less than an octave to avoid difference frequencies from different beams generating in-band signals. To receive the transmitted signal using the pattern synthesized, the mixer in the TR module is driven with the same controls but frequency shifted by the offset required to down convert (or up convert) to the intermediate frequency band. The proper phase gradient will exist to filter out the separate signals and relocate them to their desired intermediate frequencies.

In practical operation, the designer must appreciate that the mixer of the TR modules in a receive mode will receive a set of distinct local oscillator frequencies. The time waveform is the Fourier transform of this spectrum and could, for certain possible sets of local oscillator tones, be a repetitive narrow pulse. This would cause no problem for a linear system such as filters but for a non-linear system such as mixers, which are driven very hard to achieve minimal conversion loss and maximum dynamic range, the conversion loss could be expected to be increased, sometimes very considerably.

SEVENTEENTH EMBODIMENT

Figure 37:
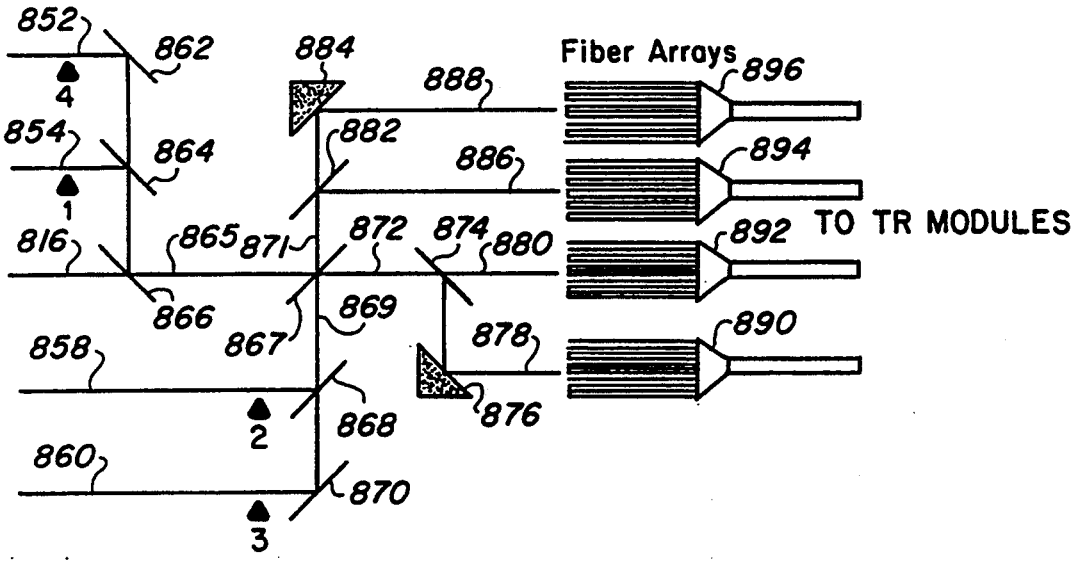
FIG. 37 is an optical schematic for a manifold distribution of beams to fiber arrays.

FIG. 37 illustrates multiple fiber arrays for providing close spacing of fiber pickup elements. RF radiating elements are conically spaced at separations of $S=\Lambda/2$. Owing to the size of the optical fibers, it is usually not possible to space fiber optic pickup elements at conically spaced intervals of $s=\lambda/2$. Instead, the size of the optical fibers limits the separation of the fiber optic pickup elements to approximately 100λ. This present embodiment enables the equivalent spacing to be reduced by a factor of two in each of the X and Y directions.

Reference beam 816 and deflected beams 852, 854, 858 and 860 are combined with mirrors 862 and 870 and combiners/splitters 864, 866, 867 and 868 as described with respect to the embodiment described with reference to FIG. 36. Combiner/splitter 867 is, for example, a half silvered mirror splitting light incident thereon into two beams. For example, beam 865, which is combined from beams 816, 852 and 854 is split by splitter 867 into a component of beam 871 and a component of beam 872. Further, beam 869, which is combined from beams 858 and 860 is split by splitter 867 into a second component of beam 871 and a second component of beam 872. Both beams 871 and 872 contain identical information. Beam 872 is split by splitter 874 and mirror 876 into beams 878 and 880. Likewise, beam 871 is split by splitter 882 and mirror 884 into beams 886 and 888. Beams 878, 880, 886 and 888 contain identical information. Fiber arrays 890, 892, 894 and 896 are confrontingly disposed to beams 878, 880, 886 and 888, respectively. However, fiber arrays 890–896 are displaced laterally transverse to the optical axis by a small amount as described below.

With respect to fiber array 890, fiber array 892 is displaced laterally in an X direction by one-half of the interelement spacing of the fiber optic pickup elements. With respect to fiber array 890, fiber array 894 is displaced laterally in a Y direction by one-half of the interelement spacing of the fiber optic pickup elements. With respect to fiber array 892, fiber array 896 is displaced laterally in a Y direction by one-half of the interelement spacing of the fiber optic pickup elements. Thus, the effective density of fiber optic pickup elements which are receiving the combined beams presented in beams 878, 880, 886 and 888 is increased by a factor of 2 in the X direction and increased by a factor 2 in the Y direction. Individual optical fibers are fed to corresponding TR modules. It is thus possible to interpolate optical signals between positions of fiber optic pickup elements. For example, where the pickup elements can be spaced no closer than a 100 times the optical wavelength, with the configuration of this embodiment, the fiber optic pickup elements will have an equivalent spacing of no more than 50 times the optical wavelength.

EIGHTEENTH EMBODIMENT

Pulse compression is a radar technique to achieve improved range resolution while maintaining long pulse lengths for high average power. Chirp is an important pulse compression technique that challenges the optical beam forming embodiments of the present invention.

Chirp is a technique employing linear-FM transmit and receive pulse modulation on a radar pulse, referred to as the chirp pulse. The chirp pulse is of a long duration relative to the range resolution sought by the radar. Persons skilled in the radar art will appreciate that the relationship between ordinary pulse duration and range resolution is defined by the speed of light. The chirp pulse is frequency modulated from a first frequency at pulse start to a second frequency at pulse end with a linear change in frequency over the pulse duration.

Figure 38:
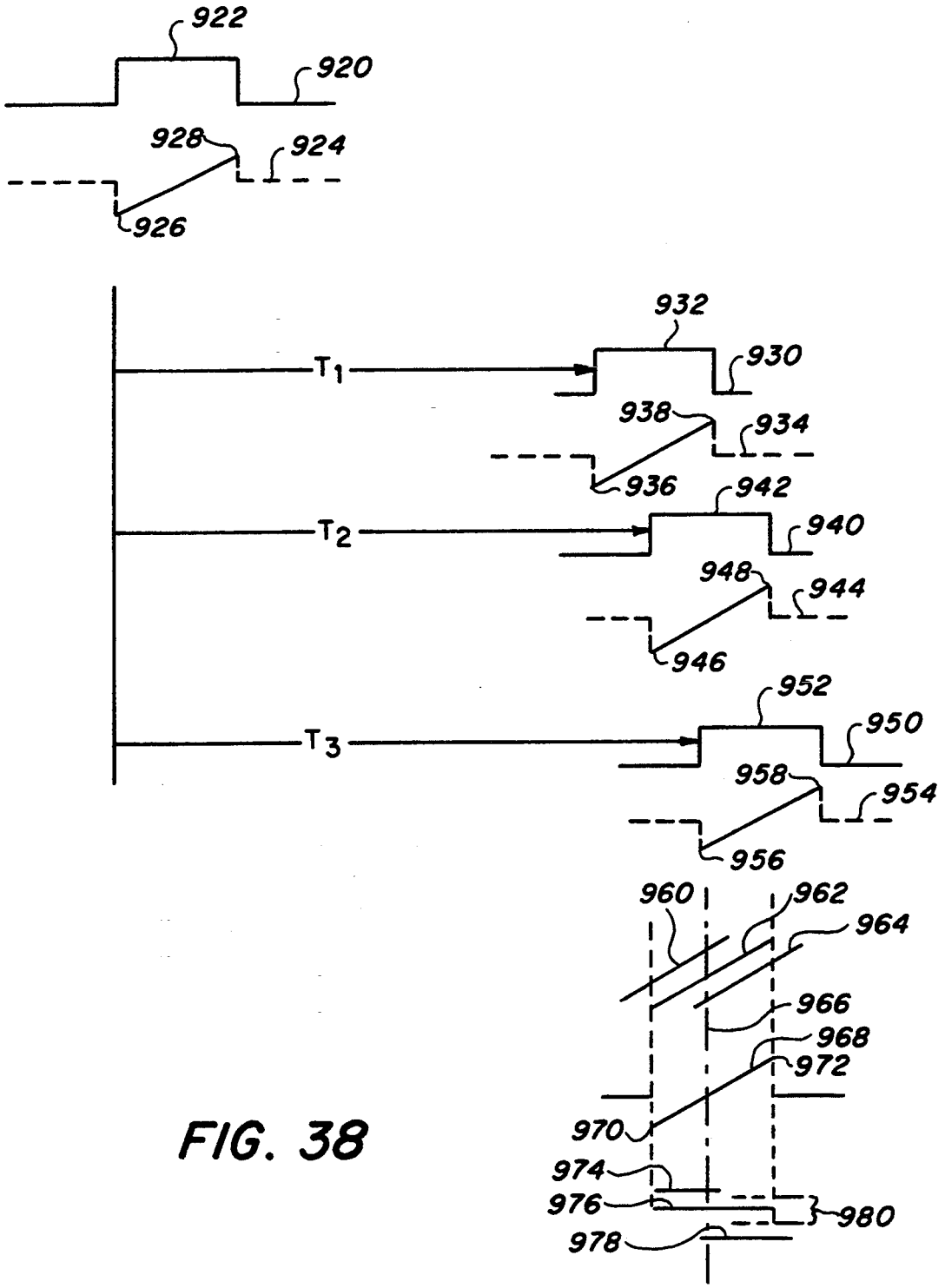
FIG. 38 is a timing diagram for chirp pulse compression.

In FIG. 38 transmit pulse amplitude 920 is on during pulse duration 922. During pulse duration 922 transmit pulse frequency 924 varies from first frequency 926 at pulse start linearly to second frequency 928 at pulse end.

After time delay $T_1$ the transmit pulse is reflected by a reflector at range $R_1$ back to the receiver. Received pulse amplitude 930 is received with pulse duration 932. During receive pulse duration 932, receive pulse frequency 934 varies from a first frequency 936 to a second frequency 938.

In a similar manner after time delay $T_2$ and time delay $T_3$ the transmit pulse 920 is reflected by reflectors at ranges $R_2$ and $R_3$ back to the receiver as received pulse amplitudes 940 and 950 having pulse durations 942 and 952, respectively. Received pulses 940 and 950 have frequencies 944 and 954 during pulse durations 942 and 952 that vary from first frequencies 946 and 956 at receive pulse start to second frequencies 948 and 958 at receive pulse end, respectively.

Thus, with reflectors at ranges $R_1$, $R_2$ and $R_3$, the receiver will receive pulses having linear-FM frequency shifts 960, 962 and 964 corresponding to reflectors at ranges $R_1$, $R_2$ and $R_3$, respectively. It is therefore seen that at a time corresponding to time 966 the receiver will receive a signal having three frequency components corresponding the reflectors at ranges $R_1$, $R_2$ and $R_3$, respectively.

The receive signal is heterodyned with a local oscillator having frequency 968 varying from a first local oscillator frequency 970 to a second local oscillator frequency 972 so that the median time between the time at which the local oscillator frequency is the first local oscillator frequency 970 and the time when the local oscillator frequency is the second local oscillator frequency 972 corresponds to time 966. This produces a de-chirped signal.

The de-chirped signal has three intermediate frequency components 974, 976 and 978 corresponding to receive signal frequencies 960, 962 and 964, respectively. The intermediate frequency components 974, 976 and 978 do not vary in frequency with time; therefore, the three frequency components can be separated into three intermediate frequency signals corresponding to signals reflected from reflectors at ranges $R_1$, $R_2$ and $R_3$, respectively. Therefore, intermediate frequency signals, corresponding to reflectors at different ranges will have different intermediate frequencies. Local oscillator linear-FM frequency 968 is started, ended and centered in time so that a signal reflected from a reflector at range $R_2$ will produce intermediate frequency 976. The signal at intermediate frequency 976 is fed to the intermediate frequency amplifier of the receiver. The intermediate frequency amplifier of the receiver has an intermediate frequency bandwidth 980 designed to amplify and pass intermediate frequency 976 and to reject intermediate frequencies 974 and 978. Therefore, signals reflected from reflectors at ranges $R_1$ and $R_3$ are rejected in the receiver and signals reflected from reflectors at range $R_2$ are amplified and passed through the receiver. Thus, the resolution achieved by a chirp radar design is defined by the linear-FM frequency rate of change (i.e., slope) and the bandwidth of the intermediate frequency amplifier in the receiver. Without chirp processing, the range resolution is defined by the pulse duration.

The linear-FM waveform presents unique challenges to a radar based on a phased array antenna. This challenge is best understood in connection with the intrinsic dispersion of the phased, also referred to as corporate fed, antenna array. The dispersion is used to denote a frequency dependence in the beam direction so that the microwave beam formed changes launch direction as the microwave signal changes frequency. If a linear phase progression exists across, for example, a linear array, a beam will be formed in a direction defined by:

$$\sin\theta = (\Delta\phi/\pi)\,(\Lambda/\Lambda_0),$$

where $\theta$ is the angle from broad side, $\Lambda_0/2$ is the spacing between radiating elements, A is the operating wavelength, and $\Delta\phi$ is the phase shift between adjacent elements in the array. As the frequency of operation is increased, as is the case in a chirp waveform, the beam squints toward the normal to the broad side of the antenna array. If the microwave beam launch direction from the antenna array is determined by conventional phase shifters, it is necessary that the phase shifter be reciprocal so that both the transmit and receive beams are handled properly by the corporate divider/combiner. It should be noted that usually there is a significant loss in the power division circuit so that the signals are amplified before transmission by solid state amplifiers. Further, the phase shifters are usually digitally controlled so that a digital bus is routed to the phase shifters. Since the beam pattern and side lobes are very strongly influenced by the accuracy with which the phase shifters are set (modulo $2\pi$), sometimes a lookup table is stored with the phase shifters to allow more precise approximation to account for individual variability in the phase shifters as a function of frequency of operation.

Thus, it is seen that the microwave beam launch direction is squinted by the linear-FM chirp pulse, and conventional beam forming structures are encumbered with complicated phase compensation circuits in order to de-squint the microwave beam.

Figure 39:
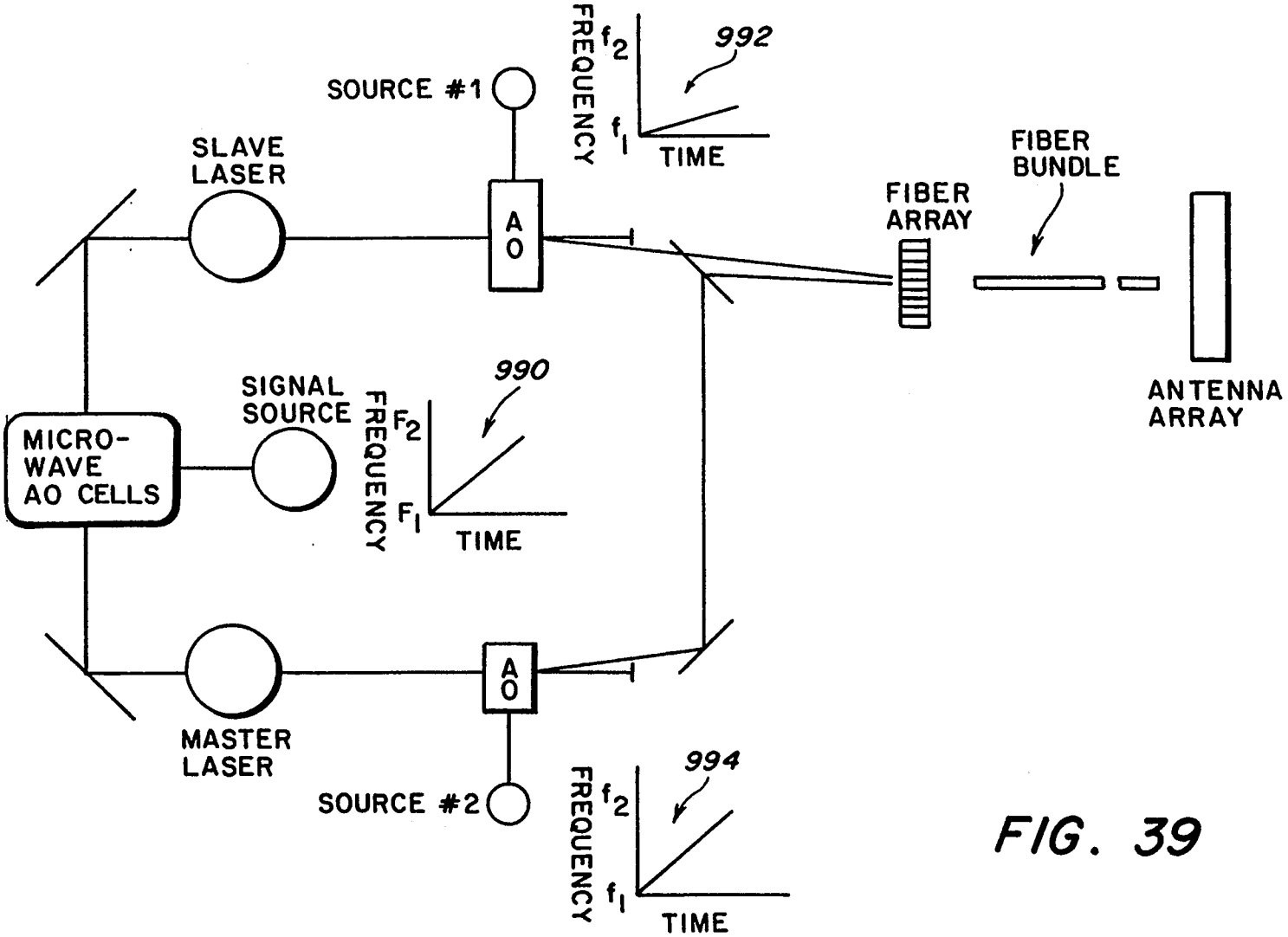
FIG. 39 is an optical schematic of an optically fed phased array antenna for a radar using chirp pulse modulation.

FIG. 39 is an optical schematic of the present embodiment substantially similar to the embodiment described with reference to FIG. 19 except that this embodiment is modified to transmit and receive linear-FM chirp pulses. In order to produce the chirp pulse, the signal source that drives the microwave acousto-optic cells is frequency swept between frequency $F_1$ and $F_2$ over the time of the pulse duration according to frequency sweep characteristic 990. In order to de-squint the microwave beam launch angle, it is necessary to encode in the phase gradient presented to the fiber array a compensating deflection. This compensating deflection is encoded in the acousto-optic cells driven by source 1 and source 2 according to characteristics 992 and 994, respectively.

In operation, a desired microwave beam direction is defined. Then the desired chirp waveform is defined. Then the squint caused by the chirp waveform (frequency time dependent) is defined. Then the time dependent phase gradient change to de-squint is defined. Then the frequency chirp characteristics 192 and 194 are defined for sources 1 and 2, respectively are defined. Finally, the frequency characteristic 990 for the signal source which drives the microwave acousto-optic cells is defined to produce the desired microwave chirp pulse while at the same time correcting for deflection defined and any undesired modulation due to use of conventional acousto-optic beam deflectors in a manner similar to the correction described in the embodiment with reference to FIG. 19. In this way, a transmit chirp pulse is produced. It will be appreciated that a receive local oscillator phase gradient is produced in the same way. Thus, by synchronously changing the acousto-optic beam deflector control frequencies, as indicated, a constant beam direction in space can be maintained even as the chirp pulse changes frequency. If the acousto-optic beam deflector chirps are chosen correctly, the beam pointing direction does not change. This allows the entire broad band waveform to be directed at a target and thereby avoid waveform filtering arising from pattern squint. A similar discrete beam switching is effective with frequency hopped waveforms such as serially synthetic spread spectrum waveforms.

NINETEENTH EMBODIMENT

The embodiment described with reference to FIG. 39 discloses an optical fed phased array antenna for a radar using chirp pulse compression to detect a reflector at a single range $R_2$ and reject the detection of reflectors at other ranges. In a search type radar it is desirable to detect reflectors at any range within the radar range coverage, and determine the range of reflector. In FIG. 38 local oscillator frequency 968 is started at first frequency 970 at a time after a time delay $T_2$ after the start of the transmit pulse corresponding to a reflector at range $R_2$. The heterodyne signal presented to the intermediate frequency amplifier includes intermediate frequencies 974, 976 and 978; however, only intermediate frequency 976 is amplified due to the frequency bandpass 980 in the intermediate frequency amplifier. If the intermediate frequency amplifier were either channelized or a broad band amplifier, intermediate frequencies 974, 976 and 978 could be amplified; however, because of the interaction between frequency and beam deflection and the frequency compensation characteristics 992 and 994 employed in the embodiment described with reference to FIG. 39, the microwave beam launch angle corresponding to intermediate frequencies 974, 976 and 978 are all different. Only intermediate frequency 976 corresponds to a stabilized or de-squinted microwave beam. Intermediate frequencies 974 and 978 correspond to squinting beams. It is desirable for the optically fed phased array antenna to support a search mode in a pulse compression radar using chirp pulses.

Figure 40:
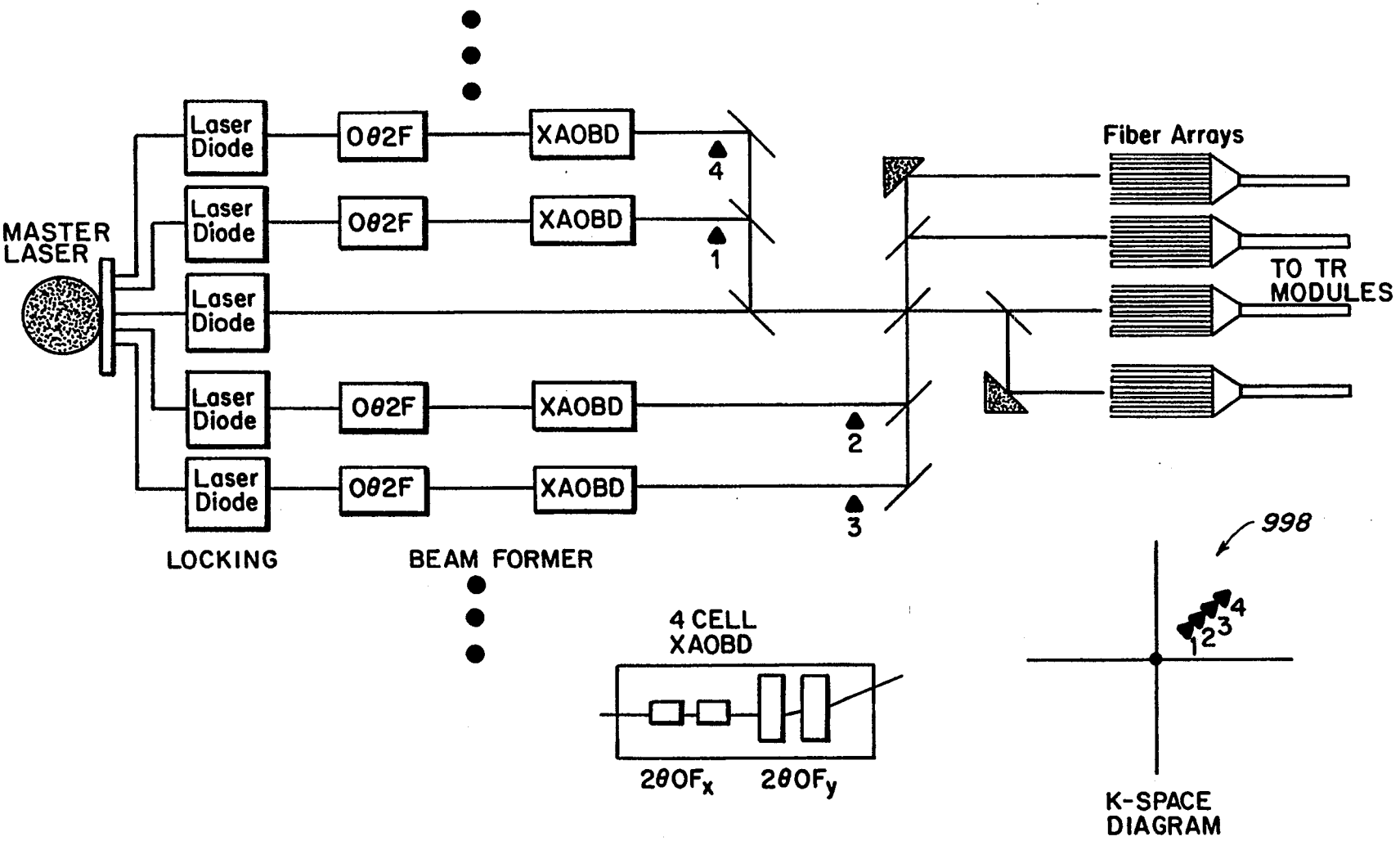
FIG. 40 is an optical schematic of an optical feed for a stepped pulse compression radar.

FIG. 40 is an optical schematic of an optic feed for a phased array antenna similar to the feed disclosed in the embodiment described with reference to FIG. 36. In FIG. 40, four beams are produced at potentially four difference microwave frequencies, all beams having independently definable microwave beam launch angles. Thus, the optical circuit of FIG. 40 can de-squint the microwave beam by stepwise switching between the four beams. If the chirp pulse frequency ramp does not drive the corporate fed antenna array too far off the desired pointing direction and the microwave beam has sufficient beam width, it is clearly understood that the four stepped beams produced by the optical feed of FIG. 40 can maintain microwave beam launch angle accuracy sufficient to keep the microwave beam pointed at the target despite frequency changes in the chirp pulse. The four independently steerable beams are indicated in K-space characteristic 998.

The optical circuit of FIG. 40 employs two axes acousto-optic beam deflectors to produce non-modulating beam deflection. With such a design, the squint of the corporately fed phased array antenna caused by the frequency changes over the pulse duration of the chirp pulse is simply compensated by switching between one beam pointing position and another beam pointing position. Therefore, the frequency range over the chirp pulse may be divided into four channels so that the intrinsic dispersion over any one of the four channels is sufficiently small so that the beam is maintained substantially pointed in the direction of the target.

TWENTIETH EMBODIMENT

True time delay behavior of an array obtained in a direct manner by treating the wide spectral band as independent subbands was discussed in the embodiment described with reference to FIG. 40. The K-space characteristic 998 shows all of the vectors having slightly different phase gradients (wave number projections) to match that gradient (wave number) required to launch or receive signal from a desired direction. The present embodiment achieves the wide band (true time delay beams) characteristics with reduced conversion losses in the receive mixers.

Figure 41:
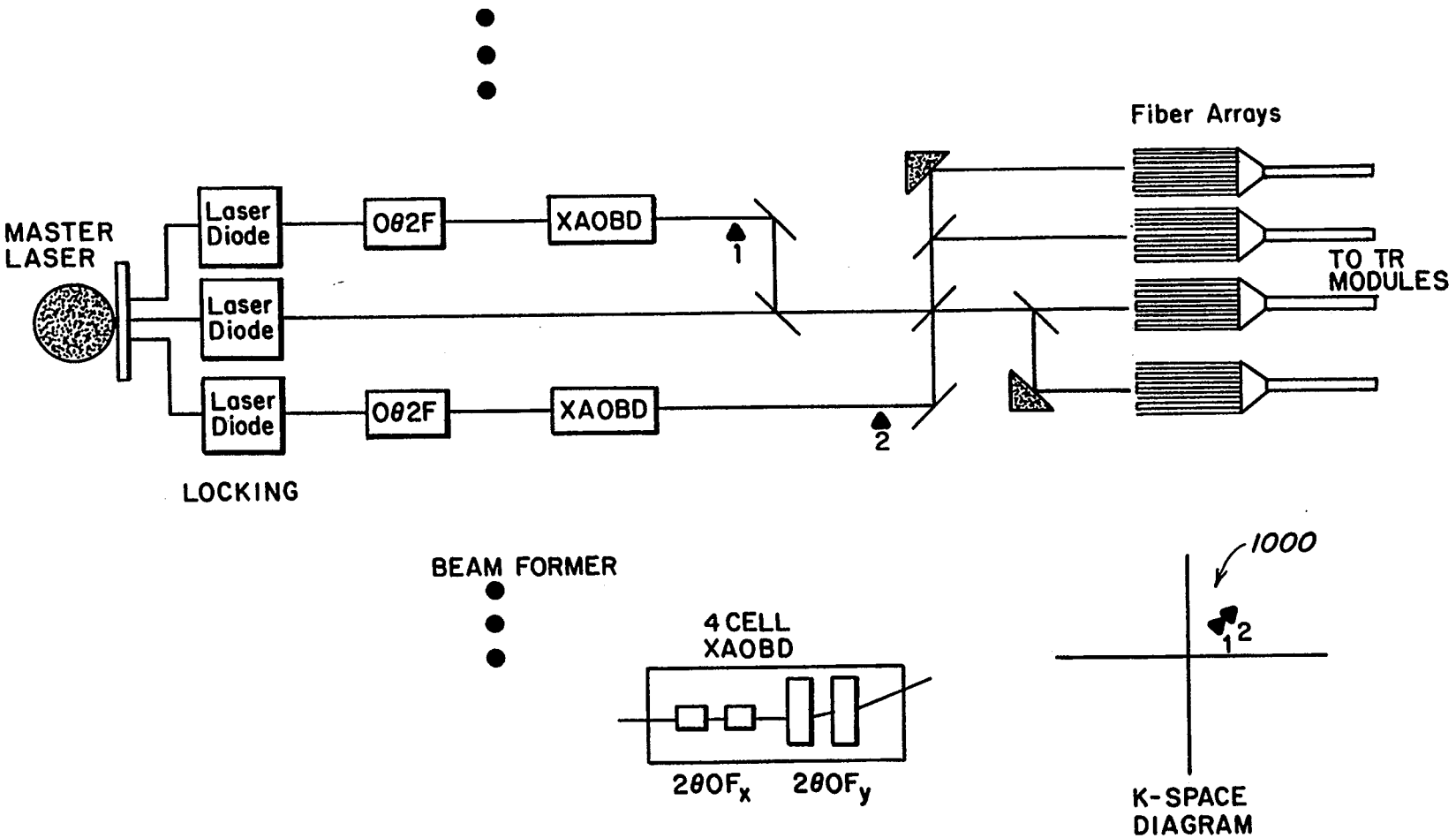
FIG. 41 is an optical schematic for an optical feed of a pulse compression radar.

FIG. 41 is an optical schematic of an optically fed phased array antenna of the present embodiment. The optical circuit of the present embodiment is substantially similar to the optical circuit of the embodiment described with reference to FIG. 36. However, the present embodiment needs only two deflection beams designated as beams 1 and 2 in FIG. 41 and one reference beam.

K-space diagram 1000 indicates that beams 1 and 2 are deflected so as to form different phase gradients across the fiber arrays. In this embodiment, beam 1 is deflected so as to produce a desired microwave launch angle when the microwave frequency of the chirp pulse is a first frequency and beam 2 is deflected so as to produce the desired microwave beam launch angle when the microwave frequency of the chirp pulse is a second microwave frequency.

Figure 42:
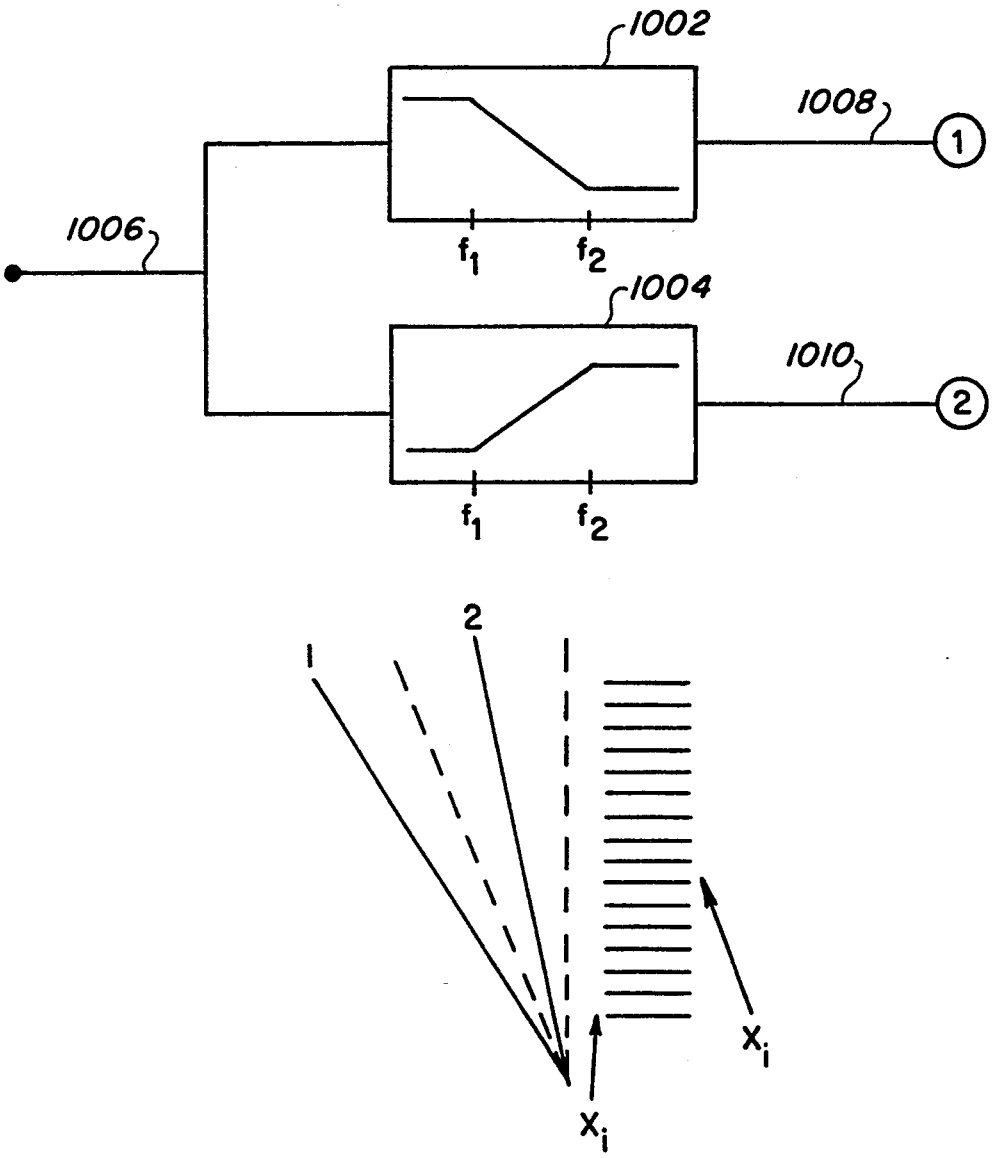
FIG. 42 is a functional schematic of frequency discrimination circuitry in support of the optical circuit of FIG. 41.

FIG. 42 is a circuit schematic employing first discriminator circuit 1002 and second discriminator circuit 1004. Both discriminator circuits are driven by microwave source attached to transmission line 1006. The microwave source feeding 1006 could be any wide band wave forth but is here considered to be a chirp pulse having linear-FM frequencies from first frequency $f_1$ to second frequency $f_2$. Discriminator circuit 1002 is a negative slope discriminator circuit providing output 1008 with the full amplitude microwave signal equal to that of input 1006 when the frequency of signal 1006 is $f_1$ and the amplitude of output 1008 is zero when the frequency of input signal 1006 is $f_2$ and the amplitude of output 1008 with respect to input 1006 is a linear interpolated amplitude at frequencies between $f_1$ and $f_2$. Discriminator circuit 1004 is a positive slope discrimination circuit between frequencies $f_1$ and $f_2$ and is similar to discriminator 1002. Therefore, a desired microwave pulse scaled in frequency, would be split and passed through the two discriminator circuits 1002 and 1004. This would create two source frequencies to drive the non-deflecting acousto-optic modulators in FIG. 41 where output 1008 drives the modulator for beam 1 and output 1010 drives the modulator for beam 2 so that the amplitude of the modulated beam 1 corresponds to the amplitude of output 1008 and the amplitude of the modulated beam 2 corresponds to the amplitude of output 1010.

When the desired microwave pulse is a chirp pulse which is applied to input 1006, the chirp pulse would be split and passed through discriminator circuits 1008 and 1010. Thus, in addition to the reference beam, the first and second beams would impinge on the fiber pickup plane on the fiber arrays with relative amplitudes according to the frequency of the chirp pulse. If the microwave source were sinusoid at frequency $f_1$, beam 2 would have zero weight and the gradient which is established by the beam deflector for beam 1 is such as to radiate microwave frequency $f_1$ in the desired microwave beam launch direction. On the other hand, if the microwave frequency is a sinusoid at frequency $f_2$, beam 1 would have zero weight and the gradient which is established by the beam deflector is such as to radiate microwave frequency $f_2$ in the desired microwave beam launch direction. If a frequency intermediate to $f_1$ and $f_2$ were applied, both beams would be excited but with a weight determined by the discrimination circuitry. Since both beams would be excited at the same frequency with only the amplitude weighting of the beams being different, an intermediate effective plane wave would be generated. Because of the small angles on the optical side of the circuit, the interpolation is linear and the proper phase gradient is established to transmit each Fourier component in the direction desired.

This can be seen by considering the signal which results from superimposing two plane waves of the same wave number magnitude but different propagation directions. Obviously one has to get interference since this is the basis of the classic Lloyd's mirror experiment in optics. In equation form, the interference is described as $$a_1 cos\ (\omega t+\phi_1)+a_2\ cos\ (\omega t+\phi_2)=N\ cos\ (\omega t\ +\phi),$$

where the amplitudes on the left are related by the response of the discriminator circuits (i.e., $a_1=1-a_2$) and where the subscripted phase terms are $Ky*\sin(\theta_i)$. Upon applying elementary trigonometric transformations, N and $\phi$ is evaluated as $$N=\sqrt{((a_1\cos(\phi_1)+a_2\cos(\phi_2))^2+(a_1\sin(\phi_1)+a_2\sin(\phi_2))^2}\text{, and}$$

$$\tan(\phi)=(a_1\cos(\Phi_1)+a_2\cos(\Phi_2))^2+(a_1\sin(\Phi_1)+a_2\sin(\Phi_2))^2,$$

where the amplitude terms, $a_i$, are a function of the operating frequency only and whereas the phase terms are a function of the position of the array and the two design frequencies involved in the chirp waveform and discriminator circuits. The expression for N shows the required interference effect. A numerical examination of the resulting phase term shows it to be a linear function of operating frequency and element position with only weak quadratic errors (even weaker quartic and higher frequency terms). Such errors can be compensated for in the optical circuit by introducing opposite spherical curvature of phase front by movement of one of the lenses.

The linear phase shift introduced on the frequency components performs the necessary operation to allow broad band beam steering. Fourier($s_0(t)$) is defined to be $S(\omega)$, where Fourier() is used to denote the Fourier transform operator and the subscript denotes the fiber under consideration. To have true time delay performance, the signal at the ith fiber should then be $$Fourier(s_0(t))=\text{Fourier}(s_0(t-\tau_i))=exp(j\omega\tau_i)*S(\omega).$$

This expresses the fact that the Fourier transform of a time delayed version of a signal is a linear phase shift of the spectrum. In an optical system, the signal at the ith element is given as $$Fourier(s_0(t)*exp(jy_iK_p))=exp(jy_ik_p)*S(\omega).$$

For time delay performance to result, the terms in the exponential must be identical. The gradients can be computed by equating the phase shift between elements on the fiber side to that on the antenna side, namely $$yK_p=Yk_p,\text{ and}$$

$$yK\sin(\theta)=Yk\sin(\Theta),$$

where subscript p denotes projection into antenna or fiber optic plane. This yields $$\tau_i=Y_i\sin(\Theta)/c,$$

if $$\sin(\theta)=\Delta Y\omega\sin(\Theta)/\Delta y\Omega,$$

where $\Delta Y$ is the antenna element spacing and $\Delta y$ is the fiber spacing. The discriminator circuit performs the correct operation for creating apparent time delays without introducing delay lines. The apparent delay comes from the progressive phase shift with frequency introduced by the optical system. By superposition, a pulse whose spectrum is contained in the discriminated frequency interval could be expected to be launched in the proper direction.

To receive a wide band signal a different discriminator, operating in the local oscillator band, must be used. The reflector must position the corresponding two point sources of light on the opposite side of the reference beam to allow a conjugation of the spatial phase variation. In one possible realization, the local oscillator spectrum should comprise a set of discrete frequencies separated by the bandwidth of the signal to be received. This will map contiguous subbands of the RF signal to well separated IF frequencies. An IF filter of identical width of the subbands will then avoid the ambiguities implicit in the phase gradient relationship $\omega\text{Sin}\ \Theta$. A second IF stage can be used to reconstitute the received signal or the subbands can be digitized at the first IF outputs.

TWENTY-FIRST EMBODIMENT

One of the most accurate methods for reducing radar clutter with moving array antennas, such as when the phased array antenna is mounted in a moving aircraft, uses the displaced phased center array (DPCA) concept. In this concept, subarrays are formed to obtain separate signal returns; however, all radiating and receiving elements are in exactly the same position. A subtraction of two returns from different subarrays then cancel all fix returns while giving a "dipole" signature for moving targets. Such switching can be incorporated in an optically fed array by the act of shifting the fiber pickup array illumination appropriately. This can be accomplished in a number of ways, either mechanically (by mirror rotations) or electrically (by acousto-optic cell drives). Under-illuminating the fiber pickup array allows optical beam displacements to shift the microwave radiating aperture from one subarray to another.

Figure 43:
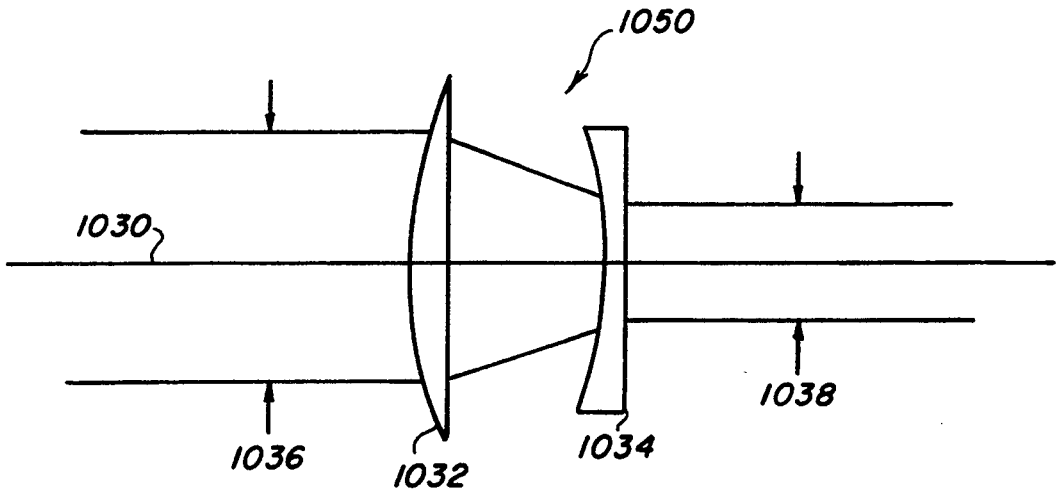
FIG. 43 is an optical beam expander/compressor.

FIG. 43 is a beam expander/compressor. Planar optical beams traveling from left to right in FIG. 43 and having beam diameter 1036 are focused by converging lens 1032 and concave lens 1034 to form an optical beam having diameter 1038. It will be appreciated that shadow masks may be applied in either large diameter side 1036 or the small diameter side 1038 to provide amplitude weighting across the cross-section of the beam. It will further be appreciated that the beam expander/compressor described with reference to FIG. 43 operates as a compressor when the beam travels from left to right and operates as an expanded when the beam travels from right to left. Beam expansion/compression can incorporate anamorphic components to create non-circular beams. It will be appreciated that the above techniques are more efficient than the simple method of using aperture masks to limit the size of an optical beam.

Figure 44:
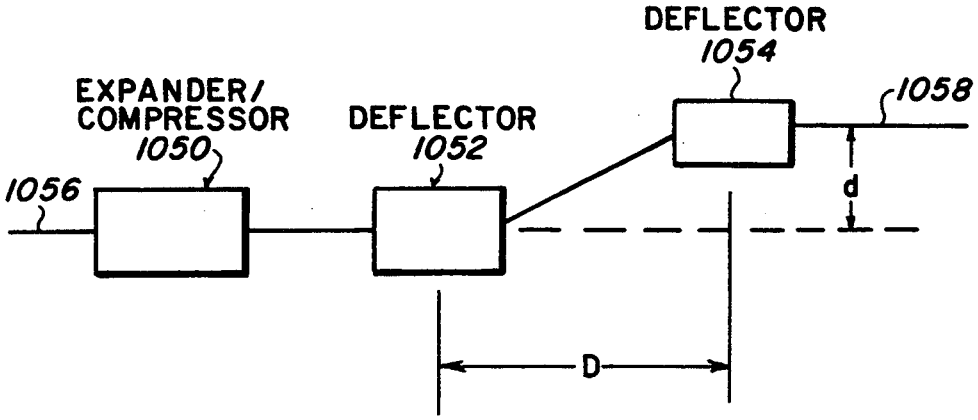
FIG. 44 is an optical schematic for an optical circuit for producing a displaced beam.

In FIG. 44 input beam 1056 enters beam expander/-compressor 1050 and passes successively through non-modulating beam deflector 10! 52 and non-modulating beam deflector 1054. Non-modulating beam deflectors 1052 and 1054 are non-modulating acousto-optic beam deflectors as described in other embodiments of this invention disclosure. Beam deflector 1054 is disposed in a downstream direction with respect to beam deflector 1052, where downstream is defined as relative positions along an optical axis. Beam deflectors 1052 and 1054 are driven with beam deflecting control signals cooperating to provide beam displacement d when beam deflector 1054 is disposed at a distance D from beam deflector 1052. The displaced beam 1058 is parallel with the input beam 1056. It will be appreciated that the displacement direction d may be in the X axis or the Y axis. It will further be appreciated that an additional pair of beam deflectors corresponding to beam deflectors 1052 and 1054 may be interposed in the optical path to provide an additional beam displacement direction so that the beam may be displaced along both the X axis and the Y axis.

It will be appreciated that the above concatenation of non-deflecting modulators implements a non-deflecting, non-modulating beam displacer. It is necessary, however, to utilize lenses of differing focal lengths, i.e. in FIG. 3 lenses 6 and 10 can be of one focal length and lenses 14 and 24 are of a different focal length. Concatenated cell w must be driven by identical control frequencies.

By using beam expander/contractor to form an under-illuminated beam illuminating the fiber array of the optically fed phased array antenna described in other embodiments of this invention, it is possible to produce a subarray.

By using the beam deflector 1052 paired with 1054, it is possible to displace the phase center of the subarray to produce the "dipole" signature for moving targets. Under-illuminating the fiber pickup array allows optical beam displacements to shift the microwave radiating aperture from one subarray within the greater array to another. Such beam displacements can be effected by simply adding an additional x deflection acousto-optic beam deflector, for example, in the y deflection arm of the beam deflection circuit. Then the x subarray addressed is purely a function of the difference in frequency of the x deflection cells. In this manner the DPCA subarrays can be electronically addressed and the DPCA algorithm implemented. Because of under-illumination, the amplitude weighting would likely be of a gaussian distribution leading to a low sidelobe antenna pattern.

Figure 45:
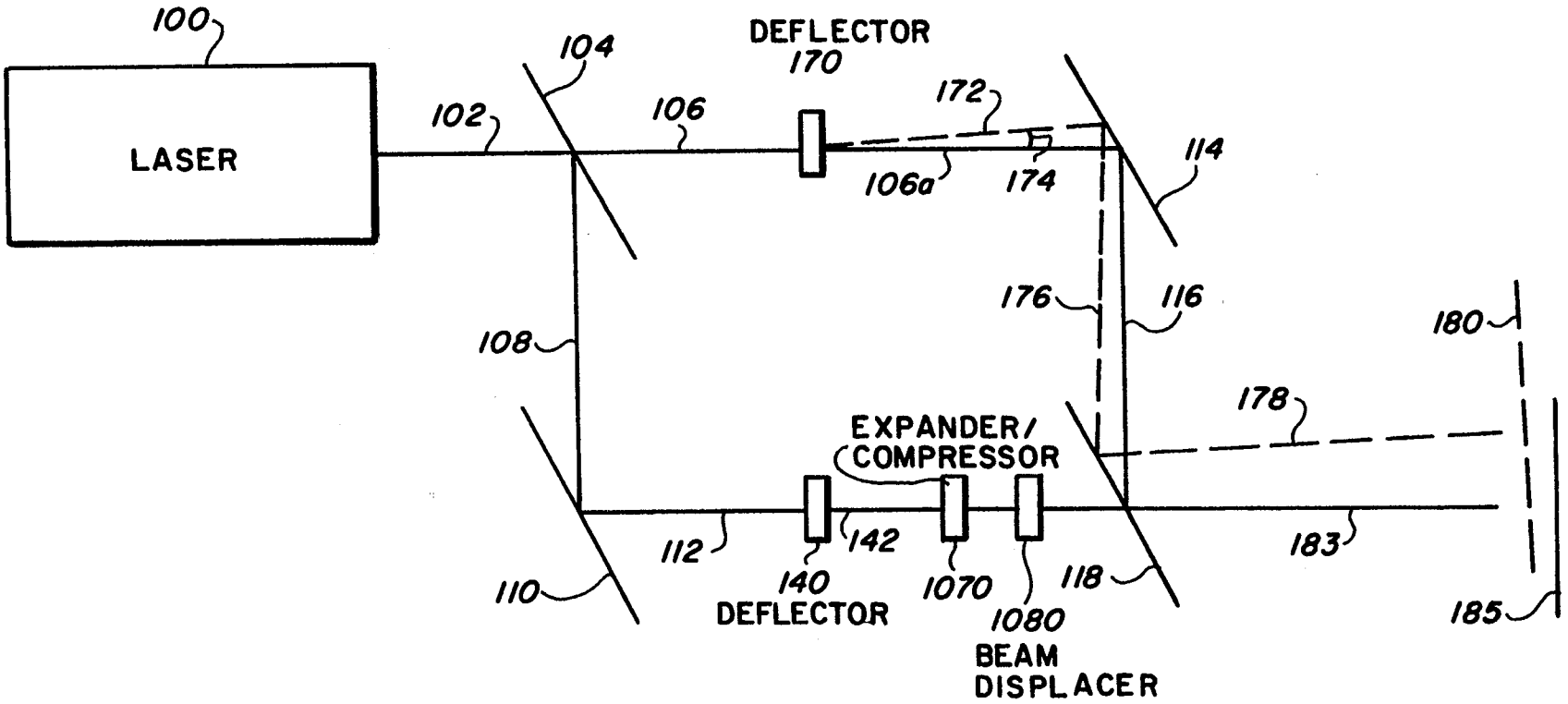
FIG. 45 is an optical schematic of a circuit for producing a displaced phase center aperture.

FIG. 45 is an interferometer as described in the embodiment discussed with reference to FIG. 9, except that beam expander/compressor 1070 and beam displacer 1080 is disposed in modulated beam 142. With this configuration an under-illuminated subarray is produced by combining beams on combiner 118.

The invention has been described with reference to its preferred embodiments which are intended to be illustrative and not limiting. For example, the two beam monopulse function described in the embodiment described with reference to FIG. 15 may be employed in the embodiment described with reference to FIG. 18 or the embodiment described with reference to FIG. 19. For example, the conformal array described with reference to the embodiment described with reference to FIGS. 16 and 17 may be employed in the embodiments described with reference to FIG. 11 and FIG. 18. For example, the two axes beam forming described in the embodiment described with reference to FIGS. 19 and 20 or FIG. 23 may be employed in the conformal array described in the embodiment described with reference to FIGS. 16 and 17. Various changes and modifications may be made by persons skilled in the art without departing from the spirit and scope of the invention.

I claim:

1. A fiber optic feed comprising:

optical circuit means for providing at least one optical output signal modulated according to an RF source; and antenna interface means for demodulating said at least one optical output signal and communicating with an antenna;

wherein said optical circuit means comprises:

a coherent light source;

interferometer means driven by said coherent light source for synthesizing a plurality of independently controlled beams;

optic modulating means for frequency modulating at least one of said independently controlled beams according to said RF source; and optic pickup means for producing said at least one optical output signal according to a superposition of said plurality of independently controlled beams.

2. The fiber optic feed of claim 1, wherein said optic modulating means comprises a non-deflecting electro-optic modulator.

3. The fiber optic feed of claim 1, wherein said optic modulating means comprises a non-deflecting acousto-optic modulator.

4. The fiber optic feed of claim 1, wherein said interferometer means comprises beam deflecting means for angularly deflecting at least one of said plurality of independently controlled beams according to a beam control command.

5. The fiber optic feed of claim 4, wherein said optic pickup means comprises at least one pickup element positioned with respect to said interferometer means so as to collect a spatial portion of said superposition of said plurality of independently controlled beams and so that at any time a difference in a phase of one beam relative to a phase of another beam depends upon said position of said at least one pickup element.

6. The fiber optic feed of claim 5, wherein said antenna interface means comprises detector means for detecting at least one RF signal having a frequency within a bandwidth about a frequency of said RF source.

7. The fiber optic feed of claim 4, wherein said beam deflecting means comprises at least one non-modulating acousto-optic beam deflector.

8. The fiber optic feed of claim 4, wherein said beam deflecting means comprises a mirror.

9. The fiber optic feed of claim 7, wherein said beam control command comprises a signal having a frequency determinative of a desired beam deflection angle.

10. The fiber optic feed of claim 4, wherein:

said optic pickup means comprises a plurality of optic pickup elements arranged in an array, each optic pickup element positioned with respect to said interferometer means so as to collect a spatial portion of said superposition of said plurality of independently controlled planar beams and so that at any time a difference in a phase of one beam relative to a phase of another beam depends upon a position of said each optic pickup element within said array;

said at least one optical output signal comprises a plurality of optical output signals, each optical output signal being derived from said spatial portion collected by a corresponding optic pickup element; and said antenna interface means comprises an array of detector elements, each detector element corresponding to a respective optic pickup element.

11. The fiber optic feed of claim 10, wherein said array of pickup elements is a planar array.

12. The fiber optic feed of claim 10, wherein one of said plurality of indpendently controlled beams is non-planar to compensate for a conformal array of RF radiating elements.

13. The fiber optic feed of claim 10, wherein each of said detector elements comprises a detector corresponding to a respective pickup element for producing a corresponding RF signal within a frequency bandwidth about a frequency of said RF.

14. The fiber optic feed of claim 13, wherein each of said RF signals has a phase relative to at least one other RF signal based on a position of an optic pickup element corresponding to said each RF signal relative to a position of an optic pickup element corresponding to said at least one other RF signal.

15. The fiber optic feed of claim 1, wherein said interferometer means comprises at least one coherent light amplifier, each coherent light amplifier being disposed in a corresponding one of said plurality of independently controlled beams.

16. The fiber optic feed of claim 15, wherein said optic modulating means is disposed in at least one of said plurality of independently controlled beams between a respective one of said at least one coherent light amplifier and said coherent light source so that an input to said coherent light amplifier is a modulated light beam.

17. The fiber optic feed of claim 16, wherein said modulation means comprises a non-deflecting acousto-optic modulator.

18. The fiber optic feed of claim 16, wherein said modulation means comprises a conventional acousto-optic modulator so that said modulation means deflects light from said coherent light source according to a frequency of said RF source so as to deflect said light from said coherent light source into said input to said coherent light amplifier.

19. The fiber optic feed of claim 15, wherein:

said at least one coherent light amplifier comprises a plurality of coherent light amplifiers;

said modulating means comprises at least one non-deflecting modulator, each modulator having an input which is driven by an output of a corresponding one of said plurality of coherent light amplifiers; and said interferometer means further comprises at least one beam deflector, an input to which is driven by a corresponding output of said at least one non-deflecting modulator and a combining means for combining outputs of said at least one beam deflector.

20. The fiber optic feed of claim 4, wherein:

said beam deflecting means comprises at least one conventional acousto-optic beam deflector; and said beam control command comprises a signal having plural frequency components so that said at least one of said plurality of independently controlled beams in which said beam deflecting means is disposed is split and deflected into plural beam components having deflection angles corresponding to and defined by respective ones of said plural frequency components.

21. The fiber optic feed of claim 4, wherein:

said plurality of independently controlled beams comprises a reference beam, a main beam and at least one auxiliary beam;

said beam deflecting means comprises a reference beam deflector disposed in said reference beam, a main beam deflector disposed in said main beam, at least one auxiliary beam deflector disposed in corresponding beams of said at least one auxiliary beam, and at least one amplitude/phase control means for controlling amplitudes and phases of beams passing through corresponding beam deflectors of said at least one auxiliary beam deflector so that said controlled amplitudes and phases are controlled relative to an amplitude and phase of said main beam as deflected by said main beam deflector.

22. The fiber optic feed of claim 21, wherein said reference beam deflector, said main beam deflector and each of said auxiliary beam deflectors are conventional acousto-optic beam deflectors, said reference beam deflector being so oriented with respect to each of said main beam deflector and each auxiliary beam deflector so as to deflect said reference beam in a same plane and in an opposite direction to each of the other beam deflectors, and all beam deflectors being so oriented as to modulate frequencies of all beams to one of increase and decrease said frequencies by equal amounts.

23. The fiber optic feed of claim 21, wherein said beam deflecting means further comprises:

pointing means for further deflecting each of said at least one auxiliary beam.

24. The fiber optic feed of claim 23, wherein said pointing means comprises a non-modulating acousto-optic beam deflector.

25. The fiber optic feed of claim 4, wherein said at least one independently controlled beam comprises two beams, and wherein said beam deflecting means comprises two beam deflectors, each beam deflector disposed in separate beams.

26. The fiber optic feed of claim 15, wherein a phase of an output of said at least one coherent light amplifier is phased-locked to a phase of an output of said coherent light source.

27. The fiber optic feed of claim 4, wherein said beam deflecting means comprises two beam deflectors disposed in said at least one of said plurality of independently controlled beams and oriented so that a first beam deflector deflects said at least one beam in a first direction and so that a second beam deflector deflects said at least one beam in a second direction substantially orthogonal to said first direction.

28. The fiber optic feed of claim 4, wherein:

said interferometer means further comprises splitter means for producing a plurality of identical phase gradient beams, each of said phase gradient beams being based on said superposition of said plurality of independently controlled beams; and said fiber optic pickup means comprises at least one pickup element positioned with respect to said splitter means in each of said plurality of identical phase gradient beams.

29. The fiber optic feed of claim 10, wherein said interferometer means further comprises beam expander/compressor means for under-illuminating said array of optic pickup elements and beam displacer means for displacing a phase center of an illuminated portion of said array of optic pickup elements.

30. The fiber optic feed of claim 4, wherein said beam deflecting means comprises a first pair of beam deflectors disposed in a first one of said plurality of independently controlled beams and oriented so that a first beam deflector of said first pair deflects said first one of said plurality of beams in a first direction and so that a second beam deflector of said first pair deflects said first one of said plurality of beams in a second direction substantially orthogonal to said first direction; and a second pair of beam deflectors disposed in a second one of said plurality of independently controlled beams and oriented so that a first beam deflector of said second pair deflects said second one of said plurality of beams in said first direction and so that a second beam deflector of said second pair deflects said second one of said plurality of beams in said second direction.

31. The fiber optic feed of claim 30, wherein:

said first beam deflector of said first pair cooperates with said first beam deflector of said second pair to modulate respective first and second beams to one of increase and decrease a frequency of said first and second beams by equal amounts; and said second beam deflector of said first pair cooperates with said second beam deflector of said second pair to modulate respective first and second beams to one of increase and decrease a frequency of said first and second beams by equal amounts.

32. The fiber optic feed of claim 1, wherein the plurality of independently controlled beams are planar.

33. The fiber optic feed of claim 1, wherein the plurality of independently controlled beams are non-planar.

34. A phased array antenna comprising:

optical circuit means for providing at least one optical output signal modulated according to an RF source; and module means for demodulating said at least one optical output signal and communicating with at least one RF radiating element;

wherein said optical circuit means comprises:

a coherent light source;

interferometer means driven by said coherent light source for synthesizing a plurality of independently controlled planar beams;

optic modulating means for frequency modulating at least one of said independently controlled planar beams according to said RF source; and optic pickup means for producing said at least one optical output signal according to a superposition of said plurality of independently controlled planar beams.

* * * * *